US006312862B1

(12) United States Patent
Okado et al.

(10) Patent No.: US 6,312,862 B1
(45) **Date of Patent: *Nov. 6, 2001**

(54) TWO-COMPONENT TYPE DEVELOPER AND IMAGE FORMING METHOD

(75) Inventors: Kenji Okado, Yokohama; Ryoichi Fujita, Odawara; Yushi Mikuriya; Shinya Yachi, both of Numazu; Kazumi Yoshizaki, Mishima, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/434,401

(22) Filed: Nov. 5, 1999

(30) Foreign Application Priority Data

Nov. 6, 1998 (JP) ..... 10-315229
Nov. 6, 1998 (JP) ..... 10-315230
Nov. 6, 1998 (JP) ..... 10-315234

(51) Int. Cl.[7] ..... G03G 9/113
(52) U.S. Cl. ..... 430/110; 430/108; 430/126
(58) Field of Search ..... 430/106, 108, 430/110, 126

(56) References Cited

U.S. PATENT DOCUMENTS

| | | | | |
|---|---|---|---|---|
| 2,297,691 | | 10/1942 | Carlson | 430/55 |
| 5,618,647 | * | 4/1997 | Kukimoto et al. | 430/106.6 |
| 5,766,814 | * | 6/1998 | Baba et al. | 430/108 |
| 5,994,019 | | 11/1999 | Okado et al. | 430/126 |
| 6,013,406 | | 1/2000 | Moriki et al. | 430/110 |
| 6,033,817 | * | 3/2000 | Yusa et al. | 430/106.6 |
| 6,106,987 | | 8/2000 | Hakata et al. | 430/106.6 |

FOREIGN PATENT DOCUMENTS

| | | |
|---|---|---|
| 0708379 | 4/1996 | (EP) . |
| 0801335 | 10/1997 | (EP) . |
| 0867779 | 9/1998 | (EP) . |
| 36-10231 | 7/1961 | (JP) . |
| 42-23910 | 11/1967 | (JP) . |
| 43-24748 | 10/1968 | (JP) . |
| 54-066134 | 5/1979 | (JP) . |
| 58-021750 | 2/1983 | (JP) . |
| 59-053856 | 3/1984 | (JP) . |
| 59-061842 | 4/1984 | (JP) . |
| 7-010452 | 1/1985 | (JP) . |
| 61-009659 | 1/1986 | (JP) . |
| 4-198946 | 7/1992 | (JP) . |
| 10-039547 | 2/1998 | (JP) . |
| 10-039589 | 2/1998 | (JP) . |

OTHER PUBLICATIONS

Patent Abstracts of Japan, vol. 18, No. 387 (P–1773) Jul. 1994 for JP 06–110255.

Patent Abstracts of Japan, vol. 18, No. 178 (P–1717) for JP 05–341580.

* cited by examiner

*Primary Examiner*—John Goodrow
(74) *Attorney, Agent, or Firm*—Fitzpatrick, Cella, Harper & Scinto

(57) ABSTRACT

A two-component type developer has a negatively chargeable toner having toner particles and an external additive and a magnetic-fine-particle-dispersed resin carrier. The magnetic-fine-particle-dispersed resin carrier has composite particles containing at least inorganic compound particles and a binder resin. The inorganic compound particles have been surface-treated with a lipophilic-treating agent having at least one type of functional group (A) selected from the group consisting of an epoxy group, an amino group, a mercapto group, an organic acid group, an ester group, a ketone group, an alkyl halide group and an aldehyde group, or a mixture of the agent. The composite particles have been surface-coated with at least one type of coupling agent having at least one type of functional group (B) different from the functional group (A) the lipophilic-treating agent. The functional group (B) the coupling agent has being a functional group or groups selected from the group consisting of an epoxy group, an amino group and a mercapto group. The negatively chargeable toner has a weight-average particle diameter of from 3 $\mu$m to 9 $\mu$m.

115 Claims, 5 Drawing Sheets

TWO-COMPONENT TYPE DEVELOPER AND IMAGE FORMING METHOD

BACKGROUND OF THE INVENTION

1. Field of the Invention

This invention relates to a two-component type developer employing a magnetic carrier, used to develop electrostatic images used to develop electrostatic images in electrophotography, electrostatic recording and so forth. It also relates to an image forming method.

2. Related Background Art

As electrophotography, various methods are disclosed in U.S. Pat. No. 2,297,691, Japanese Patent Publications No. 42-23910 and No. 43-24748 and so forth. In these methods, copies or prints are obtained by forming an electrostatic latent image on a photosensitive layer of an electrostatic image bearing member upon irradiation of a light image to form an electrostatic image, subsequently causing a toner to be attracted onto the electrostatic image to develop it to form a toner image, and transferring the toner image to a transfer medium such as paper as occasion calls, followed by fixing by heat, pressure, heat and pressure, or solvent vapor.

In the step of developing the electrostatic image, the toner image is formed by utilizing an electrostatic mutual action between a toner triboelectrically charged and the electrostatic image. Among methods of developing electrostatic images by the use of toners, a developing method making use of a two-component type developer formed of a blend of toner and carrier is commonly preferably used in full-color copying machines or printers which are required to form high-quality images.

In such a developing method, the carrier imparts positive or negative electric charge to the toner in an appropriate quantity by triboelectric charging, and carries the toner on its surface by electrostatic attraction attributable to the triboelectric charging.

The developer having the toner and the carrier is coated on a developing sleeve internally provided with a magnet, in a prescribed layer thickness by means of a developer layer thickness regulation member, and then transported, by utilizing a magnetic force, to a developing zone formed between the electrostatic image bearing member (photosensitive member) and the developing sleeve.

A certain development bias voltage is kept applied across the photosensitive member and the developing sleeve, and the toner participates in development on the photosensitive member In the developing zone.

There are various performances required for the carrier. Especially important performances may include appropriate charging performance, breakdown strength to applied voltage, impact resistance, wear resistance, spent resistance and development contribution.

For example, when developers are used for a long period, a toner called a spent-toner, which does not contribute to the development, may melt-adhere to the carrier surface to cause toner filming, so that this causes a deterioration of the developer and concurrently with it a deterioration of image quality of developed images.

In general, a carrier having too large a true specific gravity may apply a great load on the developer when the developer is formed on the developing sleeve in a prescribed layer thickness by means of the developer layer thickness or when the developer is agitated in a developing assembly. Thus, such a carrier may cause (a) toner filming, (b) carrier break and (c) toner deterioration. As the result, this tends to cause the deterioration of developer and concurrently with it the deterioration of image quality of developed images.

With an increase in particle diameter of carriers, the load applied to developer increases like the above, and hence the above (a) to (c) tend to occur, so that the deterioration of developer tends to occur. Also, (d) fine-line reproducibility In the developed images tends to lower.

Accordingly, carriers tending to cause the above (a) to (c) make it necessary to take time and labor to change developers for new ones periodically. Also, since such carriers are uneconomical, it is desirable to lessen the load applied to developers or to improve the impact resistance and spent resistance of carriers so as to prevent the above (a) to (c) and elongate the service life of developers.

Making the carrier have a smaller particle diameter makes (e) the carrier tend to adhere to the electrostatic image bearing member. Also, in an instance where the toner has a constant particle diameter and only the carrier is made to have a small particle diameter, (f) the toner has a broader charge quantity distribution to tend to cause a phenomenon that a toner having caused charge-up jumps unwantedly to non-image areas (hereinafter called "fog") especially when developed in an environment of low humidity.

As a carrier to solve the above problems (a) to (f), a magnetic-fine-particle-dispersed resin carrier is known in the art. This carrier has particles having less shape-originating strain, can relatively easily be made spherical, giving a high particle strength, and has a good fluidity. It also enables wide-range control of particle size distribution. Hence, this carrier is suited for high-speed copying machines or high-speed laser beam printers in which the developing sleeve or the magnet in the sleeve is rotated at a large number of revolutions.

The magnetic-fine-particle-dispersed resin carrier is disclosed in Japanese Patent Applications Laid-open No. 54-66134 and No. 61-9659. However, such a magnetic-particle carrier has a small saturation magnetization unless a magnetic material is incorporated in a large quantity. This tends to cause the carrier to adhere to the electrostatic image bearing member at the time of development, and may make it necessary to replenish the developer or to internally provide an image forming apparatus with a mechanism for collecting the carrier having adhered.

In the case when the magnetic material is incorporated in a large quantity in the magnetic-fine-particle-dispersed resin carrier, the magnetic material is-large in quantity with respect to the binder resin, resulting in a weak impact resistance. Thus, when the developer is formed on the developing sleeve in a prescribed layer thickness by means of the developer layer thickness regulation member, the magnetic material tends to come off the carrier, consequently tending to cause the deterioration of developer.

In addition, in the case when the magnetic material is incorporated in a large quantity in the magnetic-fine-particle-dispersed resin carrier, a magnetic material having a low resistivity is in large quantity to make the carrier have a low resistivity. As the result, faulty images tend to occur because of a leak of bias voltage applied at the time of development.

A technique to coat carrier cores with a resin is disclosed in Japanese Patent Application Laid-open No. 58-21750. Such a resin-coated carrier can be improved in spent resistance, impact resistance and breakdown strength to applied voltage. Also, on account of charging properties of the resin for coating, the charging performance of the toner can be controlled. Accordingly, the desired electric charges can be imparted to the toner by selecting resins for coating.

However, even in the resin-coated carrier, when the resin is coated in a large quantity and the resistivity of carrier is high, the phenomenon of charge-up of toner tends to occur in an environment of low humidity. Also, when the resin is coated in a small quantity, the carrier may have so excessively low a resistivity that faulty images tend to occur because of a leak of bias voltage.

Even when the resistivity of resin-coated carrier is judged to be a proper resistivity on measurement, some coating resins tend to cause faulty images because of a leak of development bias voltage or tend to cause the phenomenon of charge-up of toner in an environment of low humidity.

As a carrier improved in surface contamination resistance, impact resistance, environmental dependence of charging, rise of charging, exchange performance of electric charges and so forth, Japanese Patent Application Laid-open No 4-198946 discloses a magnetic carrier comprising magnetic core particles surface-treated with an aminosilane coupling agent and having coat layers formed of a resin having functional groups capable of reacting with it. Japanese Patent Applications Laid-open No. 7-10452, No. 10-39547 and No. 10-39549 (U.S. Pat. No. 5,766,814) disclose a magnetic carrier provided with silicone resin coat layers containing a silane coupling agent. However, in the carriers disclosed in the above publications, it is difficult to control the reactivity of the silane coupling agent. As the result, charge characteristics tend to vary under the influence of residual functional groups and unreacted matter and also the resistivity can be controlled with difficulty. Thus, there remains a problem for imparting stably to the toner a sufficient charging performance having less environmental variations. In developers also proposed, the coat resin adheres in such an insufficient strength that the coat resin tends to come off when large-area images involving a large toner consumption are copied on a large number of sheets, tending to cause changes in charge quantity of toners.

Thus, it is sought to provide a magnetic carrier that can meet severe requirements nowadays made on quality, e.g., can be adapted to various copying objects such as fine lines, small characters, photographs and color originals and also can satisfy the achievement of high image quality, high grade, high speed and high running performance.

SUMMARY OF THE INVENTION

An object of the present invention is to provide a two-component type developer making use of a magnetic carrier having solved the problems discussed above.

Another object of the present invention is to provide a two-component type developer making use of a magnetic carrier that is free from carrier adhesion, can prevent or keep fog from occurring and can form high-quality toner images.

Still another object of the present invention is to provide a two-component type developer making use of a magnetic carrier that does not depend on temperature and humidity and can form highly minute color toner images in a high image density.

A further object of the present invention is to provide a two-component type developer making use of a magnetic carrier that can be free from image deterioration even in image reproduction on a large number of sheets, promising a superior running performance.

A still further object of the present invention is to provide an image forming method making use of the above two-component type developer.

To achieve the above objects, the present invention provides a two-component type developer comprising a negatively chargeable toner having toner particles and an external additive and a magnetic-fine-particle-dispersed resin carrier;

wherein;

i) the magnetic-fine-particle-dispersed resin carrier comprises composite particles containing at least inorganic compound particles and a binder resin;

the inorganic compound particles having been surface-treated with a lipophilic-treating agent having at least one type of functional group (A) selected from the group consisting of an epoxy group, an amino group, a mercapto group, an organic acid group, an ester group, a ketone group, an alkyl halide group and an aldehyde group, or a mixture of the agent; and the composite particles having been surface-coated with at least one type of coupling agent having at least one type of functional group (B) different from the functional group (A) the lipophilic-treating agent has;

the functional group (B) the coupling agent has being a functional group or groups selected from the group consisting of an epoxy group, an amino group and a mercapto group; and ii) the negatively chargeable toner has a weight-average particle diameter of from 3 $\mu$m to 9 $\mu$m.

In another embodiment of the developer, the present invention provides a two-component type developer comprising a negatively chargeable toner having toner particles and an external additive and a magnetic-fine-particle-dispersed resin carrier;

wherein;

i) the magnetic-fine-particle-dispersed resin carrier comprises composite particles containing at least inorganic compound particles and a binder resin;

the inorganic compound particles having been surface-treated with a lipophilic-treating agent having at least one type of functional group (A) selected from the group consisting of an epoxy group, an amino group, a mercapto group, an organic acid group, an ester group, a ketone group, an alkyl halide group and an aldehyde group, or a mixture of the agent; and the composite particles having been surface-coated with at least one type of resin having at least one type of functional group (C) different from the functional group (A) the lipophilic-treating agent has;

the functional group (C) the resin has being a functional group or groups selected from the group consisting of an epoxy group, an amino group, an organic acid group, an ester group, a ketone group, an alkyl halide group, a hydroxyl group and a chloro group; and ii) the negatively chargeable toner has a weight-average particle diameter of from 3 $\mu$m to 9 $\mu$m.

The present invention also provides an image forming method comprising;

charging an electrostatic image bearing member electrostatically by a charging means;

exposing the electrostatic image bearing member thus charged, to form an electrostatic image on the electrostatic image bearing member;

developing the electrostatic image by a developing means having a two-component type developer, to form a toner image on the electrostatic image bearing member;

transferring the toner image formed on the electrostatic image bearing member, to a transfer medium via, or not via, an intermediate transfer member; and fixing the toner image on the transfer medium by a heat-and-pressure fixing means;

the two-component type developer comprising a negatively chargeable toner having toner particles and an external additive and a magnetic-fine-particle-dispersed resin carrier;

wherein;

i) the magnetic-fine-particle-dispersed resin carrier comprises composite particles containing at least inorganic compound particles and a binder resin;

the inorganic compound particles having been surface-treated with a lipophilic-treating agent having at least one type of functional group (A) selected from the group consisting of an epoxy group, an amino group, a mercapto group, an organic acid group, an ester group, a ketone group, an alkyl halide group and an aldehyde group, or a mixture of the agent; and the composite particles having been surface-coated with at least one type of coupling agent having at least one type of functional group (B) different from the functional group (A) the lipophilic-treating agent has;

the functional group (B) the coupling agent has being a functional group or groups selected from the group consisting of an epoxy group, an amino group and a mercapto group; and ii) the negatively chargeable toner has a weight-average particle diameter of from 3 $\mu$m to 9 $\mu$m.

In another embodiment of the method, the present invention provides an image forming method comprising;

charging an electrostatic image bearing member electrostatically by a charging means;

exposing the electrostatic image bearing member thus charged, to form an electrostatic image on the electrostatic image bearing member;

developing the electrostatic image by a developing means having a two-component type developer, to form a toner image on the electrostatic image bearing member;

transferring the toner image formed on the electrostatic image bearing member, to a transfer medium via, or not via, an intermediate transfer member; and fixing the toner image on the transfer medium by a heat-and-pressure fixing means;

the two-component type developer comprising a negatively chargeable toner having toner particles and an external additive and a magnetic-fine-particle-dispersed resin carrier;

wherein;

i) the magnetic-fine-particle-dispersed resin carrier comprises composite particles containing at least inorganic compound particles and a binder resin;

the inorganic compound particles having been surface-treated with a lipophilic-treating agent having at least one type of functional group (A) selected from the group consisting of an epoxy group, an amino group, a mercapto group, an organic acid group, an ester group, a ketone group, an alkyl halide group and an aldehyde group, or a mixture of the agent; and the composite particles having been surface-coated with at least one type of resin having at least one type of functional group (C) different from the functional group (A) the lipophilic-treating agent has;

the functional group (C) the resin has being a functional group or groups selected from the group consisting of an epoxy group, an amino group, an organic acid group, an ester group, a ketone group, an alkyl halide group, a hydroxyl group and a chloro group; and ii) the negatively chargeable toner has a weight-average particle diameter of from 3 $\mu$m to 9 $\mu$m.

DESCRIPTION OF THE PREFERRED EMBODIMENTS

Figure 1:
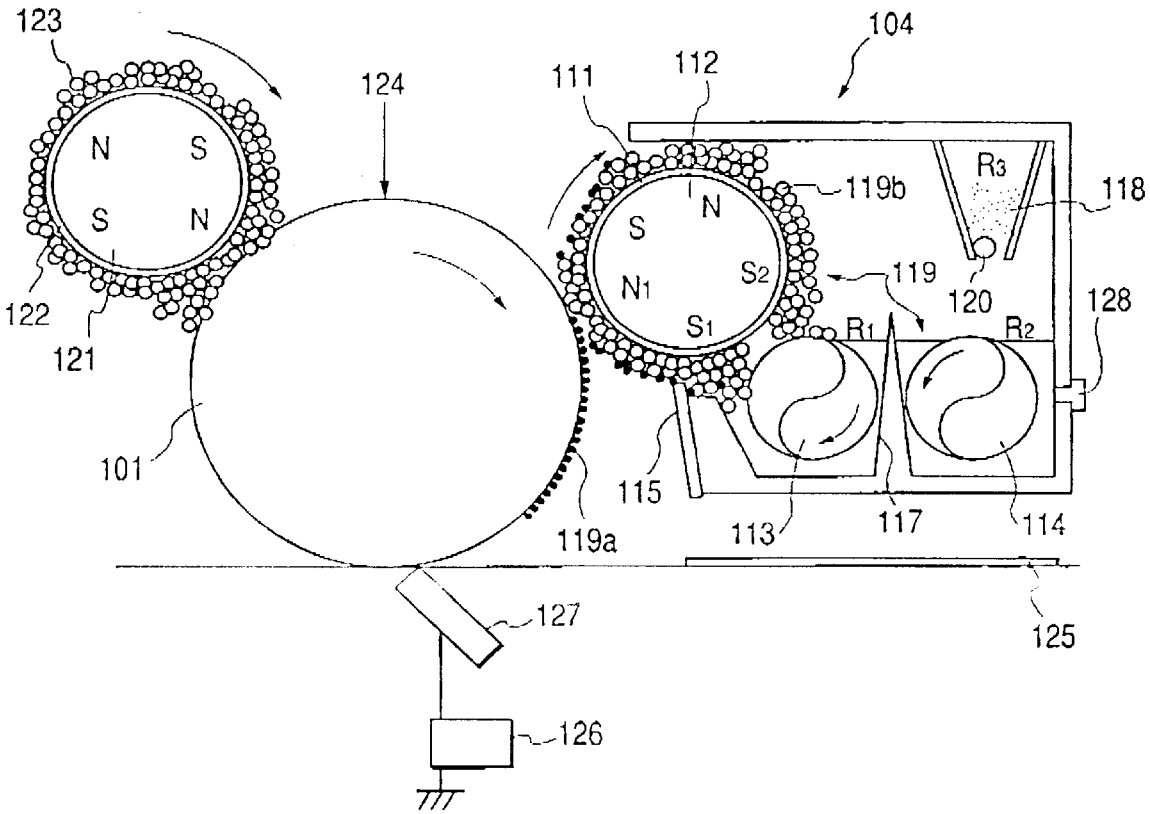
FIG. 1 is a diagrammatic illustration of a preferred example of an image forming apparatus, used to carry out the image forming method according to the present invention.

The present inventors made various researches and studies in order to solve the problems discussed previously. As the result, they have discovered that a developer prepared in combination with a) a magnetic carrier comprising a magnetic-fine-particle-dispersed resin carrier i) containing magnetic fine particles (inorganic compound particles) having been subjected to specific surface treatment and ii) having been surface-coated with a specific coupling agent with b) toner particles of 3 to 9 $\mu$m in weight-average particle diameter which may contain a solid wax in a specific quantity is effective for improving various properties. Thus, they have accomplished the present invention.

The toner used In the present invention will be described first. The toner is a negatively chargeable toner having toner particles and an external additive.

The toner used in the present invention has a weight-average particle diameter (D4) of from 3 to 9.0 $\mu$m, and preferably from 4.5 to 8.5 $\mu$m. Also, the cumulative value of distribution of diameter ½ time or less the number-average particle diameter may be not more than 20% by number and the cumulative value of distribution of diameter twice or more the weight-average particle diameter may be not more than 10% by volume This is preferred in order to impart good electric charge free of any reversal component and to improve reproducibility of latent-image dots. In order to more improve triboelectric charging performance of the toner and more improve the dot reproducibility, it is more preferred that the cumulative value of distribution of diameter ½-time or less the number-average particle diameter is not more than 15% by number and the cumulative value of distribution of diameter twice or more the weight-average particle diameter is not more than 5% by volume. It is still more preferred that the cumulative value of distribution of diameter ½-time or less the number-average particle diameter is not more than 10% by number and the cumulative value of distribution of diameter twice or more the weight-average particle diameter is not more than 2% by volume.

If the toner has a weight-average particle diameter (D4) larger than 9 $\mu$m, the toner that develops electrostatic images has large particles, and hence may make it difficult to perform development faithful to the electrostatic images even when the magnetic coated carrier has a low magnetic force. Also, the toner tends to scatter at the time of electrostatic transfer. A toner having a weight-average particle diameter (D4) smaller than 3 $\mu$m may bring about a low handling performance as a powder.

If the cumulative value of distribution of diameter ½-time or less the number-average particle diameter is more than 20% by number, the toner can not impart electric charge to fine toner particles well, resulting in a broad triboelectric distribution to tend to cause a problem of a charge in particle diameter during running because of poor charging (formation of reversal components) or localization of particle diameter of the toner participated in the development. If, on the other hand, the cumulative value of distribution of diameter twice or more the weight-average particle diameter is more than 10% by volume, the toner can not be triboelectrically charged well by the magnetic resin carrier and in addition it becomes difficult to develop electrostatic images faithfully.

Particle size distribution of the toner can be measured by, e.g., a method making use of a Coulter counter Specific measurement will be described later.

As a binder resin used in the toner, the following binder resins may be used.

For example, usable ones are homopolymers of styrene or derivatives thereof such as polystyrene poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl $\alpha$-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenolic resins, natural-resin-modified phenolic resins, natural-resin-modified maleic acid resins, acrylic resins, methacrylic resins, polyvinyl acetate, silicone resins, polyester resins, polyurethanes, polyamide resins, furan resins, epoxy resins, xylene resins, polyvinyl butyral, terpene resins, cumarone indene resins, and petroleum resins. As preferred binder resins, they include styrene copolymers and polyester resins. Cross-linked styrene resins are also preferred binder resins.

Comonomers copolymerizable with styrene monomers of the styrene copolymers may include vinyl monomers such as monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof as exemplified by maleic acid, butyl maleate, methyl maleate and dimethyl maleate; vinyl esters as exemplified by vinyl chloride, vinyl acetate and vinyl benzoate; olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether; any of which may be used alone or in combination of two or more.

In the present invention, the binder resin of the toner may have a THF-soluble matter preferably having a number-average molecular weight of from 3,000 to 1,000,000, and more preferably from 6,000 to 200,000.

The styrene polymers or styrene copolymers may be cross-linked or may be mixed resins of resins cross-linked and resins not cross-linked.

As a cross-linking agent, compounds mainly having at least two polymerizable double bonds may be used, including, for example, aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups; any of which may be used alone or in the form of a mixture.

The cross-linking agent may preferably be added in an amount of from 0.001 to 10 parts by weight based on 100 parts by weight of polymerizable monomer.

The toner may contain a charge control agent.

A charge control agent capable of controlling the toner to be negatively chargeable includes the following materials.

For example, organic metal complex salts and chelate compounds are effective, and also monoazo metal complexes, acetylyacetone metal complexes, aromatic hydroxycarboxylic acid and aromatic dicarboxylic acid type metal complexes The charge control agent may further include aromatic hydroxycarboxylic acids, aromatic mono- and polycarboxylic acids, and metal salts, anhydrides or esters thereof, phenol derivatives such as bisphenol; urea derivatives, metal-containing salicylic acid compounds, metal-containing naphthoic acid compounds, boron compounds, quaternary ammonium salts, carixarene, silicon compounds, a styrene-acrylic acid copolymer, a styrene-methacrylic acid copolymer, a styrene-acrylic-sulfonic acid copolymer, and non-metal carboxylic acid compounds. It is particularly preferred to use metal compounds of aromatic hydroxycarboxylic acids.

Any of these charge control agents may be used in an amount of from 0.01 to 20 parts by weight, preferably from 0.1 to 10 parts by weight, and more preferably from 0.2 to 4 parts by weight, based on 100 parts by weight of the resin components of the toner.

In the present invention, colorants as exemplified below may be used.

Carbon black, magnetic materials, and colorants toned in black by the use of yellow, magenta and cyan colorants shown below may be used as black colorants.

As a yellow colorant, condensation azo compounds, isoindollnone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 109, 110, 111, 128, 129, 147, 168 and 180 are preferably used. Dyes such as C.I. Solvent Yellow 162 may also be used in combination.

As a magenta colorant, condensation azo compounds, diketopyroropyyrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are preferably used.

As a cyan colorant, copper phthalocyanine compounds and derivatives thereof, anthraquinone compounds and basic dye lake compounds may be used Stated specifically, C.I. Pigment Blue 1, 7, 15, 15:1, 15:2, 15:3, 15:4, 60, 62 and 66 may particularly preferably be used.

Any of these colorants may be used alone, in the form of a mixture, or in the state of a solid solution. The colorants used in the present invention are selected taking account of hue angle, chroma, brightness, weatherability, transparency on OHP films and dispersibility in toner particles. The colorant may be added in an an amount of from 1 to 20 parts by weight based on 100 parts by weight of the resin compositions of the toner.

A wax may be contained in the toner. As preferable waxes, those may be used which have a ratio of weight-average molecular weight (Mw) to number-average molecular weight (Mn), Mw/Mn, of not more than 1.45, and more preferably not more than 1.30, in molecular weight distribution measured by gel permeation chromatography (GPC). When the wax has the value of Mw/Mn not more than 1.45, good uniformity of fixed images and good transfer performance can be achieved. Good results can also be obtained with regard to the prevention of contamination on a contact charging means which electrostatically charges the photosensitive member in contact with it.

A wax having, in addition to the value of Mw/Mn not more than 1.45, a solubility parameter of from 8.4 to 10.5 may also be used, whereby the toner can have a good fluidity and storage stability, and uniform fixed images free of uneven gloss can be obtained. Also, a toner can be obtained that may hardly contaminate any heating member of fixing assemblies and has a good fixing performance and good light transmission properties on fixed images. In addition, when full-color OHP images having a good transparency are formed by causing the toner to melt, part or the whole of the wax covers the heating member appropriately, and hence the full-color OHP images can be formed without causing any offset of the toner.

If the wax has a value of Mw/Mn more than 1.45, the toner may have a low fluidity to tend to cause uneven gloss on fixed images, and also the toner tends to have a low transfer performance and cause contamination on the contact charging means.

In the present invention, the molecular weight distribution of the wax are measured by GPC under conditions shown below.

GPC Measurement Conditions

Apparatus: GPC-150C (manufactured by Waters Co.)

Column: GMH-HT 30 cm, combination of two columns (available from Toso Co., Ltd.)

Temperature: 135° C.

Solvent: o-Dichlorobenzene (0.1% ionol-added)

Flow rate: 1.0 ml/min

Sample: 0.4 ml of sample with concentration of 0.15% is injected.

Molecular weight is measured under conditions shown above. Molecular weight of the sample is calculated using a molecular weight calibration curve prepared from a monodisperse polyurethane standard sample. The calculated value is further calculated by converting the value in terms of polyethylene according to a conversion expression derived from the Mark-Houwink viscosity equation.

The wax used in the present invention may preferably have a melting point of from 30 to 150° C., and more preferably from 50 to 120° C. If the wax has a melting point lower than 30° C., the toner tends to have low properties in respect of anti-blocking properties and prevention of developing sleeve contamination and photosensitive member contamination when copied on many sheets. If the wax has a melting point higher than 150° C., an excessive energy is required for its uniform mixing with the binder resin in the case of the process for producing toners by pulverization. In the case of the process for producing toners by polymerization, too, such a wax is not desirable because the production system must be made large-sized in order to make the viscosity higher so that it can be dispersed uniformly in binder resin or because the wax can not easily be incorporated in a large quantity as having a limit to quantity to melt together.

The melting point of the wax refers to the temperature corresponding to a main maximum peak value in the endothermic curve as measured according to ASTM D3418-8.

The measurement made according to ASTM D3418-8 is made using, e.g., DSC-7, manufactured by Perkin Elmer Co. The temperature at the detecting portion of the device is corrected on the basis of melting points of indium and zinc, and the calorie is corrected on the basis of heat of fusion of indium. The sample is put in a pan made of aluminum and an empty pan is set as a control, to make measurement at a rate of temperature rise of 10° C./min in the range of from 20 to 200° C.

The wax used in the present invention may have a melt viscosity at 100° C. of from 1 to 50 mPas·sec, and more preferably from 3 to 30 mpas.sec. If the wax has a melt viscosity lower than 1 mPas·sec, it tends to cause a damage due to a shear force acting between the toner and the carrier at the time of development, tending to make the external additive become buried in toner particles or make the toner crush. If the wax has a melt viscosity higher than 50 mPas·sec, dispersoids may have a too high viscosity when toners are produced by polymerization, so that it is not easy to obtain fine-particle toners having a uniform particle diameter, tending to provide toners having a broad particle size distribution.

The melt viscosity of the wax may be measured with a corn plate type roller (PK-1) by means of VT-500, manufactured by HAAKE Co.

The wax used in the present invention may also have, in molecular weight distribution measured by GPC, two or more peaks or at least one peak and at least one shoulder, and also have, in the molecular weight distribution, a weight-average molecular weight (Mw) of from 200 to 2,000 and a number-average molecular weight (Mn) of from 150 to 2,000. Such molecular weight distribution may be achieved by the use of either of a sole wax and a plurality of waxes. It has been found that its crystallizability can be lessened consequently and its transparency can be more improved. As methods for blending two or more types of wax, there are no particular limitations. For example, they may be melt-blended at the melting point or higher temperature of the waxes to be blended, by means of a media type dispersion machine such as a ball mill, a sand mill, an attriter, an apex mill, a Cobol mill or a handy mill). Also, the waxes to be blended may be dissolved in a polymerizable monomer to blend them by means of the media type dispersion machine. Here, a pigment, a charge control agent and a polymerization initiator may be used as additives.

The wax may more preferably have a weight-average molecular weight (Mw) of from 200 to 1,500, and still more preferably from 300 to 1,000, and may more preferably have a number-average molecular weight (Mn) of from 200 to 1,500, and still more preferably from 250 to 1,000. If the wax has Mw less than 200 and Mn less than 150, the toner may have low anti-blocking properties. If the wax has Mw more than 2,000 and Mn more than 2,000, the crystallizability of the wax itself may come out to lower its transparency.

The wax may preferably be mixed in an amount of from 1 to 40 parts by weight, and more preferably from 2 to 30 parts by weight, based on 100 parts by weight of the binder resin of the toner.

In the pulverization toner production process in which a mixture containing the binder resin, the colorant and the wax is melt-kneaded, followed by cooling, pulverization and then classification to obtain toner particles, the wax may preferably be added in an amount of from 1 to 10 parts by weight, and more preferably from 2 to 7 parts by weight, based on 100 parts by weight of the binder resin.

In the polymerization toner production process in which a mixture containing the polymerizable monomer, the colorant and the wax is polymerized to obtain toner particles directly, the wax may preferably be added in an amount of from 2 to 40 parts by weight, more preferably from 5 to 30 parts by weight, and still more preferably from 10 to 20 parts by weight, based on 100 parts by weight of the resin synthesized by polymerizing polymerizable monomers.

In the polymerization toner production process, compared with the pulverization toner production process, the wax used has a polarity lower than that of the binder resin, and hence the wax can readily be encapsulated in toner particles in a large quantity. Thus, compared with the pulverization toner production process, the wax can be used in a large quantity. This is especially effective for the prevention of offset at the time of fixing.

If the wax is mixed in an amount less than the lower limit, the effect of preventing offset may lower. If it is in an amount more than the upper limit, the anti-blocking effect may lower to tend to also adversely affect the effect of preventing offset, tending to cause melt-adhesion to drum and melt-adhesion to sleeve. Especially in the case of the polymerization toner production process, a toner having a broad particle size distribution tends to be formed.

Waxes usable in the present invention may include, e.g., paraffin waxes, polyolefin waxes, modified products of these (e.g., oxides or grafted products), higher fatty acids, ester waxes and metal salts thereof, amide waxes, and ester waxes In particular, ester waxes are preferred in view of an advantage that full-color OHP images having a higher grade can be obtained.

The ester wax used preferably in the present invention may be produced by a process utilizing, e.g., synthesis carried out by oxidation reaction, synthesis from carboxylic acids and derivatives thereof, or reaction for introducing ester groups as typified by Michael addition reaction.

In view of the variety of materials and the readiness of reaction, the ester wax used in the present invention may particularly preferably be produced by a process utilizing dehydration condensation reaction of a carboxylic acid compound with an alcohol compound as shown by the following scheme (1), or reaction of an acid halide with an alcohol compound as shown by the following scheme (2)

$$nR_1\text{—}COOH+R_2(OH)n \leftrightarrows R_2(OCO\text{—}R_1)n+nH_2O \quad (1)$$

$$nR_1\text{—}COCl+R_2(OH)n \leftrightarrows R_2(OCO\text{—}R_1)n+nHCl \quad (2)$$

In the formulas, $R_1$ and $R_2$ each represent an organic group such as an alkyl group, an alkenyl group, an aralkyl group or an aromatic group; and n represents an integer of 1 to 4. The organic group may preferably be those having 1 to 50, preferably 2 to 45, and more preferably 4 to 30, carbon atoms, and may further preferably be straight-chain.

In order to transfer the above ester equilibrium reaction to a production system, the reaction may preferably be carried out using a large excess of alcohol or using a Dean-Stark water separator in an aromatic organic solvent capable of being azeotropic with water. Using the acid halide, a base may be added as an acceptor of the acid formed as a by-product in the aromatic organic solvent, to form the polyester; such a method may also be used.

Processes for producing the toner used in the present invention will be described below. The toner used in the present invention may be produced by either of the pulverization toner production process and the polymerization toner production process.

In the pulverization toner production process, the binder resin, the wax, a pigment or dye as the colorant or a magnetic material, and optionally the charge control agent and other additives are thoroughly mixed using a mixing machine such as a Henschel mixer or a ball mill, and then the mixture obtained is melt-kneaded using a heat kneading machine such as a heating roll, a kneader or an extruder to make the resin and so on melt one another, in which the metal compound, the pigment, the dye and the magnetic material are dispersed or dissolved. The kneaded product thus obtained Is cooled to solidify, followed by pulverization and classification. Thus the toner can be obtained.

If necessary, any desired additives may further thoroughly be mixed with the toner by means of a mixing machine such as a Henschel mixer. Thus, the toner used in the present invention can be obtained.

In the polymerization toner production process, the toner may be produced by the method disclosed in Japanese Patent Publication No. 56-13945, in which a molten mixture is atomized or sprayed in the air by means of a disk or multiple fluid nozzles to obtain a spherical toner; the method disclosed in Japanese Patent Publication No. 36-10231 and Japanese Patent Applications Laid-open No. 59-53856 and No. 59-61842, in which toners are directly produced by suspension polymerization; a dispersion polymerization method in which toners are directly produced using an aqueous organic solvent in which monomers are soluble and polymers obtained are insoluble; an emulsion polymerization method as typified by soap-free polymerization in which toners are produced by direct polymerization in the presence of a water-soluble polar polymerization initiator; or heterogeneous agglomeration in which primary polar emulsion polymerization particles are previously produced and thereafter polar particles having opposite-polarity electric charges are added to effect association.

In particular, preferred is a method in which a monomer composition containing at least the polymerizable monomer, the colorant and the wax is directly polymerized to form toner particles.

In the dispersion polymerization, the toner obtained shows a very sharp particle size distribution. However, its production apparatus tends to be complicated and troublesome because of a narrow range for the selection of materials used and, since organic solvents are used, from the viewpoint of disposal of waste solvent produced or flammability of the organic solvents. Accordingly, the method in which the monomer composition containing at least the polymerizable monomer, the colorant and the wax is directly polymerized in an aqueous medium to form toner particles is preferred. The emulsion polymerization as typified by soap-free polymerization is effective since the toner can have a relatively uniform particle size distribution. It, however, sometimes tends to make environmental properties poor when emulsifying agents used or initiator terminals are present on toner particles.

Accordingly, in the present invention, particularly preferred is suspension polymerization carried out under normal pressure or under application of a pressure, which can relatively easily obtain fine-particle toners having a sharp particle size distribution. What is called seed polymerization, in which monomers are further adsorbed on polymer particles once obtained and thereafter a polymerization initiator is added to carry out polymerization, may also be preferably employed in the present invention.

As a preferred form of the toner used in the present invention, it is a toner in the toner particles of which the wax is encapsulated with shell resin layers when their cross sections are observed with a transmission electron microscope (TEM) Since it is necessary for the toner particles to be incorporated with the wax in a large quantity from the viewpoint of fixing performance, it is preferable to encapsulate the wax with shell resin layers A toner in which the wax is not encapsulated can not uniformly be dispersed, resulting in a broad particle size distribution and also tending to cause melt-adhesion of toner to assemblies. As a specific method by which the wax is encapsulated into toner particles, a wax whose material polarity in an aqueous dispersion medium is set smaller than the main monomer may be used and also a small amount of resin or monomer with a greater polarity may be added. Thus, toner particles having a core/shell structure wherein the wax is covered with the shell resin can be obtained. The particle size distribution and particle diameter of the toner may be controlled by a method in which the types and amounts of slightly water soluble inorganic salts or dispersants having the action of protective colloids are changed, or by controlling mechanical apparatus conditions, for example, stirring conditions such as rotor peripheral speed, pass times and stirring blade shapes, and the shape of vessels or the solid matter concentration in aqueous solutions, whereby the intended toner of the present invention can be obtained.

As a specific method for measuring the cross sections of toner particles in the present invention, toner particles are well dispersed in a room temperature curable epoxy resin, followed by curing in an environment of temperature 40° C. for 2 days, and the cured product obtained is dyed with triruthenium tetraoxide, and triosmium tetraoxide optionally used in combination Thereafter, samples are cut out in slices by means of a microtome having a diamond cutter to measure the form of cross sections of the toner particles using a transmission electron microscope (TEM). In the present invention, it is preferable to use the triruthenium tetraoxide dyeing method so that a contrast can be formed between the materials by utilizing the difference in crystallinity between the wax used and the binder resin constituting the shell.

When the direct polymerization is employed as the process for producing the toner of the present invention, the toner can be produced directly by a production process as described below. A monomer composition comprising polymerizable monomers and added therein the wax, the colorant, the charge control agent, a polymerization initiator and other additives are added in monomers, which are uniformly dissolved or dispersed by means of a homogenizer or an ultrasonic dispersion machine, is dispersed in an aqueous medium containing a dispersion stabilizer, by means of a conventional stirrer or a stirrer such as a homomixer or homogenizer. Granulation is carried out preferably while controlling the stirring speed and time so that droplets of the monomer composition can have the desired toner particle size. After the granulation, stirring may be carried out to such an extent that the state of particles is maintained and the particles can be prevented from settling by the action of the dispersion stabilizer. The polymerization may be carried out at a polymerization temperature set at 40° C. or above, usually from 50 to 90° C. At the latter half of the polymerization, the temperature may be raised, and also the aqueous medium may be removed in part at the latter half of the reaction or after the reaction has been completed, in order to remove unreacted polymerizable monomers, by-products and so forth that may cause an odor when the toner is fixed After the reaction has been completed, the toner particles formed are collected by washing and filtration, followed by drying. In the suspension polymerization, water may preferably be used as the dispersion medium usually in an amount of from 300 to 3,000 parts by weight based on 100 parts by weight of the monomer composition.

When the toner is directly obtained by polymerization, the polymerizable monomers include styrene; styrene monomers such as o-, m- or p-methylstyrene and m- or p-ethylstyrene; acrylate or methacrylate monomers such as methyl acrylate or methacrylate, ethyl acrylate or methacrylate, propyl acrylate or methacrylate, butyl acrylate, or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile, and acrylic acid amide As a resin having a great polarity, it may include polymers of nitrogen-containing monomers such as dimethylaminoethyl methacrylate and diethylaminoethyl methacrylate, nitrile monomers such as acrylonitrile, halogen-containing monomers such as vinyl chloride, unsaturated carboxylic acid monomers such as acrylic acid and methacrylic acid, unsaturated dibasic acid monomers, unsaturated dibasic acid anhydride monomers, and nitro monomers; or copolymers of such monomers with styrene or styrene monomers; polyesters; and epoxy resins. More preferred examples are a copolymer of styrene with acrylic or methacrylic acid, a styrene-maleic acid copolymer, unsaturated polyester resins and epoxy resins.

The polymerization initiator may include, e.g., azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; peroxide type initiators such as benzoyl peroxide, methyl ethyl ketone peroxide, diisopropylperoxy carbonate, cumene hydroperoxide, t-butyl hydroperoxide, di-t-butyl peroxide, dicumyl peroxide, 2,4-dichlorobenzoyl peroxide, lauroyl peroxide, 2,2-bis(4,4-t-butylperoxycyclohexyl)propane, and tris-(t-butylperoxy) triazine; polymeric initiators having a peroxide in the side chain; persulfates such as potassium persulfate and ammonium persulfate; and hydrogen peroxide. Any of these may be used alone or in combination of two or more.

The polymerization initiator may preferably be added in an amount of from 0.5 to 20 parts by weight based on 100 parts by weight of the polymerizable monomer.

In order to control molecular weight, any known cross-linking agent and chain transfer agent may be added, which may preferably be added in an amount of from 0.001 to 15 parts by weight based on 100 parts by weight of the polymerizable monomers.

In the dispersion medium used when the polymerization toner is produced, a suitable dispersion stabilizer comprising an inorganic compound or an organic compound may preferably be used in accordance with emulsion polymerization, dispersion polymerization, suspension polymerization, seed polymerization, or polymerization carried out by heterogeneous agglomeration. As the Inorganic compound, it may include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. As the organic compound, it may include polyvinyl alcohol, gelatin, methyl cellulose, methyl hydroxypropyl cellulose, ethyl cellulose carboxymethyl cellulose sodium salt, polyacrylic acid and salts thereof, starch, polyacrylamide, polyethylene oxide, a poly hydroxystearic acid-g-methyl methacrylate-eu-methacrylic acid) copolymer, and nonionic or ionic surface active agents.

When the emulsion polymerization and the polymerization carried out by heterogeneous agglomeration are used, anionic surface active agents, cationic surface active agents, amphoteric surface active agents and nonionic surface active agent are used. Any of these dispersion stabilizers may preferably be used in an amount of 0.2 to 30 parts by weight based on 100 parts by weight of the polymerizable monomer.

Of these dispersion stabilizers, when the inorganic compound is used, those commercially available may be used as they are- In order to obtain fine particles, however, the inorganic compound may also be formed in the dispersion medium.

In order to finely disperse these dispersion stabilizers, a surface active agent may be used in an amount of from 0.001 to 0.1 part by weight based on 100 parts by weight of the polymerizable monomer. This surface-active agent accelerates the stabilization action of the dispersion stabilizer. As specific examples thereof, it may include sodium dodecylbenzenesulfonate, sodium tetradecyl sulfate, sodium pentadecyl sulfate, sodium octyl sulfate, sodium oleate, sodium laurate, potassium stearate and calcium oleate As colorants used in the polymerization toner in the present invention, attention must be paid to polymerization inhibitory action or aqueous-phase transfer properties inherent in the colorants. The colorant should more preferably be subjected to surface modification, e.g., hydrophobic treatment which makes the colorants free from polymerization inhibition. In particular, most dye type colorants and carbon black have the polymerization inhibitory action and hence care must be taken when used. A preferable method for the surface treatment of the dyes may include a method in which polymerizable monomers are previously polymerized in the presence of any of these dyes. The resulting colored polymer may be added to the monomer composition. With regard to the carbon black, besides the same treatment as that on the dyes, it may be treated with a material capable of reacting with surface functional groups of the carbon black, as exemplified by polyorganosiloxane.

The wax contained in the toner may preferably have a melting point which is higher than the glass transition temperature of the binder resin. Temperature difference between them may preferably be 100° C. or smaller, more preferably 75° C. or smaller, and still more preferably 50° C. or smaller. If this temperature difference is larger than 100° C., the toner may have a low low-temperature fixing performance. Also, this temperature difference between them may preferably be 2° C. or larger because, if the both are too close, the toner has a narrow temperature range in which its storage stability and high-temperature anti-offset properties can both be achieved.

The binder resin may preferably have a glass transition temperature of from 40° C. to 90° C., and more preferably from 50° C. to 85° C. If the binder resin has a glass transition temperature below 40° C., the toner may have low fluidity and storage stability to make it difficult to obtain good images. If on the other hand the binder resin has a glass transition temperature above 90° C., the toner may have a poor fixing performance at low temperature and, in addition, may have a low transmission for full-color transparent OHP sheets. In particular, dull images tend to be formed at halftone areas to provide projected images lacking in chroma The glass transition temperature of the binder resin is measured according to ASTM D3418-8. For example, it is measured with DSC-7, manufactured by Perkin Elmer Co. The temperature at the detecting portion of the device is corrected on the basis of melting points of indium and zinc, and the calorie is corrected on the basis of heat of fusion of indium. The sample is put in a pan made of aluminum and an empty pan is set as a control, to make measurement at a rate of temperature rise of 10° C./min in the range of from 20 to 200° C.

The external additive added externally to the toner particles will be described below.

As the external additive used in the present invention, preferably usable are inorganic fine powders such as silica, alumina and titanium oxide powders, and fine powders of polytetrafluoroethylene, polyvinylidene fluoride, polymethyl methacrylate, polystyrene, silicone, carbon black and carbon fluoride. In particular, hydrophobic fine silica powder, hydrophobic fine titanium oxide powder or hydrophobic fine alumina powder is preferred.

The external addition of the above fine powder to the toner particles brings the fine powder into presence between the toner and carrier or between toner particles mutually to bring about an improvement of fluidity of the developer and also an improvement of service life of the developer. The above fine powder may have an average particle diameter not larger than 0.2 $\mu$m, and more preferably from 3 to 100 nm. If it has an average particle diameter larger than 0.2 $\mu$m, it may have less effect of improving the fluidity, resulting in a low image quality because of a poor performance at the time of development and at the time of transfer in some cases. Measurement of the average particle diameter of these fine powders will be described later.

Any of these fine powders may preferably have a surface area of 30 $m^2/g$ or larger, and particularly in the range of from 50 to 400 $m^2/g$, as specific surface area measured by the BET method using nitrogen absorption. The fine powder used may preferably be added in an amount of from 0.1 to 20 parts by weight based on 100 parts by weight of the toner particles.

Since the toner is a negatively chargeable toner, a hydrophobic-treated silica should be used as at least one kind. This is preferred in view of charging performance. Namely, since the silica has a higher negative chargeability than fluidizing agents such as alumina or titanium oxide, it has a high adhesion to toner particles to lessen any free external additive. Hence, the electrostatic image bearing member can be kept form the filming, and charging members from contamination. However, with an increase in negative chargeability, a partly free external additive tends to move to the carrier. Even in such an instance, the coupling-agent-coated carrier according to the present invention can keep the external additive from adhering to the carrier because of its low surface energy attributable to siloxane moieties of the coupling agent which are readily aligned on particle surfaces. As for the resin-coated carrier, too, the same effect can be expected when a resin having moieties with a low surface energy.

In order to maintain charging performance in an environment of high humidity, the inorganic fine powder may preferably be hydrophobic-treated. An example of such hydrophobic treatment is shown below.

A silane coupling agent is available as one of hydrophobic-treating agents. It may be used in an amount of from 1 to 40 parts by weight, and preferably from 2 to 35 parts by weight, based on 100 parts by weight of the inorganic fine powder, So long as the treating agent is in an amount of from 1 to 40 parts by weight, the toner can be improved in moisture resistance to make agglomerates hardly occur The silane coupling agent used in the present invention may include those represented by the following general formula:

$$R_mSiY_n$$

wherein R represents an alkoxyl group or a chlorine atom; m is an integer of 1 to 3; Y represents a hydrocarbon group (including, e.g., an alkyl group, a vinyl group, a glycidoxyl group or a methacrylic group; and n=4−m.

It may include, e.g., dimethyldichlorosilane, trimethylchlorosilane, allyldimethylchlorosilane, hexamethyldisilazane, allylphenyldichlorosilane, benzyldimethylchlorosilane, vinyltriethoxysilane, γ-methacryloxypropyltrimethoxysilane, vinyltriacetoxysilane, divinylchlorosilane and dimethylvinylchlorosilane.

The treatment of the inorganic fine powder with the silane coupling agent may be carried out by a commonly known method such as dry treatment in which an inorganic fine powder made into cloud by agitation is allowed to react with a vaporized silane coupling agent, or wet treatment in which a fine silicate powder is dispersed in a solvent and the silane coupling agent is added dropwise thereto to carry out reaction. Such hydrophobic treatment may be used in appropriate combination.

As another hydrophobic-treating agent, silicone oil is available. Commonly preferred are those represented by the following formula:

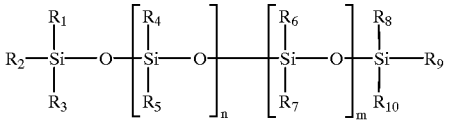

wherein $R_1$ to $R_{10}$ may be the same or different and each represents a hydrogen atom, a hydroxyl group, an alkyl group, a halogen atom, a phenyl group, a phenyl group having a substituent, a fatty acid group, a polyoxyalkylene group or a perfluoroalkyl group; and m and n each represent an integer.

As preferred silicone oils, those having a viscosity at 25° C. of from 5 to 2,000 $mm^2/s$ are used Silicone oils having a low viscosity because of a too low molecular weight is not so much preferable because a volatile component may occur upon heat treatment. On the other hand, silicone oils having a high viscosity because of a too high molecular weight makes it difficult to make the surface treatment. As the silicone oil, preferred are methylsilicone oil, dimethylsilicone oil, phenylmethylsilicone oil, chlorophenylmethylsilicone oil, alkyl-modified silicone oils, fatty-acid-modified silicone oils and polyoxyalkyl-modified silicone oils.

As the above silicone oils, those having the same polarity as the toner particles may preferably be used so that the toner can be improved in charging performance.

The inorganic fine powder may be treated with the silicone oil by known techniques. For example, the inorganic fine powder and the silicone oil may be mixed directly by means of a mixing machine such as a Henschel mixer, or a method of spraying the silicone oil on the inorganic fine powder may be used. Alternatively, the silicone oil may be dissolved or dispersed in a suitable solvent and thereafter mixed with the inorganic fine powder, followed by removal of the solvent.

The silicone oil may be used in an amount of from 1.5 to 60 parts by weight, and preferably from 3.5 to 40 parts by weight, based on 100 parts by weight of the inorganic fine powder to be treated. When treated with silicone oil in such an amount of from 1.5 to 60 parts by weight, the inorganic fine powder can be surface-treated uniformly with the silicone oil. Hence, the filming and blank areas caused by poor transfer can be prevented, the charging performance of the toner can be prevented from lowering as a result of moisture absorption in an environment of high humidity, and image density can be kept from decreasing during running.

Additives used for the purpose of imparting various toner properties may preferably have a particle diameter of not larger than ⅕ of the volume average diameter of toner particles in view of their durability when added internally to the toner particles or added externally to the toner particles. This particle diameter of the additives is meant to be an average particle diameter of 300 external additive particles present on the surfaces of toner particles magnified 30,000 times with an electron microscope. As these additives, used for the purpose of providing various properties, the following may be used, for example.

As abrasives, they may include, e.g., metal oxides such as cerium oxide, aluminum oxide, magnesium oxide and chromium oxide, nitrides such as silicon nitride, carbides such as silicon carbide; and metal salts such as strontium titanate, calcium sulfate, barium sulfate and calcium carbonate.

As lubricants, they may include, e.g., powders of fluorine resins such as vinylidene fluoride and polytetrafluoroethylene, and fatty acid metal salts such as zinc stearate and calcium stearate.

As charge controlling particles, they may include, e.g., metal oxides such as tin oxide, titanium oxide, zinc oxide, silicon oxide and aluminum oxide, and carbon black.

Any of these additives may preferably be used in an amount of from 0.1 part to 10 parts by weight, more preferably from 0.1 part to 5 parts by weight, and still more preferably from 0.5 part to 5 parts by weight, based on 100 parts by weight of the toner particles. These additives may be used alone or in combination of two or more.

The toner used in the present invention may preferably have triboelectric charges of from −15 to −40 mC/kg, and more preferably from −20 to −35 mC/kg, upon its blending with the magnetic resin carrier The toner used In the present invention may have a shape factor SF-1 of from 100 to 140, and preferably from 100 to 130, and may make use of at least a hydrophobic fine silica powder as the external additive. This is preferable in order to more improve developing performance.

The carrier used in the developer of the present invention will be described below. The carrier is a magnetic-fine-particle-dispersed resin carrier comprising composite particles containing at least inorganic compound particles and a binder resin.

The magnetic-fine-particle-dispersed resin carrier (hereinafter "magnetic resin carrier") used in the present invention is formed of composite particles whose particle surfaces have been treated with a specific coupling agent and which comprise inorganic compound particles dispersed therein.

The inorganic compound particles (the term "inorganic compound particles" herein embraces magnetic fine particles and non-magnetic inorganic compound particles) that constitute the composite particles in the present invention may be those not capable of dissolving in water and not changeable in properties or modifiable by water. As magnetic fine particles, usable are various magnetic particles such as magnetite particles, maghematite particles, these particles deposited or incorporated with cobalt, magnetoblumbite type ferrite particles containing barium, strontium or barium-strontium, and spinel type ferrite particles containing at least one selected from manganese, nickel, zinc, lithium and magnesium. As non-magnetic inorganic compound particles, usable are hematite particles, hydrous ferric oxide particles, titanium oxide particles, silica particles, talc particles, alumina particles, barium sulfate particles, barium carbonate particles, cadmium yellow particles, calcium carbonate particles and zinc white particles.

The inorganic compound particles may have particle form such as cubic, polyhedral, spherical, acicular or platelike, any forms of which may be employed. They may have an average particle diameter smaller than the average particle diameter of the composite particles, and may preferably have a number-average particle diameter of from 0.02 to 5.0 $\mu$m, in particular, from 0.02 to 2 $\mu$m in the case of the magnetic fine particles, and from 0.05 to 5 $\mu$m in the case of the non-magnetic inorganic compound particles.

The inorganic compound particles have been treated with a lipophilic-treating agent in their entirety or in part.

As the lipophilic-treating agent, usable are organic compounds having one or two types of functional groups selected from an epoxy group, an amino group, a mercapto group, an organic acid group, an ester group, a ketone group, an alkyl halide group and an aldehyde group, or mixtures of such compounds Any of these can achieve the object of the present invention. Of these, coupling agents having functional groups are preferred, and silane type coupling agents, titanium type coupling agents or aluminum type coupling agents are more preferred. Silane type coupling agents are particularly preferred. Also, as preferred functional groups, an epoxy group, an amino group and a mercapto group are preferred in view of an advantage that the carrier can have a sharp particle size distribution. The epoxy group is more preferred in view of an advantage that the carrier is less affected by temperature and humidity and can have a stable charge-providing performance.

The organic compounds having an epoxy group include epichlorohydrin, glycidol and a styrene-glycidyl acrylate or methacrylate copolymer The silane type coupling agents having an epoxy group include γ-glycidoxypropylmethyldimethoxysilane, γ-glycidoxypropyltrimethoxysilane and β-(3,4-epoxycyclohexyl)trimethoxysilane.

The organic compounds having an amino group include ethylenediamine, diethylenetriamine, and a styrene-dimethylaminoethyl acrylate or methacrylate copolymer.

The silane type coupling agents having an amino group include γ-aminopropyltrimethoxysilane, N-β-(aminoethyl)-γ-aminopropyltrimethoxysilane, N-β-(aminoethyl)-γ-aminopropylmethyldimethoxysilane, and N-phenyl-γ-aminopropyltrimethoxysilane.

The titanium type coupling agents having an amino group include isopropyltri(N-aminoethyl) titanate The organic compounds having a mercapto group include mercaptoethanol and mercaptopropionic acid.

The silane type coupling agents having a mercapto group include γ-mercaptopropyltrimethoxysilane.

The organic compounds having an organic acid group include oleic acid, stearic acid, and styrene-acrylic acid.

The organic compounds having an ester group include ethyl stearate, and styrene-methylmethacrylate.

The organic compounds having a ketone group include cyclohexanone, acetophenone, and methyl ethyl ketone resin.

The organic compounds having an alkyl halide group include chlorohexadecane and chlorodecane.

The organic compounds having an aldehyde group include propionaldehyde and benzaldehyde In the present invention, the lipophilic-treating agent may preferably be used in an amount of from 0.1 to 5.0% by weight based on the weight of the inorganic compound particles If it is in an amount less than 0.1% by weight, it may be difficult to bring the resin coat into close adhesion to the surfaces of the composite particles Also, because of insufficient hydrophobic treatment, any composite particles containing the inorganic compound particles in a large quantity can not be obtained. If on the other hand it is In an amount more than 5.0% by weight, though it is possible to bring the resin coat into close adhesion to the surfaces of the composite particles, the composite particles formed may cause mutual agglomeration to make it difficult to control the particle size of the composite particles.

The binder resin that constitutes the composite particles in the present invention may preferably be a thermosetting resin.

The thermosetting resin includes phenolic resins, epoxy resins, polyamide resins, melamine resins, urea resins, unsaturated polyester resins, alkyd resins, xylene resins, acetoguanamine resins, furan resins, silicone resins, polyimide resins, and urethane resins. Any of these resins may be used alone or in the form of a mixture of two or more, where at least a phenolic resin may preferably be contained.

The binder resin and the inorganic compound particles that constitute the composite particles In the present invention may preferably be in a proportion of 1 to 20% by weight of the binder resin and 80 to 99% by weight of the inorganic compound particles.

In an embodiment of the magnetic resin carrier according to the present invention, the particle surfaces of the composite particles have been coated with at least one type of coupling agent having at least one type of functional group selected from an epoxy group, an amino group and a mercapto group. In another embodiment of the magnetic resin carrier according to the present invention, the particle surfaces of the composite particles have been coated with a resin having at least one type of functional group selected from an epoxy group, an amino group, an organic acid group, a hydroxyl group, a chloro group, an ester group, a ketone group and an alkyl halide group.

The functional group possessed by the coupling agent or resin with which the surfaces of the composite particles are coated must be different from the functional group contained in the lipophilic-treating agent with which the inorganic compound particles in the composite particles has been treated. Each functional group may preferably be a reactive one.

In the embodiment where the surfaces of the composite particles are treated with the coupling agent, the functional group possessed by the coupling agent may preferably be an amino group.

In the embodiment where the particle surfaces of the composite particles have been coated with the resin, the functional group possessed by the resin may preferably be an epoxy group, an amino group, an organic acid group, an ester group, a ketone group or an alkyl halide group. It may more preferably be an epoxy group, an amino group or an organic acid group, and particularly preferably be an amino group.

The both embodiments will be described below.

In the embodiment where the surfaces of the composite particles are treated with the coupling agent;

when the functional group contained in the coating coupling agent is an epoxy group, at least one type of an amino group, a hydroxyl group and an organic acid group may be selected as the functional group contained in the lipophilic-treating agent with which the inorganic compound particles have been treated;

when the functional group contained in the coating coupling agent is an amino group, at least one type of an organic acid group, an ester group, an aldehyde group, an epoxy group, a ketone group and an alkyl halide group may be selected as the functional group contained in the lipophilic-treating agent with which the inorganic compound particles have been treated; and when the functional group contained in the coating coupling agent is a mercapto group, at least one type of an aldehyde group, a ketone group and an organic acid group may be selected as the functional group contained in the lipophilic-treating agent with which the inorganic compound particles have been treated.

In particular, preferred is an instance where the functional group contained in the coating coupling agent and the functional group contained in the lipophilic-treating agent with which the inorganic compound particles have been treated are the combination of an amino group, an epoxy group, an amino group and an organic acid group.

In the embodiment where the surfaces of the composite particles are treated with the resin;

when the functional group contained in the coating resin is an epoxy group, at least one type of functional group selected from an amino group, a mercapto group and an organic acid group may be selected as the functional group contained in the lipophilic-treating agent with which the inorganic compound particles have been treated;

when the functional group contained in the coating resin is an amino group, at least one type of functional group selected from an epoxy group, a mercapto group, an organic acid group, an ester group, a ketone group, an alkyl halide group and an aldehyde group may be selected as the functional group contained in the lipophilic-treating agent with which the inorganic compound particles have been treated;

when the functional group contained in the coating resin is an organic acid group, at least one type of functional group selected from an epoxy group, an amino group, a mercapto group, an ester group, a ketone group, an alkyl halide group and an aldehyde group may be selected as the functional group contained in the lipophilic-treating agent with which the inorganic compound particles have been treated;

when the functional group contained in the coating resin is an ester group, at least one type of functional group selected from an epoxy group, an amino group, a mercapto group, an organic acid group, a ketone group, an alkyl halide group and an aldehyde group may be selected as the functional group contained in the lipophilic-treating agent with which the inorganic compound particles have been treated;

when the functional group contained in the coating resin is a ketone group, at least one type of functional group selected from an epoxy group, an amino group, a mercapto group, an organic acid group, an ester group, an alkyl halide group and an aldehyde group may be selected as the functional group contained in the lipophilic-treating agent with which the inorganic compound particles have been treated;

when the functional group contained in the coating resin is an alkyl halide group, at least one type of functional group selected from an epoxy group, an amino group, a mercapto group, an organic acid group, an ester group, a ketone group and an aldehyde group may be selected as the functional group contained in the lipophilic-treating agent with which the inorganic compound particles have been treated;

when the functional group contained in the coating resin is a hydroxyl group, at least one type of functional group selected from an epoxy group and an organic acid group may be selected as the functional group contained in the lipophilic-treating agent with which the inorganic compound particles have been treated; and when the functional group contained in the coating resin is a chloro group, a hydroxyl group may be selected as the functional group contained in the lipophilic-treating agent with which the inorganic compound particles have been treated.

Taking the case of the coupling agent, the reaction of these functional groups proceeds as shown below.

(1) Reaction of amino group with organic acid group:

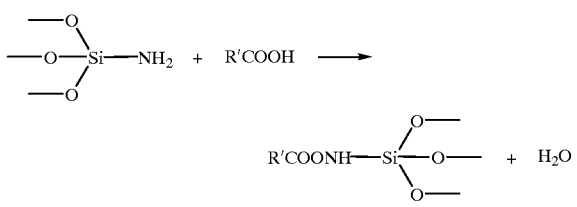

(2) Reaction of amino group with ester group:

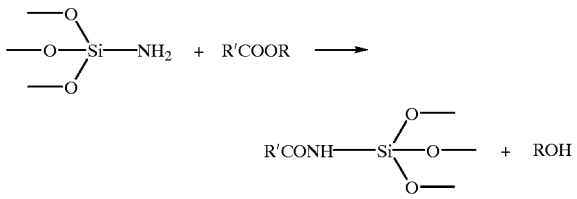

(3) Reaction of amino group with aldehyde group:

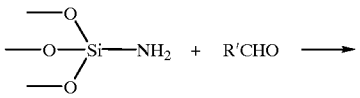

-continued

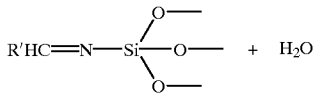

(4) Reaction of amino group with ketone group:

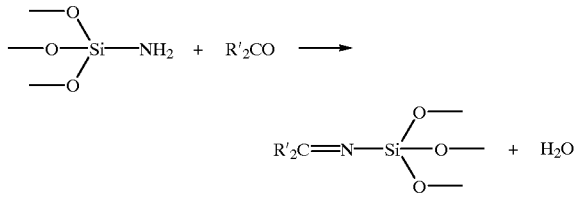

(5) Reaction of amino group with alkyl halide group:

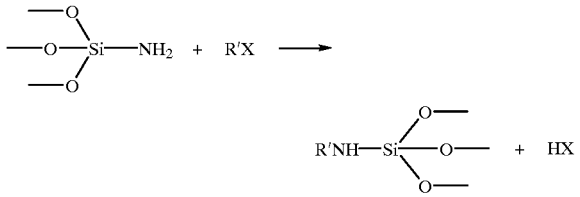

(6) Reaction of amino group with epoxy group:

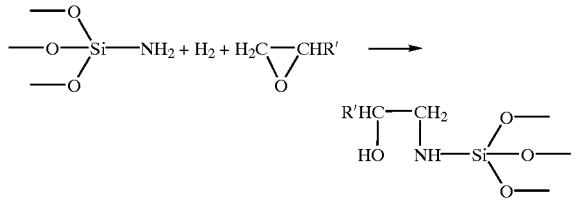

(7) Reaction of amino group with mercapto group:

$$R_2CO+2R'SH \rightarrow R_2C(SR')_2+H_2O$$

In the formulas, R and R' each represent an organic group or a silicone residual group, and "—" represents that Si and N are bonded directly or via a linking group.

The type of the coating coupling agent having the functional group, used to coat the composite particle surfaces may be any of the above coupling agents used to lipophilic-treat the inorganic compound particles. In particular, silane type coupling agents are preferred in view of an advantage that they do not damage the fluidity of carriers.

As a method of treating the composite particle surfaces with the coupling agent having the functional group, the composite particle surfaces may be treated after the coupling agent has ben mixed with a resin. As the resin in such an instance, silicone resins are preferred, which may more preferably include condensation reaction type silicone resins whose substituent(s) is/are a methyl group(s). Those commercially available may include SR2410 and SR2411 (available from Toray Dow Corning, Inc.) and KR255 and KR251 (available from Shin-Etsu Silicone Co., Ltd.)

The composite particles may preferably be coated with the coupling agent in an amount of from 0.001 to 5.0% by weight based on the weight of the composite particles. In an amount less than 0.001 t by weight, it is difficult to bring the coatings of the coupling agent into close adhesion to the composite particle surfaces, and a problem may occur on the permanence of charge quantity. In an amount more than 5.0% by weight, it is possible to bring the coatings of the coupling agent into close adhesion to the composite particle surfaces, but there may occur a problem that the presence of an excess coupling agent causes a change in charge quantity as a result of long-time service.

After the composite particles have been coated with the coupling agent, the particles may further be coated with a resin. In such an instance, the coupling agent may preferably be used in an amount of from 0.005 to 4.0% by weight based on the weight of the composite particles, in order to improve the adhesion strength of the resin.

As the types of the resin having the functional group, used to coat the composite particles, it may include resin compositions having an epoxy group, such as epoxy resins, epoxy-modified silicone resins, and copolymers of styrene with monomers having an epoxy group such as glycidyl acrylate or methacrylate; resin compositions having an amino group, such as polyamide resins, urea-formalin resins, aniline resins, melamine-formalin resins, guanamine resins, and copolymers of styrene with monomers having an amino group such as dimethylaminoethyl acrylate or methacrylate or diethylaminoethyl acrylate or methacrylate; resin compositions having an organic acid group such as copolymers of polyacrylic acid or styrene with acrylic acid; resin compositions having an ester group such as polyester resins, acrylic or methacrylic resins, acryl-modified resins, alkyd-modified silicone resins, and copolymers of styrene with acrylic or methacrylic acid; resin compositions having a ketone group such as methyl ethyl ketone resin; and resin compositions having an alkyl halide group such as polyvinyl chloride and polyvinylidene chloride.

The composite particles may preferably be coated with the resin having the functional group, in an amount of 0.05% by weight or more, based on the weight of the composite particles In an amount less than 0.05% by weight, insufficient and non-uniform coatings may be formed to make it difficult to control charge quantity as desired. If coated in a too large quantity, the composite particles tend to have so excessively a high electric resistance as to cause a problem on images. The former may preferably be coated with the latter in an amount of from 0.1 to 10% by weight, and more preferably from 0.2 to 5% by weight in order to prevent the particles from coalescing one another.

In the resin having the functional group, with which the composite particle surfaces are coated, a coupling agent may optionally be contained in an amount of from 0.1 to 20.0% by weight based on the weight of the resin solid content. As the coupling agent, a silane type coupling agent is preferred. Such a coupling agent may be in an amount of from 0.1 to 10.0% by weight in order to prevent coat strength from lowering due to self-condensation of the coupling agent.

The magnetic resin carrier according to the present invention may optionally further be coated with a resin after the composite particles have been coated with the coupling agent or resin having the functional group.

The resin for such additional coating may be any of known resins, including, e.g., epoxy resins, silicone resins, polyester resins, fluorine resins, styrene resins, acrylic resins and phenolic resins. Polymers obtained by polymerizing monomers may also be used. Taking account of running performance and contamination resistance, silicone resins are preferred.

Such silicone resins may include condensation reaction type silicone resins may include condensation reaction type silicone resins whose substituent(s) is/are a methyl group(s).

Those commercially available may include SR2410 and SR2411 (available from Toray Dow Corning, Inc.) and KR255 and KR251 (available from Shin-Etsu Silicone Co., Ltd.). Modified silicone resins may also be used. For example, epoxy-modified silicone resins may include SR2115 and SR2145 (available from Toray Dow Corning, Inc.) and ES1001N and ES1002T (available from Shin-Etsu Silicone Co., Ltd.).

Coating with such a resin may be in an amount of 0.05% by weight or more, based on the weight of the composite particles. In an amount less than 0.05% by weight, insufficient and non-uniform coatings may be formed to make it difficult to control charge quantity as desired. If coated in a too large quantity, the composite particles tend to have so excessively a high electric resistance as to cause a problem on images. Coating with the resin may preferably be in an amount of from 0.1 to 10% by weight, and more preferably from 0.2 to 5% by weight in order to prevent the particles from coalescing one another.

In the resin coatings, a coupling agent may optionally be contained in an amount of from 0.1 to 20.0% by weight based on the weight of the resin solid content. As the coupling agent, a silane type coupling agent is preferred. Such a coupling agent may be in an amount of from 0.1 to 10.0% by weight in order to prevent coat strength from lowering due to self-condensation of the coupling agent.

In the embodiment where the composite particle surfaces are coated with the coupling agent, it is a preferred form that a phenolic resin is used as the binder resin of the composite particles, an epoxy-group-containing silane coupling agent is used as the surface-treating agent for the inorganic compound particles, and a silane coupling agent containing an amino group is used as the surface-treating agent for the composite particles or the composite particles are surface-coated with a silicone resin containing a silane coupling agent. In such an instance, the water content incorporated appropriately into the resin causes the amino-group-containing coupling agent to hydrolyze to undergo self-condensation while combining through hydrogen with the hydroxyl group of the phenolic resin, or undergo condensation with the residual silanol group in the silicone resin, to form strong coatings. At the same time, the amino group reacts with the epoxy group of the surface-treating agent for the inorganic compound particles. Thus, the silicone resin is improved in adhesion and the coat resin is kept from coming off.

In the embodiment where the composite particle surfaces are coated with the resin having the functional group, it is a preferred form that a phenolic resin is used as the binder resin of the composite particles, an epoxy-group-containing silane coupling agent is used as the surface-treating agent for the inorganic compound particles, and an organic resin containing an amino group is used as the coating resin. In such an instance, the water content incorporated appropriately into the resin causes the amino group to combine with the epoxy and also combine through hydrogen with the hydroxyl group of the phenolic resin, to form strong coatings.

The magnetic resin carrier according to the present invention may preferably have a particle size of from 10 to 200 $\mu$m as weight-average particle diameter. If it has a weight-average particle diameter smaller than 10 $\mu$m, the magnetic resin carrier itself may fly to the photosensitive member to cause faults on images, what is called carrier adhesion. If it has a weight-average particle diameter larger than 200 $\mu$m, it may be difficult to obtain sharp images.

Especially in order to achieve high image quality and high grade, the carrier may preferably have a weight-average particle diameter ranging from 10 to 50 $\mu$m. It may more preferably have a weight-average particle diameter of from 15 to 45 $\mu$m. This is more preferable in view of an advantage that any replenishing toner can be blended and transported well also when original images having a large area percentage and involving a large toner consumption, such as photographic originals, are printed continuously.

The magnetic resin carrier used in the present invention may have a true specific gravity of from 2.5 to 4.5, and preferably from 3.0 to 4.3. The one having true specific gravity within this range may apply less load on the toner when the magnetic resin carrier and the toner are agitated and blended, so that the carrier particle surfaces can be kept from being contaminated with the toner and the carrier can be kept from adhering to non-image areas of the electrostatic image bearing member. Thus, such a carrier is preferred.

The magnetic resin carrier used in the present invention may have a magnetization intensity $\sigma_{1,000}$ of from 15 to 60 $Am^2/kg$ (emu/g) (preferably from 20 to 55 $Am^2/kg$) and a residual magnetization or of from 0.1 to 20 $Am^2/kg$ ( emu/g) (preferably from 0.3 to 10 $Am^2/kg$) as measured under application of a magnetic field of 79.6 kA/m (1 kOe). When the magnetic resin carrier has magnetic properties within these ranges, the magnetic resin carrier can be prevented from the carrier adhesion to the electrostatic image bearing member under application of a magnetic field by a magnetic-field-generating means (e.g., a stationary magnet) set inside a developer carrying member (developing sleeve), and its compression force acting on the toner in the magnetic brush of a two-component type developer can be relieved to keep the carrier from being contaminated by the toner particles. Thus, such a carrier is preferred If the magnetic resin carrier has a residual magnetization ($\sigma r$) above 20 $Am^2/kg$, the two-component type developer on the developer carrying member and the two-component type developer in the developing assembly can not smoothly be exchanged to tend to cause charge-up of the toner and non-uniform charge quantity of the toner.

The magnetic resin carrier used in the present invention may have a resistivity of from $5\times10^{11}$ to $5\times10^{15}$ $\Omega\cdot$cm. When the magnetic resin carrier has specific resistivity within this range, the magnetic resin carrier may hardly adhere to the electrostatic image bearing member and the charge-up of the toner can also be kept well from occurring.

In order to bring the resistivity and magnetic properties of the magnetic resin carrier into the stated range, a non-magnetic inorganic compound particles may preferably be mixed in carrier cores in addition to the magnetic fine particles. The magnetic fine particles and the non-magnetic inorganic compound particles may preferably be contained in an amount of from 70 to 99% by weight (carrier-based), and more preferably from 80 to 99% by weight, in total. This is preferred in view of the relationship between the control of true specific gravity of the carrier, the control of resistivity of the carrier and the mechanical strength of carrier cores.

In addition, the non-magnetic inorganic compound particles may have a resistivity higher than the resistivity of the magnetic fine particles, and the non-magnetic inorganic compound particles may have a number-average particle diameter larger than the number-average particle diameter of the magnetic fine particles. This is preferable in order to make the carrier have a higher resistivity and make the carrier have a small true specific gravity. With regard to the number-average particle diameter, it is particularly preferred that the non-magnetic inorganic compound particles has a number-average particle diameter larger by 1.5 times the number-average particle diameter of the magnetic fine particles.

The magnetic fine particles may be contained in an amount of from 30 to 95% by weight based on the total weight of the magnetic fine particles and non-magnetic inorganic compound particles. This is preferable in order to control the magnetic force of the carrier to prevent the carrier adhesion and also in order to control the resistivity of the carrier.

The shape of the magnetic resin carrier is appropriately so selected as to be favorable for any preset systems. However, the magnetic resin carrier may preferably have a sphericity (shape factor) SF-1 of from 100 to 130, and more preferably from 100 to 120. If the magnetic resin carrier has a sphericity SF-1 of more than 130, it may provide a poor fluidity for the developer, and may have a low ability to impart triboelectric charge to the toner or make the shape of the magnetic brush non-uniform, making it difficult to obtain images having a high image quality.

The sphericity of the carrier is measured by sampling at random 300 particles or more of carrier by the use of a field-emission scanning electron microscope S-800, manufactured by Hitachi Ltd., and determining a sphericity calculated from the following expression, using an image processing analyzer LUZEX3, manufactured by Nireko Co.

$$\text{Sphericity } SF\text{-}1=(MXLNG)^2/\text{AREA}\times\pi/4\times100$$

wherein MXLNG represents a maximum length of a carrier particle, and AREA represents a projected area of a carrier particle.

Here is meant that, the closer to 100 the SF-1 is, the closer to a sphere the particle is.

A process for producing the magnetic resin carrier according to the present invention will be described below.

To treat the inorganic compound particles with the lipophilic-treating agent, the particles may be coat-treated by adding and mixing a solution of the coupling agent or organic compound in the inorganic compound particles to coat the particles with it.

The composite particles may be produced by what is called a polymerization process in which inorganic compound particles dispersed in a solvent are dispersed in the monomer constituting the binder resin, followed by addition of an initiator or catalyst to carry out polymerization; or what is called a kneading-pulverization process in which a binder resin containing the inorganic compound particles is kneaded and the kneaded product obtained Is dried and then pulverized. In order to control the particle diameter of the magnetic resin carrier with ease to provide a sharp particle size distribution, the polymerization process is preferred.

To produce the composite particles using phenolic resin as the binder resin, a process may be used in which, e.g., a phenol, an aldehyde and the inorganic compound particles having been lipophilic-treated are dispersed in an aqueous medium, followed by addition of a basic catalyst to carry out reaction. Another process may also be used in which natural resin such as rosin and drying oil such as tung oil or linseed oil are mixed together with a phenol to allow them to react to form a modified phenolic resin.

In the case when the binder resin is especially the phenolic resin, it retains adsorbed water appropriately. In the case when the composite particle surfaces have been treated with the coupling agent, the resin accelerates the hydrolysis of the coupling agent. Thus, such cases are preferable in order to form strong coatings.

The phenol used to form the phenolic resin may include phenol itself and besides alkyl phenols such as m-cresol, p-tert-butylphenol, o-propylphenol, resorcinol and bisphenol A; and compounds having a phenolic hydroxyl group, such as halogenated phenols part or the whole of the benzene ring or alkyl group of which has been substituted with a chlorine atom(s) or a bromine atom(s). In particular, phenol (hydroxybenzene) is more preferred.

The aldehyde may include formaldehyde in the form of either formalin or para-aldehyde, and furfural. In particular, formaldehyde is preferred.

The molar ratio of the aldehyde to the phenol may preferably be from 1 to 4, and particularly preferably from 1.2 to 3. If the molar ratio of the aldehyde to the phenol is smaller than 1, the particles may be formed with difficulty or, even when formed, the curing of resin may proceed with difficulty to tend to result in a low strength of the particles formed. If on the other hand the molar ratio of the aldehyde to the phenol is larger than 4, unreacted aldehydes remaining in the aqueous medium after the reaction tend to be in a large quantity.

The basic catalyst used when the phenol and the aldehyde are subjected to condensation polymerization may include those conventionally used in the production of resol resin. It may include, e.g., ammonia water, hexamethylenetetramine, and alkylamines such as dimethylamine, diethyltriamine and polyethyleneimine. The molar ratio of any of these basic catalysts to the phenol may preferably be from 0.02 to 0.3.

To produce the composite particles using epoxy resin as the binder resin, a process may be used in which; e.g., a bisphenol, an epihalohydrin and the inorganic compound particles having been lipophilic-treated are dispersed in an aqueous medium to carry out reaction in an alkaline medium.

To produce the composite particles using melamine resin as the binder resin, a process may be used in which, e.g., a melamine, an aldehyde and the inorganic compound particles having been lipophilic-treated are dispersed in an aqueous medium to carry out reaction in the presence of a weakly acidic catalyst.

As a process for producing the composite particles using other thermosetting resin, a process may be used in which, e.g., the inorganic compound particles having been lipophilic-treated are kneaded with resin of various types, followed by pulverization and further by treatment to make spherical.

The composite particles comprised of the inorganic compound particles having been lipophilic-treated may and the binder resin optionally be subjected to heat treatment in order to cause the resin to cure better. In particular, the heat treatment may preferably be made under reduced pressure or in an inert atmosphere in order to prevent oxidation of the inorganic compound particles and so forth.

In the case when the composite particles are surface coat-treated with the coupling agent having the functional group, a process may be used in which the composite particles are immersed in a solution prepared by dissolving the coupling agent in water or other solvent by a conventional method, followed by filtration and drying; or a process in which an aqueous solution or solvent solution of the coupling agent is sprayed on the composite particles while agitating them, followed by drying In particular, in order to prevent the composite particles from coalescing and to form uniform coat layers, the process of making the treatment while agitating the composite particles is preferred.

In the case when the composite particles are coated with the resin having the functional group, any process may be used, e.g., a process in which the composite particles and the resin are dry-process blended by means of a Henschel mixer or a high-speed mixer, a process in which the composite particles are impregnated with a solvent containing the resin, and a process in which the resin is sprayed on the composite particles by means of a spray dryer.

The above processes may be used also when the composite particle surfaces having been coated with the coupling agent or resin having the functional group are further coated with a resin.

Also usable are a process in which the composite particles are allowed to react with a phenol and an aldehyde or with a melamine and an aldehyde to coat them with a phenolic resin or melamine resin, a process in which a mixture of acrylonitrile and other vinyl monomer is polymerized in an aqueous medium to coat the particles with an acrylonitrile polymer, and a process in which the particles are coated with polyamide resin by anionic polymerization of a lactam.

Characteristic values concerning the magnetic resin carrier used in the present invention are measured by methods described below.

(Measurement of Characteristic Value of Carrier)

The average particle diameter is shown as a weight-average particle diameter measured with a laser diffraction particle size distribution meter (manufactured by Horiba Seisakusho K.K.).

Values of the magnetization intensity ($\sigma_{1,000}$) and residual magnetization ($\sigma r$) are shown as values measured with a vibration sample magnetism meter VSM-3S-15 (manufactured by Toei Kogyo K.K.) under application of an external magnetic field of 79.6 kA/m (1 kOe).

The true specific gravity is shown as a value measured with a multi-volume densitometer (manufactured by Micromeritix Co.)

The resistivity is shown as a value measured with a high-resistance meter 4329A (manufactured by Yokogawa Hewlett Packard Co.).

Figure 6:
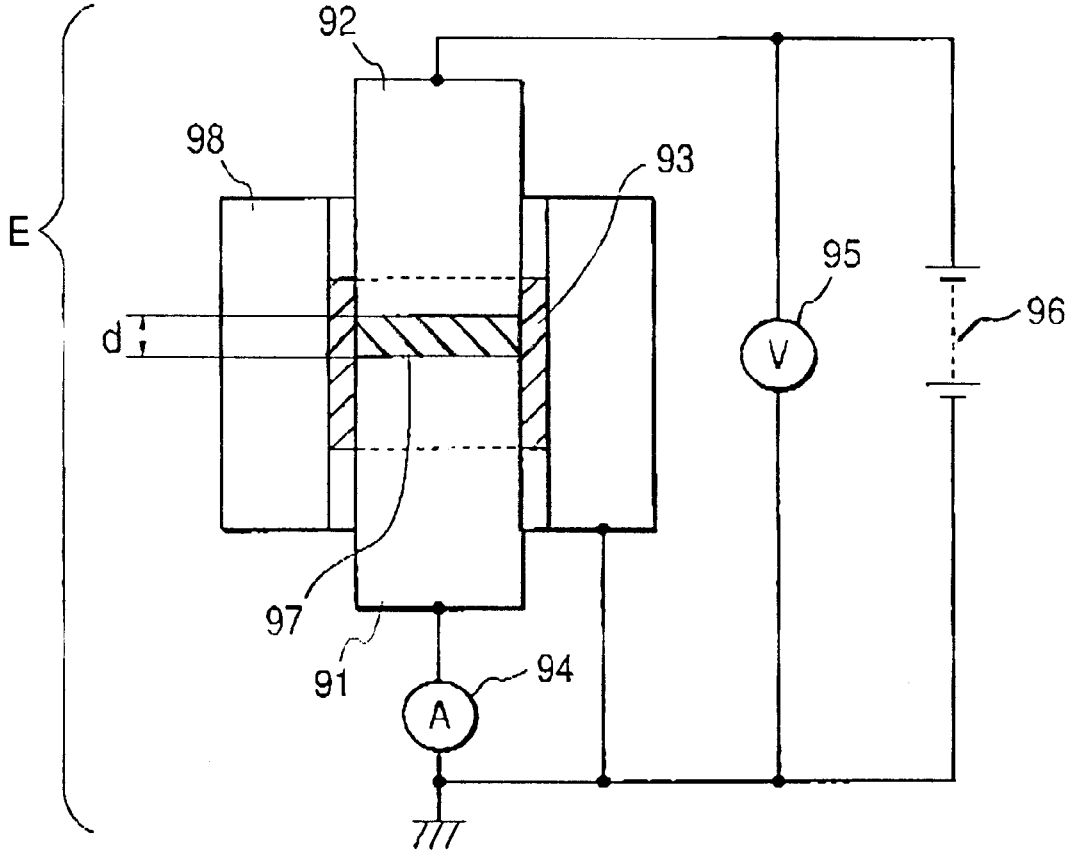
FIG. 6 is a diagrammatic illustration of a cell used to measure volume resistivity.

More specifically, the resistivity of the magnetic resin carrier or carrier cores is measured with a measuring device shown in FIG. 6. In the measuring device shown in FIG. 6, reference numeral 91 denotes a lower electrode; 92, an upper electrode; 93, an insulating material; 94, an ammeter; 95, a voltmeter; 96, a constant-voltage device; and 97, a sample to be measured; 98, a guide ring; and E, a resistance measuring cell. The cell E is packed with the magnetic resin carrier or core material. The lower and upper electrodes 91 and 92 are so provided as to come into contact with the magnetic resin carrier or core material thus packed, where a voltage is applied across the electrodes 91 and 92 and the currents flowing at that time are measured to determine resistivity. In the above measuring method, since the magnetic resin carrier or core material is a powder, a change may occur in a packing and the resistivity may change correspondingly thereto in some cases, thus care must be taken. The measurement is made under conditions of contact area S between the magnetic resin carrier or core material packed and the electrodes: about 2.3 $cm^2$; thickness d: about 2 mm; load of the upper electrode 92: 180 g; and applied voltage: 100 V.

The resistivity of the inorganic compound particles is measured according to the measurement of carrier resistivity. The cell E shown in FIG. 6 is packed with the inorganic compound particles. The lower and upper electrodes 91 and 92 are so provided as to come into contact with the inorganic compound particles thus packed, where a voltage is applied across the electrodes 91 and 92 and the currents flowing at that time are measured to determine resistivity. When the cell is packed with the inorganic compound particles, it is done while rotating the upper electrode 92 right and left so that the electrode comes into uniform contact with the sample. In the above measuring method, the resistivity is measured under conditions of contact area S between the inorganic compound particles packed and the electrodes: about 2.3 $cm^2$; thickness d: about 2 mm; load of the upper electrode 92: 180 g; and applied voltage: 100 V.

A preferred embodiment of magnetic resin carrier cores according to the present invention will be described.

To carry out reaction, first, a phenol, a formalin, water and the magnetic fine particles and non-magnetic inorganic compound particles having been treated with the coupling agent having an epoxy group are charged into a reaction vessel and are thoroughly stirred. Thereafter, a basic catalyst is added and the temperature is raised with stirring, where the reaction temperature is adjusted to 70 to 90° C. to cause the phenolic resin to cure. Here, the temperature may preferably be raised gently so that spherical composite particles having a high sphericity can be obtained. The temperature may preferably be raised at a rate of from 0.5 to 1.5° C./minute, and more preferably from 0.8 to 1.2° C./minute.

After curing, the reaction product is cooled to 40° C. or below, and the aqueous dispersion obtained is filtered and then solid-liquid separated according to a conventional method such as centrifugal separation, followed by washing and then drying. Thus, spherical carrier core particles are obtained in which the magnetic fine particles and the non-magnetic inorganic compound particles are combined with the phenolic resin serving as the binder resin. The carrier core particles may be produced by either of a batch process and a continuous production process.

As a method of coating the surfaces of carrier cores with the resin, a method may be used in which a coating fluid prepared by dissolving or suspending the resin in a solvent is applied to the carrier core surfaces.

In the present invention, when the toner and the carrier are blended to prepare a two-component type developer, they may be blended in such a proportion that the toner in the developer is in a concentration of from 2 to 15% by weight, and preferably from 4 to 13% by weight, where good results can be obtained. If the toner is in a concentration less than 2% by weight, image density tends to lower. If it is in a concentration more than 15% by weight, fog or in-machine scatter tends to occur and also a short service life of the developer may result.

Weight-average particle diameter a of the toner and number-average particle diameter b of the magnetic resin carrier may preferably be in a ratio a/b of from 0.1 to 0.3. If the ratio is less than 0.1, it may be. difficult for the carrier to impart electric charge to the toner in a good state, tending to cause fog or cause toner scatter in an environment of high humidity. If on the other hand the ratio is more than 0.3, the toner may have a too large charge quantity especially in an environment of low humidity, tending to cause a decrease in image density or fog.

As development employing the magnetic resin carrier according to the present invention, the development may be performed using, e.g., a developing means as shown in FIG. 1. Stated specifically, the development may preferably be performed while applying an alternating electric field and in such a state that a magnetic brush comes into touch with the electrostatic image bearing member, e,g, a photosensitive drum 1. A distance B between the developer carrying member (developing sleeve) 11 and the photosensitive drum 1 (distance between S-D) may preferably be from 100 to 1,000 $\mu$m. This is preferable for preventing carrier adhesion and improving dot reproducibility. If it is smaller (i.e., the gap is narrower) than 100 $\mu$m, the developer tends to be insufficiently fed, resulting in a low image density. If it is larger than 1,000 μm, the magnetic line of force from a magnet pole S1 may broaden to make the magnetic brush have a low density, resulting in a poor dot reproducibility, or to weaken the force of binding the carrier, tending to cause carrier adhesion.

The alternating electric field may preferably be applied at a peak-to-peak voltage of from 300 to 3,000 V and a frequency of from 500 to 10,000 Hz, and preferably from 1,000 to 7,000 Hz, which may each be applied under appropriate selection in accordance with processes. In this instance, the waveform used may be selected from triangular waveform, rectangular waveform, sinusoidal waveform, or waveform with a varied duty ratio. If the applied voltage is lower than 300 V, a sufficient image density can be attained with difficulty, and fog toner having adhered to non-image areas may not be well collected in some cases. If it is higher than 5,000 V, the latent image may be disordered through the magnetic brush to cause a lowering of image quality.

Use of a two-component developer having a toner well charged enables application of a low fog take-off voltage (Vback), and enables the photosensitive member to be low charged in its primary charging, thus the photosensitive member can be made to have a longer lifetime. The Vback, which may depend on the development system, may preferably be 200 V or below, and more preferably 150 V or below.

As contrast potential, a potential of from 100 V to 400 V may preferably be used so that a sufficient image density can be achieved.

If the frequency is lower than 500 Hz, the toner having come into contact with the electrostatic image bearing member (photosensitive drum) can not be well vibrated when returned to the developing sleeve, so that fog tends to occur If it is higher than 10,000 Hz, the toner can not follow up the electric field to tend to cause a decrease of image quality.

What is important in the development according to the present invention is as follows: In order to carry out development promising a sufficient image density, achieving a superior dot reproducibility and free of carrier adhesion, the magnetic brush on the developing sleeve 11 may preferably be made to come into touch with the photosensitive drum 1 at a width (developing nip C) of from 3 to 8 mm. If the developing nip C is narrower than 3 mm, it may be difficult to well satisfy sufficient image density and dot reproducibility. If it is broader than 8 mm, the developer may pack into the nip to cause the machine to stop from operating, or it may be difficult to well prevent the carrier adhesion. As methods for adjusting the developing nip, the nip width may appropriately be adjusted by adjusting the distance between a developer-regulating blade 15 and the developing sleeve 11, or by adjusting the distance between the developing sleeve 11 and the photosensitive drum 1.

The image forming method of the present invention enables development that is faithful to dot latent images because it is not affected by the magnetic brush and does not disorder latent images when, in the reproduction of full-color images attaching importance especially to halftones, three or more developing assemblies for magenta, cyan and yellow are used and the two-component type developer of the present invention is used especially in combination with a development system where digital latent images are formed- In the step of transfer, too, the use of the toner fine-powder cut-off and having a sharp particle size distribution enables achievement of a high transfer efficiency and hence enables achievement of a high image quality at both halftone areas and solid areas.

Together with the achievement of a high image quality, the use of the two-component type developer of the present invention can also well bring about the effect of the present invention that any shear may less be applied to the developer in developing assemblies and no decrease in image density may occur even when copied on a large number of sheets.

In order to form tighter images, development for black may finally be made, using an image forming apparatus having developing assemblies for magenta, cyan, yellow and black, whereby images can more assume a tightness.

The image forming method of the present invention will be described below with reference to the accompanying drawings.

In an image forming appratus shown in FIG. 1, a magnetic brush comprised of magnetic particles 123 is formed on the surface of a transport sleeve 122 by the action of a magnetic force a magnet roller 121 has. This magnetic brush is brought into touch with the surface of an electrostatic image bearing member (photosensitive drum) 101 to charge the photosensitive drum 101 electrostatically. A charging bias is kept applied to the transport sleeve 122 by a bias applying means (not shown). The photosensitive drum 101 thus charged is exposed to laser light 124 by means of an exposure unit to form a digital electrostatic image. The electrostatic image thus formed on the photosensitive drum 101 is developed with a toner 119*a* held in a developer 119 containing the toner 119*a* and a carrier 119*b* and carried on a developing sleeve 111 internally provided with a magnet roller 112 and to which a development bias is kept applied by a bias applying means (not shown).

The inside of a developing assembly 104 is partitioned into a developer chamber $R_1$ and an agitator chamber $R_2$ by a partition wall 117, and is provided with a developer transport screw 113 and 114, respectively. At the upper part of the agitator chamber $R_2$, a toner storage chamber R3 holding a replenishing toner 118 is formed. At the lower part of the toner storage chamber R3, a supply opening 120 is provided.

As a developer transport screw 113 is rotatingly driven, the developer held in the developer chamber $R_1$ is transported in the longitudinal direction of the developing sleeve 111 while being agitated. The partition wall 117 is provided with openings (not shown) on this side and the inner side as viewed in the drawing. The developer transported to one side of the developer chamber $R_1$ by the screw 113 is sent into the agitator chamber $R_2$ through the opening on the same side of the partition wall 117, and is delivered to the developer transport screw 114. The screw 114 is rotated in the direction opposite to the screw 113. Thus, while the developer in the agitator chamber $R_2$, the developer delivered from the developer chamber $R_1$ and the toner replenished from the toner storage chamber R3 are agitated and blended, the developer is transported inside the agitator chamber $R_2$ in the direction opposite to the screw 113 and is sent into the developer chamber $R_1$ through the opening on the other side of the partition wall 117.

To develop the electrostatic image formed on the photosensitive drum 101, the developer 119 held In the developer chamber $R_1$ is drawn up by the magnetic force of the magnet roller 112, and is carried on the surface of the developing sleeve 111. The developer carried on the surface of the developing sleeve 111 is transported to a regulating blade 115 as the developing sleeve 111 is rotated, where the developer is regulated into a developer thin layer with a proper layer thickness. Thereafter, it reaches a developing zone where the developing sleeve 111 faces the photosensitive drum 101 In the magnet roller 112 at its part corresponding to the developing zone, a magnetic pole (development pole) N1 is positioned, and the development pole N1 forms a magnetic field at the developing zone. This magnetic field causes the developer to rise in ears, thus the magnetic brush of the developer is formed in the developing zone. Then, the magnetic brush comes into touch with the photosensitive drum 101. The toner attracted to the magnetic brush and the toner attracted to the surface of the developing sleeve 111 are moved to and become attracted to the region of the electrostatic image on the photosensitive drum 101, where the electrostatic image is developed by reverse development, thus a toner image is formed.

The developer having passed through the developing zone Is returned into the developing assembly 104 as the developing sleeve 111 is rotated, then stripped off the developing sleeve 111 by a repulsive magnetic field formed between magnetic poles S1 and S2, and dropped into the developer chamber $R_1$ and agitator chamber $R_2$ so as to be collected there Once a T/C ratio (blend ratio of toner and carrier, i.e., toner concentration in the developer) of the developer 119 in the developing assembly 104 has lowered as a result of the above development, the toner 118 is replenished from the toner storage chamber R3 in the quantity corresponding to the quantity of the toner consumed by the development, thus the T/C ratio of the developer 119 is maintained at a prescribed value. To detect the T/C ratio of the developer 119 in the developing assembly 104, a toner concentration detecting sensor 128 is used which measures changes in permeability of the developer by utilizing the inductance of a coil. The toner concentration detecting sensor 128 has a coil (not shown) on its inside.

A developer regulating blade 115 provided beneath the developing sleeve 111 to regulate the layer thickness of the developer 119 on the developing sleeve 111 is a non-magnetic blade 115 made of a non-magnetic material such as aluminum or SUS316 stainless steel. The distance between its end and the face of the developing sleeve 111 is 300 to 1,000 $\mu$m, and preferably 400 to 900 $\mu$m. If this distance is smaller than 300 $\mu$m, the magnetic carrier may be caught between them to tend to make the developing layer uneven, and also the developer necessary for performing good development may be coated on the sleeve with difficulty, so that developed images with a low density and much unevenness may be obtained. In order to prevent uneven coating (what is called the blade clog) due to unauthorized particles included in the developer, the distance may preferably be 400 $\mu$m or larger. If it is larger than 1,000 $\mu$m, the quantity of the developer coated on the developing sleeve 111 increases to make it difficult to make desired regulation of the developer layer thickness, so that the magnetic carrier particles adhere to the photosensitive drum 101 in a large quantity and also the circulation of the developer and the control of the developer by the non-magnetic blade 115 may become less effective to tend to cause fog because of a decrease of triboelectricity of the toner.

This layer of magnetic carrier particles, even when the developing sleeve 111 is rotatingly driven in the direction of an arrow, moves slower as it separates from the sleeve surface in accordance with the balance between the binding force exerted by magnetic force and gravity and the transport force acting toward the transport of the developing sleeve 111. Particles drop by the effect of gravity.

Accordingly, the position to arrange the magnetic poles N and N and the fluidity and magnetic properties of the magnetic carrier particles may appropriately be selected, so that the magnetic carrier particle layer is transported toward the magnetic pole N1 as it stands nearer to the sleeve, to form a moving layer. Along this movement of the magnetic carrier particles, the developer is transported to the developing zone as the developing sleeve 111 is rotated, and participates in development.

The toner image formed by development is transferred onto a transfer medium (recording medium) 125 transported to a transfer zone, by means of a transfer blade 127 which is a transfer means to which a transfer bias is kept applied by a bias applying means 126. The toner image thus transferred onto the transfer medium is fixed to the transfer medium by means of a fixing assembly (not shown). Transfer residual toner remaining on the photosensitive drum 101 without being transferred to the transfer medium in the transfer step is charge-controlled in the charging step and collected at the time of development.

Figure 3:
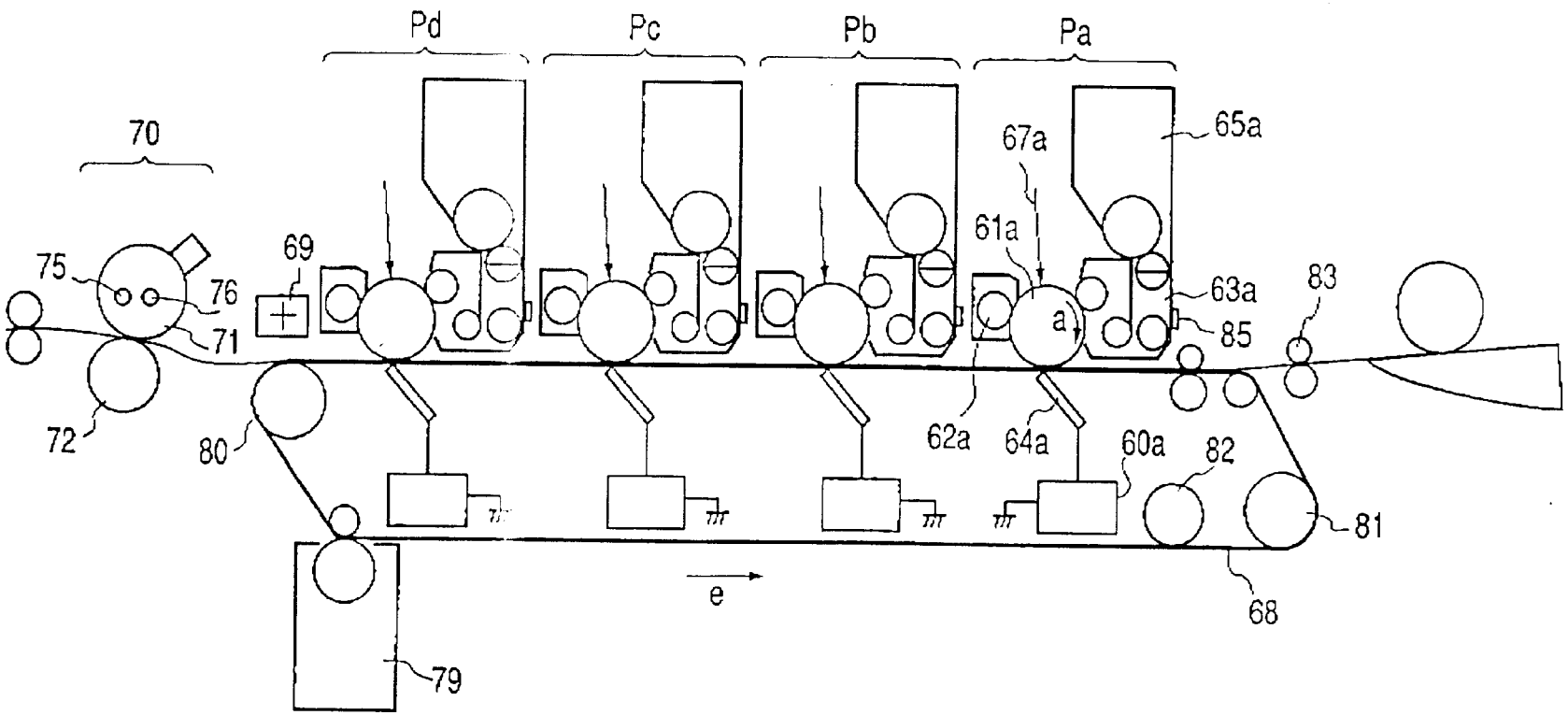
FIG. 3 is a schematic illustration of an example of a full-color image forming apparatus, used to carrying out the image forming method of the present invention.

FIG. 3 schematically illustrates an example in which the image forming method of the present invention is applied to a full-color image forming apparatus.

The main body of the full-color image forming apparatus is provided side by side with a first image forming unit Pa, a second image forming unit Pb, a third image forming unit Pc and a fourth image forming unit Pd, and images with respectively different colors are formed on a transfer medium through the process of latent image formation, development and transfer.

The respective image forming unit provided side by side in the image forming apparatus are each constituted as described below taking the case of the first image forming unit Pa.

The first image forming unit Pa has an electrophotographic photosensitive drum 61*a* of 30 mm diameter as the electrostatic image bearing member. This photosensitive drum 61*a* is rotatingly moved in the direction of an arrow a. Reference numeral 62*a* denotes a primary charging assembly as a charging means, and a magnetic brush formed on a 16 mm diameter sleeve is so provided as to be in contact with the photosensitive drum 61*a*. Reference numeral 67*a* denotes laser light for forming an electrostatic image on the photosensitive drum 61*a* whose surface has uniformly been charged by means of the primary charging assembly 62*a*. Reference numeral 63*a* denotes a developing assembly as a developing means for developing the electrostatic image held on the photosensitive drum 61*a*, to form a color toner image, which holds a a developer having a color toner and a carrier. Reference numeral 64*a* denotes a transfer blade as a transfer means for transferring the color toner image formed on the surface of the photosensitive drum 61*a*, to the surface of a transfer medium (recording medium) transported by a beltlike transfer medium carrying member 68. A transfer bias is kept applied thereto by a bias applying means 60*a*. This transfer blade 64*a* comes into touch with the back of the transfer medium carrying member 68 and can apply a transfer bias.

In this first image forming unit Pa, the photosensitive drum 61*a* is uniformly primarily charged by the primary charging assembly 62*a*, and thereafter the electrostatic image is formed on the photosensitive member by the exposure laser light 67*a*. The electrostatic image is developed by the developing assembly 63*a* using a color toner. The toner image thus formed by development is transferred to the surface of the transfer medium by applying transfer bias from the transfer blade 64*a* coming into touch with the back of the beltlike transfer medium carrying member 68 carrying and transporting the transfer medium, at a first transfer zone (the position where the photosensitive member and the transfer medium come into contact).

The toner is consumed as a result of the development and the T/C ratio lowers, whereupon this lowering is detected by a toner concentration detecting sensor 85 which measures changes in permeability of the developer by utilizing the inductance of a coil, and a replenishing toner 65*a* is replenished in accordance with the quantity of the toner consumed. The toner concentration detecting sensor 85 has a coil (not shown) on its inside.

In the image forming apparatus, the second image forming unit Pb, third image forming unit Pc and fourth image forming unit Pd, constituted in the same way as the first image forming unit Pa but having different color toners held In the developing assemblies are provided side by side. For example, a yellow toner is used in the first image forming unit Pa, a magenta toner in the second image forming unit Pb, a cyan toner in the third image forming unit Pc and a black toner in the fourth image forming unit Pd, and the respective color toners are successively transferred to the transfer medium at the transfer zones of the respective image forming units. In this course, the respective color toners are superimposed while making registration, on the same transfer medium during one-time movement of the transfer medium. After the transfer is completed, the transfer medium is separated from the surface of the transfer medium carrying member 68 by a separation charging assembly 69, and then sent to a fixing assembly 70 by a transport means such as a transport belt, where a final full-color image is formed by only-one-time fixing.

The fixing assembly 70 has a 40 mm diameter fixing roller 71 and a 30 mm diameter pressure roller 72 in pair. The fixing roller 71 has heating means 75 and 76 on its inside.

The unfixed color toner images transferred onto the transfer medium are passed through the pressure contact area between the fixing roller 71 and the pressure roller 72 of this fixing assembly 70, whereupon they are fixed onto the transfer medium by the action of heat and pressure In the apparatus shown in FIG. 3, the transfer medium carrying member 68 is an endless beltlike member. This beltlike member is moved in the direction of an arrow e by a drive roller 80. Reference numeral 79 denotes a transfer belt cleaning device; 81, a belt follower roller; and 82, a belt charge eliminator. Reference numeral 83 denotes a pair of resist rollers for transporting to the transfer medium carrying member 68 the transfer medium kept in a transfer medium holder.

As the transfer means, the transfer blade coming into touch with the back of the transfer medium carrying member may be replaced with a contact transfer means that comes into contact with the back of the transfer medium carrying member and can directly apply a transfer bias, as exemplified by a roller type transfer roller The above contact transfer means may also be replaced with a non-contact transfer means that performs transfer by applying a transfer bias from a corona charging assembly provided in non-contact with the back of the transfer medium carrying member, as commonly used.

However, in view of the advantage that the quantity of ozone generated when the transfer bias is applied can be controlled, it is more preferable to use the contact transfer means.

An example of another image forming method of the present invention will be described below with reference to FIG. 4.

Figure 4:
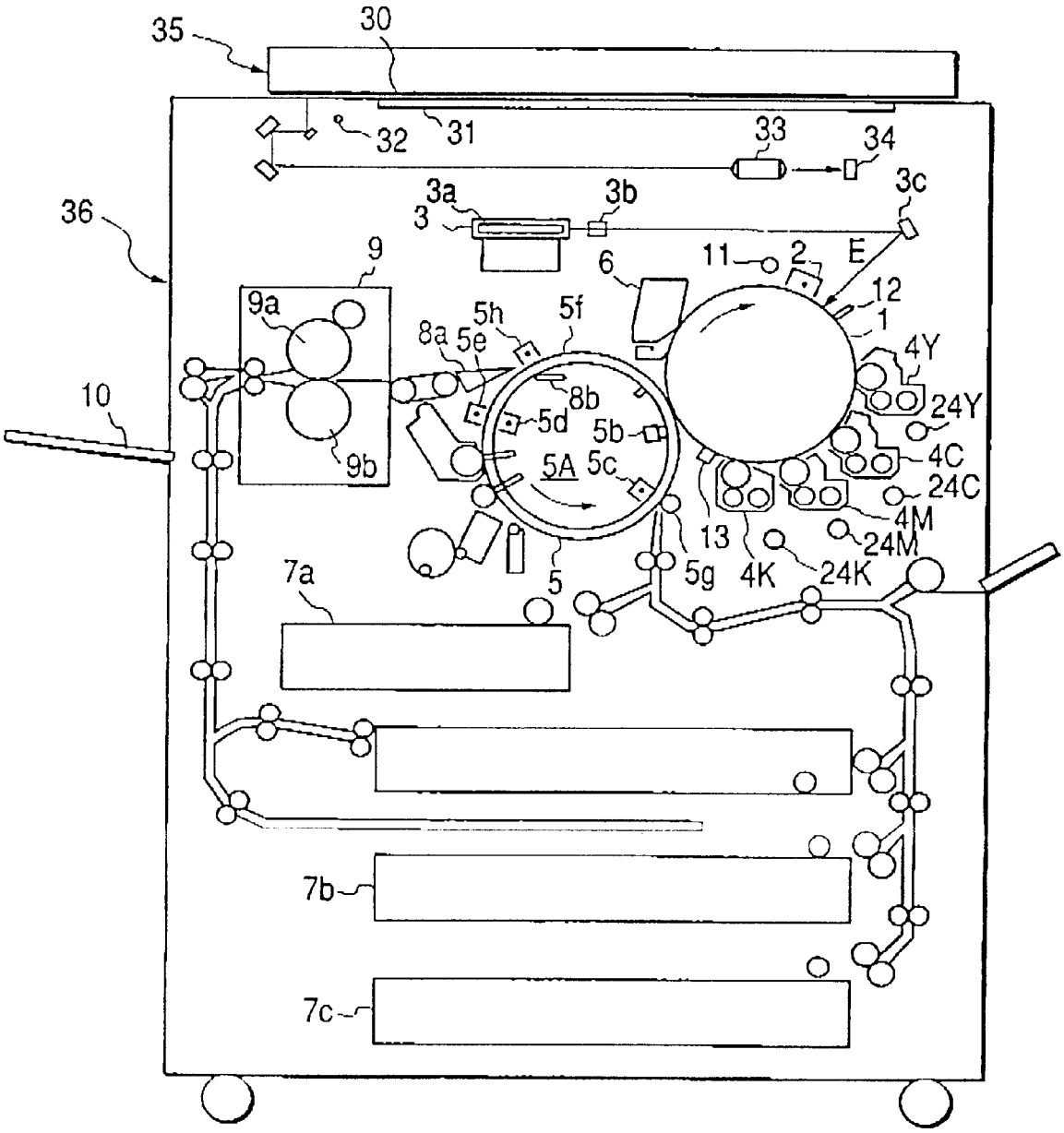
FIG. 4 is a schematic illustration of another example of an image forming apparatus, used to carry out the image forming method according to the present invention.

FIG. 4 schematically illustrates the constitution of an example of an image forming apparatus which can carry out the image forming method of the present invention.

This image forming apparatus is set up as a full-color copying machine. The full-color copying machine has, as shown in FIG. 4, a digital color-image reader section 35 at the top and a digital color-image printer section 36 at a lower part.

In the image reader section, an original 30 is placed on an original-setting glass 31, and an exposure lamp 32 is put into exposure scanning, whereby an optical image reflected from the original 30 is focused on a full-color sensor 34 through a lens 33 to obtain color separation image signals. The color separation image signals are processed by a video processing unit (not shown) through an amplifying circuit (not shown), and then forwarded to the digital color-image printer section.

In the image printer section, a photosensitive drum 1 as an electrostatic image bearing member is a photosensitive member formed of, e.g., an organic photoconductor, and is supported rotatably in the direction of an arrow. Around the photosensitive drum 1, a pre-exposure lamp 11, a corona charging assembly 2 as a primary charging assembly, a laser exposure optical system 3 as a latent image forming means, a potential sensor 12, four different color developing assemblies 4Y, 4C, 4M and 4K, a detecting means 13 for detecting the amount of light on the drum, a transfer member 5A and a cleaner 6 are provided.

In the laser exposure optical system 3, the image signals sent from the reader section are converted into optical signals for image scanning exposure in a laser output section (not shown) The laser light thus converted is reflected on a polygonal mirror 3*a* and projected on the surface of the photosensitive drum 1 through a lens 3*b* and a mirror 3*c*.

In the printer section, the photosensitive drum 1 is rotated in the direction of an arrow at the time of image formation The photosensitive drum 1 is, after destaticized by the pre-exposure lamp 11, uniformly negatively charged by means of the charging assembly 2, and then irradiated with an optical image E for each separated color to form an electrostatic image on the photosensitive drum 1.

Next, a stated developing assembly is operated to develop the electrostatic image formed on the photosensitive drum 1 to form on the photosensitive drum 1 a visible image formed of a negatively chargeable toner comprised basically of resin, i.e., a toner image The developing assemblies 4Y, 4C, 4M and 4K are sequentially come close to the photosensitive drum 1 in accordance with the respective separated colors by the operation of eccentric cams 24Y, 24C, 24M and 24K, respectively, to perform development.

The transfer member 5A has a transfer drum 5, a transfer charging assembly 5*b*, an attraction charging assembly 5*c* for electrostatically attracting a recording medium, and an attraction roller 5*g* provided opposingly to the assembly 5*c*, an inside charging assembly 5*d*, an outside charging assembly 5*e* and a separation charging assembly 5*h*. The transfer drum 5 is supported on a shaft so that it can be rotatably driven, and has a transfer sheet 5*f* serving as a recording material holding member that holds the recording material (transfer medium) at an open zone on the periphery thereof, the transfer sheet being provided in a cylindrical form under integral adjustment. As the transfer sheet 5*f*, a resin film such as polycarbonate film is used.

The recording material is transported from a cassette 7*a*, 7*b* or 7*c* to the transfer drum 5 through a transfer sheet transport system, and is held on its transfer sheet 5*f*. With the rotation of the transfer drum 5, the recording material held on the transfer drum 5 is repeatedly transported to the transfer position facing the photosensitive drum 1. In the course where it passes the transfer position, the toner image formed on the photosensitive drum 1 is transferred to the recording material by the action of the transfer charging assembly 5*b*.

The above steps of image formation are repeatedly carried out on yellow (Y), magenta (M), cyan (C) and black (K), thus a color toner image formed by superimposingly transferring four color toner images is obtained on the recording material held on the transfer drum 5.

In the case of one-side image formation, the recording material to which the four color toner images have been thus transferred is separated from the transfer drum 5 by the action of a separation claw 8*a*, a separation push-up roller 5*b* and the separation charging assembly 5*h*, and sent to a heat fixing assembly 9. This heat fixing assembly 9 is constituted of a heat fixing roller 9*a* having a heating means internally and a pressure roller 9*b*. The recording material is passed through the pressure contact area between the heat fixing roller 9*a* and the pressure roller 9*b*, serving as a heating member. Thus, the full color toner image supported on the recording medium is fixed to the recording medium. That is, by this fixing step the color mixing of the toners, color formation, and fixing to the recording material are carried out until a full-color permanent image Is formed. Thereafter, the recording material having the image thus formed is outputted to a tray 10. Thus, the full-color copying on one sheet is completed, Meanwhile, the photosensitive drum 1 is cleaned by the cleaner 6 so that toners remaining on its surface are removed, and thereafter again put to the steps of image formation.

In the image forming method of the present invention, the toner image formed by developing the electrostatic image formed on the electrostatic image bearing member may be transferred to the recording medium via an intermediate transfer member.

More specifically, such an image forming method has the step of transferring to an intermediate transfer member the toner formed by developing the electrostatic image formed on the electrostatic image bearing member, and the step of transferring to a recording medium the toner image transferred to the intermediate transfer member.

An example of the image forming method employing the intermediate transfer member will specifically be described below with reference to FIG. 5.

Figure 5:
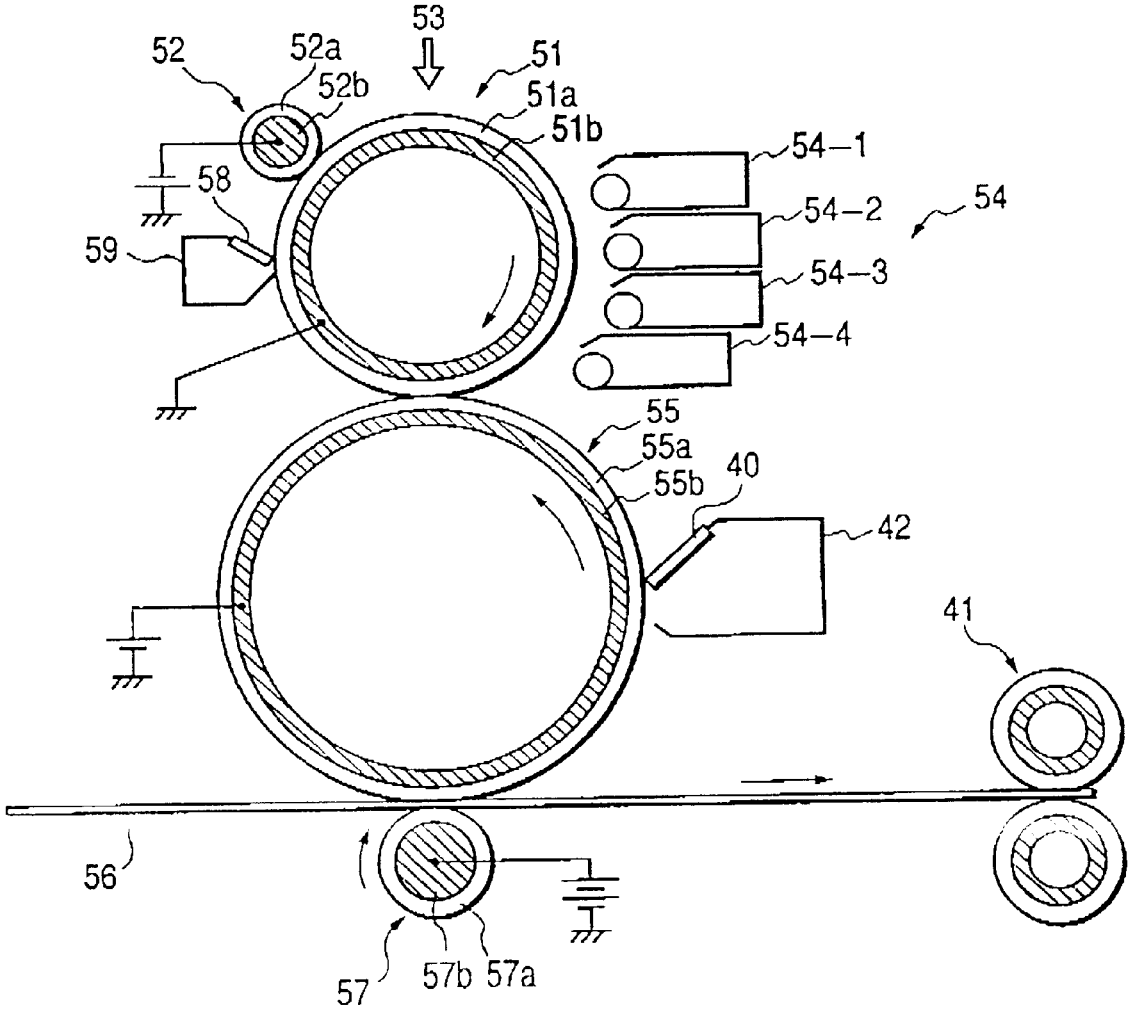
FIG. 5 is a schematic illustration of still another example of an image forming apparatus, used to carry out the image forming method according to the present invention.

In the apparatus system shown in FIG. 5, a developer having a cyan toner, a developer having a magenta toner, a developer having a yellow toner and a developer having a black toner are put into cyan, magenta, yellow and black developing assemblies 54-1, 54-2, 54-3 ad 54-4, respectively. An electrostatic image is formed on a photosensitive member 51 serving as the electrostatic image bearing member, by an electrostatic image forming means 53 such as laser light. The electrostatic image formed on the photosensitive member 51 is developed by magnetic brush development, non-magnetic one-component development or magnetic jumping development to form toner images of respective colors on the photosensitive member 51. The photosensitive member 51 may be a photosensitive drum or photosensitive belt having a photoconductive insulating material layer 51 a formed of amorphous selenium, cadmium sulfide, zinc oxide, an organic photoconductor or amorphous silicon. The photosensitive member is rotated in the direction of an arrow by means of a drive mechanism (not shown). As the photosensitive member 51, a photosensitive member having an amorphous silicon photosensitive layer or organic photosensitive layer is preferably used.

The organic photosensitive layer may be of either of a single-layer type in which a charge-generating material and a charge-transporting material are contained in the same layer, or a function-separated photosensitive layer formed of a charge transport layer and a charge generation layer. A multi-layer type photosensitive layer comprising a conductive support and superposingly formed thereon the charge generation layer and the charge transport layer in this order is one of preferred examples.

As binder resins for the organic photosensitive layer, polycarbonate resins, polyester resins or acrylic resins have a very good cleaning performance, and may hardly cause faulty cleaning and melt-adhesion of toner or filming of external additives to the photosensitive member.

The step of charging has a system making use of a corona charging assembly and being in non-contact with the photosensitive member 51 or a contact type system making use of a contact charging member such as a charging roller. Either system may be used. The contact charging system as shown in FIG. 5 is preferably used so as to enable efficient and uniform charging, simplify the system and make ozone less occur.

A charging roller 52 is basically comprised of a mandrel 52*b* at the center and a conductive elastic layer 52*a* that forms the periphery. The charging roller 52 is brought into pressure contact with the surface of the photosensitive member 51 under a pressure, and is rotated in follow-up with the rotation of the photosensitive member 51.

When the charging roller is used, preferable process conditions are as follows: Contact pressure of the charging roller 52 is 5 to 500 g/cm; and, when a voltage formed by superimposing an AC voltage on a DC voltage, AC voltage is 0.5 to 5 kVpp, AC frequency is 50 to 5 kHz and DC voltage is ±0.2 to ±5 kV. p As other contact charging members, a method making use of a charging blade and a method making use of a conductive brush are known in the art These contact charging members have the advantages that no high voltage is required and ozone less occurs.

The charging roller or charging blade serving as the contact charging members may preferably be made of conductive rubber, and a release coating may be provided on its surface. To form the release coating, it is possible to use nylon resins, PVDF (polyvinylidene fluoride), PVDC (polyvinylidene chloride) and fluorine acrylic resins.

The toner image formed on the photosensitive member 51 is transferred to an intermediate transfer member 55 to which a voltage (e.g., ±0.1 to ±5 kV) is kept applied. The intermediate transfer member 55 is comprised of a pipelike conductive mandrel 55*b* and a medium-resistance elastic layer 55*a* that forms the periphery. The mandrel 55*b* may have a plastic surface provided thereon with a conductive layer (e.g., a conductive coating).

The medium-resistance elastic layer 55*a* is a solid or foamed-material layer made of an elastic material such as silicone rubber, Teflon rubber, chloroprene rubber, urethane rubber or EPDM (ethylene-propylene-diene terpolymer) in which a conductivity-providing agent such as carbon black, zinc oxide, tin oxide or silicon carbide has been mixed and dispersed to adjust electrical resistance (volume resistivity) to a medium resistance of from $10^5$ to $10^{11}$ Ω·cm.

The intermediate transfer member 55 is axially supported in parallel to the photosensitive member 51 so as to be provided in contact with the underside of the photosensitive member 51, and is counterclockwise rotated in the direction of an arrow at the same peripheral speed as that of the photosensitive member 51.

In the course where a first-color toner image formed on the surface of the photosensitive member 51 is passed through the transfer nip at which the photosensitive member 51 and the intermediate transfer member 55 come into contact, the toner image is transferred orderly onto the periphery of the intermediate transfer member 55 by the aid of an electric field formed at the transfer nip by a transfer bias applied to the intermediate transfer member 55.

Transfer residual toner remaining on the photosensitive member 51 without being transferred to the intermediate transfer member 55 is removed by a photosensitive member cleaning member 58 and collected in a cleaning container 59 for the photosensitive member 51.

A transfer means 57 is axially supported in parallel to the intermediate transfer member 55 so as to be provided in contact with the underside of the intermediate transfer member 55. The transfer means 57 is, e.g., a transfer roller or a transfer belt, which is clockwise rotated in the direction of an arrow at the same peripheral speed as that of the intermediate transfer member 55. The transfer means 57 may be provided in the manner that it comes in direct contact with the intermediate transfer member 55, or in the manner that it comes in indirect contact with the latter via a transfer belt provided between the intermediate transfer member 55 and the transfer means 57.

In the case of the transfer roller, it is basically comprised of a mandrel 57*b* at the center and a conductive elastic layer 57*a* that forms the periphery.

To form the intermediate transfer member and transfer roller, materials commonly available may be used. The volume resistivity of the transfer means may be set smaller than the volume resistivity of the intermediate transfer member, whereby the voltage applied to the transfer means can be decreased. Thus, good toner images can be formed on the transfer medium and at the same time the transfer medium can be prevented from winding around the intermediate transfer member. In particular, what is preferred is that the elastic layer of the intermediate transfer member has a volume resistivity at least 10 times higher than the elastic layer of the transfer means.

Hardness of the intermediate transfer member and transfer roller is measured according to JIS K-6301. The intermediate transfer member used in the present invention may preferably be formed of an elastic layer having a hardness in the range of from 10 to 40 degrees. As for the elastic layer of the transfer roller, it may preferably have a hardness greater than the hardness of the electric layer of the intermediate transfer member and has the value of from 41 to 80 degrees in order to prevent the transfer medium from winding around the intermediate transfer member. If inversely the hardness is greater in the intermediate transfer member than in the transfer roller, a concave is formed on the side of the transfer roller, so that the transfer medium tends to wind around the intermediate transfer member.

The transfer means 57 is rotated at a peripheral speed equal to, or different from, the peripheral speed of the intermediate transfer member 55. The transfer medium 56 is transported to the part between the intermediate transfer member 55 and the transfer means 57, and at the same time a bias with a polarity reverse to that of triboelectric charges possessed by the toner is applied to the transfer means 57 from a transfer bias applying means, so that the toner images on the intermediate transfer member 55 is transferred to the surface of the transfer medium 56.

Transfer residual toner remaining on the intermediate transfer member without being transferred to the transfer medium 56 is removed by an intermediate transfer member cleaning member 40 and collected in a cleaning container 42 for the intermediate transfer member. The toner image transferred to the transfer medium 56 is fixed to the transfer medium 56 by means of a heat fixing assembly 41.

The transfer roller may also be made of the same material as the charging roller. Preferable process conditions are as follows: Contact pressure of the transfer roller is 2.94 to 490 N/m (3 to 500 g/cm), and more preferably 19.6 N/m to 294 N/m, and DC voltage is ±0.2 to ±10 kV.

If the linear pressure as the contact pressure is 2.94 N/m or below, transport aberration of transfer mediums and faulty transfer tends to occur undesirably.

The conductive elastic layer 57*a* of the transfer roller 57 is, e.g., a solid or foamed-material layer made of an elastic material such as polyurethane rubber or EPDM (ethylene-propylene-diene terpolymer) in which a conductivity-providing agent such as carbon black, zinc oxide, tin oxide or silicon carbide has been mixed and dispersed to adjust electrical resistance (volume resistivity) to a medium resistance of from $10^6$ to $10^{10}$ Ω·cm.

A specific example for the measurement of toner particle diameter is shown below.

To 100 to 150 ml of an electrolytic solution, 0.1 to 5 ml of a surface active agent (alkylbenzene sulfonate) is added, and 2 to 20 mg of a sample to be measured is added thereto. The electrolytic solution in which the sample has been suspended is subjected to dispersion for about 1 minute to about 3 minutes by means of an ultrasonic dispersion machine. Particle size distribution of toner particles of 0.3 to 40 μm diameters is measured on the basis of volume, by means of, e.g., Coulter Counter Multisizer, using an aperture of 17 μm or 100 μm adapted appropriately to toner particle size Number-average particle diameter and weight-average particle diameter measured under these conditions are determined by computer processing. Then the cumulative proportion in cumulative distribution of diameter ½ time or less the number-average particle diameter is calculated from number-based particle size distribution to determine the cumulative value of diameter ½ time or less the number-average particle diameter. Similarly, the cumulative proportion in cumulative distribution of diameter twice or more the weight-average particle diameter is calculated from volume-based particle size distribution to determine the cumulative value of diameter twice or more the weight-average particle diameter.

The quantity of triboelectricity of the two-component type developer is measured by a method described below.

1.6 g of the toner and 18.4 g of the magnetic resin carrier are put In a 50 ml bottle made of polyethylene, which is then left for a day in an open state in each environment. In an environment of high temperature and high humidity, the container is hermetically closed after leaving so that the sample is not dewed, and this is further left for 2 hours and thereafter set in a measuring device. The sample is blended with a tumbler mixer for 60 seconds, and this blended powder (developer) is put in a container made of a metal at the bottom of which a conductive screen with an opening of 20 μm (625 meshes) is provided, and then sucked by means of a suction device. The quantity of triboelectricity is determined from the difference in weight before and after the suction and from the potential accumulated in a capacitor connected to the container. Here, suction pressure is set at 33.3 kPa (250 mmHg). By this method, the quantity of triboelectricity (Q) is calculated according to the following expression.

$$Q(\mu C/g)=(C\times V)\times(W_1-W_2)^{-1}$$

wherein $W_1$ is the weight before suction, $W_2$ is the weight after suction, C is the capacity of the capacitor, and V is the potential accumulated in the capacitor.

The quantity of triboelectricity of developers after running is measured by sampling 1 g of a developer present on the developing sleeve, and using the above measuring device without mixing or agitating the sample.

The shape factors SF-1 and SF-52 are measured in the following way.

At least 300 toner particles are sampled at random using a field emission scanning electron microscope S-800, manufactured by Hitachi Ltd, and SF-1 and SF-2 calculated from the following expressions are determined using an image processing analyzer LUZEX 3; manufactured by Nireko Co.).

$$SF\text{-}1=(MXLNG)^2/\text{AREA}\times\pi/4\times100$$

wherein MXLNG represents an absolute maximum length of a toner particle, and AREA represents a projected area of a toner particle.

$$SF\text{-}2=(PERI)^2/\text{AREA}\times1/4\pi\times100$$

wherein PERI represents a peripheral length of a toner particle, and AREA represents a projected area of a toner particle.

EXAMPLES

The present invention will be described below in greater detail by giving Examples. These by no means limit the present invention.

Magnetic Carrier
Production Example 1

| | (by weight) |
|---|---|
| Phenol (hydroxybenzene) | 50 parts |
| Aqueous 37% by weight formalin solution | 80 parts |
| Water | 50 parts |

Fine magnetite particles containing alumina surface-treated with silane type coupling agent having epoxy group, KBM403 (available from Shin-Etsu Chemical Co., Ltd.) (number-average particle diameter: 0.24 μm; resistivity: $5\times10^5$ Ω·cm) 280 parts Fine $\alpha$-$Fe_2O_3$ particles surface-treated with KBM403 (number-average particle diameter: 0.40 μm;

| | |
|---|---|
| resistivity: $8\times10^9$ Ω•cm) | 120 parts |
| Aqueous 25% by weight ammonia | 15 parts |

The above materials were put into a four-necked flask of a treating machine. Temperature was raised to 85° C. in 60 minutes while mixing with stirring, and kept at that temperature. Reaction was carried out for 120 minutes to effect curing. Thereafter, the reaction mixture was cooled to 30° C., and 500 parts by weight of water was added thereto. Then, the supernatant formed was removed, and the precipitate was washed with water, followed by air drying. Subsequently, the air-dried product was further dried at 150 to 180° C. for 24 hours under reduced pressure [(667 Pa (5 mmHg)] to obtain magnetic carrier cores (A) having phenolic resin as a binder resin. On the magnetic carrier cores (A), 0.4% by weight of adsorbed water was present after leaving at 30° C./80%RH for 24 hours.

The surfaces of the magnetic carrier cores (A) thus obtained were treated with a toluene solution of 5% by weight of γ-aminopropyltrimethoxysilane:

$$NH_2CH_2CH_2CH_2—Si—(—OCH_3)_3.$$

The surfaces of the magnetic carrier cores (A) were found to have been treated with 0.2% by weight of the γ-aminopropyltrimethoxysilane During the treatment, the toluene was evaporated while treating the cores and while applying a shear stress continuously to the magnetic carrier cores (A). It was confirmed that

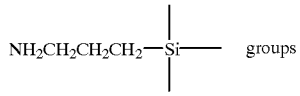

were present on the surfaces of the magnetic carrier cores (A).

The magnetic carrier cores (A) treated with the silane coupling agent and held in the treating machine were coated with a resin with stirring at 70° C., by adding under reduced pressure a solution prepared by adding γ-aminopropyltrimethoxysilane to a silicone resin KR221 (available from Shln-Etsu Chemical Co., Ltd.) in an amount of 3% based on the silicone resin solid matter, diluted with toluene so as to be in a concentration of 20% as the silicone resin solid matter.

Subsequently, after stirring for 2 hours, heat treatment was made at 140° C. for 2 hours in an atmosphere of nitrogen gas. After agglomeration was broken up, coarse particles were removed with a sieve with an opening of 54 μm (200 meshes) to obtain a magnetic resin carrier 1.

The magnetic resin carrier 1 thus obtained had SF-1 of 107, a weight-average particle diameter of 35 μm, an electrical resistivity of $7\times10^{13}$ Ω·cm, a magnetization intensity ($\sigma_{1,000}$) of 42 $Am^2/kg$ and residual magnetization (σr) of 3.1 $Am^2/kg$ at 79.6 kA/m (1 kOe), a true specific gravity of 3.71, and a bulk density of 1.87 $g/cm^3$.

Magnetic Carrier

Production Example 2

Magnetic resin carrier 2 was obtained in the same manner as in Production Example 1 except that the carrier cores were not treated with the silicone resin KR221 to which the γ-aminopropyltrimethoxysilane was added and the treatment was made at 120° C. for 2 hours.

Physical properties of the magnetic resin carrier 2 are shown in Table 1.

Magnetic Carrier

Production Example 3

Magnetic resin carrier 3 was obtained in the same manner as in Production Example 2 except that the silane coupling agent KBM403 was not used.

Physical properties of the magnetic resin carrier 3 are shown in Table 1.

Magnetic Carrier

Production Example 4

Magnetic resin carrier 4 was obtained in the same manner as in Production Example 2 except that the magnetic carrier cores (A) were surface-treated with n-propyltrimethoxysilane in place of the γ-aminopropyltrimethoxysilane.

Physical properties of the magnetic resin carrier 4 are shown in Table 1.

The above materials were thoroughly premixed using a Henschel mixer, and the mixture obtained was melt-kneaded using a twin-screw extrusion kneader. The kneaded product obtained was cooled and thereafter crushed into particles of about 1 to 2 mm diameter by means of a hammer mill, followed by pulverization with a fine-grinding mill of an air-jet system. The pulverized product thus obtained was further classified, followed by treatment with the silicone resin KR221 to obtain a magnetic resin carrier 5 having a weight-average particle diameter of 35 $\mu$m, SF-1 of 148, an electrical resistivity of $3\times10^{13}$ $\Omega\cdot$cm, $\sigma_{1,000}$ of 36 $Am^2/kg$, a residual magnetization of 2.8 $Am^2/kg$, a true specific gravity of 3.63 and a bulk density of 1.65 $g/cm^3$.

| Magnetic Carrier Production Example 6 | (by weight) |
|---|---|
| Styrene | 50 parts |
| Methyl methacrylate | 12 parts |
| Finer magnetite particles as used in Production Example 1 | 280 parts |
| Fine $\alpha$-$Fe_2O_3$ particles as used in Production Example 1 | |

The above materials were mixed and thereafter heated to 70° C., followed by addition of 0.7 part by weight of azobisisobutyronitrile to prepare a monomer composition. The monomer composition was dispersed in an aqueous 1% by weight polyvinyl alcohol solution to carry out granulation by means of a homogenizer at 4,500 rpm for 10 minutes. Thereafter, polymerization was carried out at 700° C. for 10 hours with stirring by using paddles, and then the product was filtered out of the aqueous polyvinyl alcohol solution, followed by washing, drying, and then treatment with silicone resin KR211 to obtain a magnetic resin carrier 6 having physical properties as shown in Table 1.

Magnetic Carrier

Production Example 7

Magnetic resin carrier 7 having physical properties as shown in Table 1 was obtained in the same manner as in Production Example 2 except that the alumina-containing fine magnetite particles used therein were replaced with magnetite particles containing no alumina.

Toner Production Example 1

Into 710 parts of ion-exchanged water, 450 parts of an aqueous 0.1 mol/liter $Na_3PO_4$ solution was introduced, and the mixture obtained was heated to 60° C., followed by stirring at 1,300 rpm. using TK-type homomixer (manufactured by Tokushu Kika Kogyo). Then, 68 parts of an aqueous 1.0 mol/liter $CaCl_2$ solution was slowly added thereto to obtain an aqueous medium containing $Ca_3(PO_4)_2$.

| | (by weight) |
|---|---|
| Styrene | 160 parts |
| n-Butyl acrylate | 34 parts |
| Copper phthalocyanine pigment | 12 parts |
| Di-tert-butylsalicylic acid aluminum compound | 2 parts |
| Saturated polyester (acid value: 10 mg KOH/g; peak molecular weight: 8,500) | 10 parts |
| Monoester wax (Mw: 500; Mn: 400; Mw/Mn: 1.25; melting point: 69° C.; viscosity: 6.5 mPa•s; Vickers hardness: 1.1; SP value: 8.6) | 20 parts |

The above materials were heated to 60° C., and then dispersed using a TK-type homomixer (manufactured by Tokushu Kika Kogyo) at 12,000 rpm. To the dispersion obtained, 10 parts by weight of a polymerization initiator 2,2'-azobis(2,4-dimethylvaleronitrile) was dissolved to prepare a polymerizable monomer composition. This polymerizable monomer composition was introduced into the above aqueous medium, and then stirred at 10,000 rpm for 10 minutes by means of a Kurea mixer (manufactured by & Emu Technique K.K.) at 60° C. in an atmosphere of $N_2$ to granulate the polymerizable monomer composition. Thereafter, polymerization was carried out for 10 hours while stirring the aqueous medium by using paddle stirring blades, at a temperature raised to 80° C. and while maintaining pH at 6.

After the polymerization was completed, the reaction mixture was cooled, and hydrochloric acid was added so as to adjust its pH to 2 to dissolve the calcium phosphate, followed by filtration, water washing, and then drying to obtain polymerization particles (cyan toner particles).

The polymerization particles thus obtained contained 8.4 parts by weight of the monoester wax per 100 parts by weight of the binder resin. Also, the cross-section observation of the polymerization particles by the use of a transmission electron microscope (TEM) confirmed that the particles had a core/shell structure wherein the wax was encapsulated with the shell resin layer.

The binder resin of the polymerization particles obtained also had an SP value of 19 and Tg of 60° C.

To 100 parts by weight of the polymerization particles (cyan toner particles) obtained, the following three types of external additives were added externally. After the external addition, coarse particles were removed with a sieve with an opening of 43 $\mu$m (330 meshes) to obtain a negatively chargeable, toner No. 1. The toner No. 1 had a weight-average particle diameter of 7.3 $\mu$m and SF-1 of 108. Also, in this toner, the cumulative value of distribution of diameter ½-time or less the number-average particle diameter was 10.3% by number. The cumulative value of distribution of diameter twice or more the weight-average particle diameter was 1.8% by volume.

Physical properties of the toner thus obtained are shown in Table 2.

(1) First hydrophobic fine silica powder, 0.3 part by weight:

BET specific surface area: 170 $m^2/g$

Number-average particle diameter: 12 nm

Hydrophobic-treated in gaseous phase, with 20 parts by weight of hexamethyldisilazane based on 100 parts by weight of the fine silica powder.

(2) Second hydrophobic fine silica powder, 0.7 part by weight:

BET specific surface area: 70 $m^2/g$

Number-average particle diameter: 30 nm

Hydrophobic-treated in gaseous phase, with 10 parts by weight of hexamethyldisilazane based on 100 parts by weight of the fine silica powder.

(3) Hydrophobic fine titanium oxide powder, 0.4 part by weight:
BET specific surface area: 100 $m^2/g$
Number-average particle diameter: 45 nm
Hydrophobic-treated in aqueous medium, with 10 parts by weight of isobutyltrimethoxysilane based on 100 parts by weight of the fine titanium oxide powder.

Toner Production Example 2

Polymerization particles (cyan toner particles) were prepared in the same manner as in Toner Production Example 1 except that an aqueous medium containing the $Ca_3(PO_4)_2$ in a larger quantity than that in Toner Production Example 1 and the number of revolution of the Kurea mixer was changed to 15,000 rpm. External additives were externally added in the same manner as in Toner Production Example 1 to prepare a negatively chargeable, toner No. 2. The toner No. 2 had a weight-average particle diameter of 2.8 $\mu$m and SF-1 of 112.

Toner Production Example 3

Polymerization particles (cyan toner particles) were prepared in the same manner as in Toner Production Example 1 except that an aqueous medium containing the $Ca_3(PO_4)_2$ in a smaller quantity than that in Toner Production Example 1 and the number of revolution of the Kurea mixer was changed to 6,000 rpm. External additives were externally added in the same manner as in Toner Production Example 1 to prepare a negatively chargeable, toner No. 3. The toner No. 3 had a weight-average particle diameter of 10.1 $\mu$m and SF-1 of 107.

Toner Production Example 4

To the same polymerization particles (cyan toner particles) as those obtained in Toner Production Example 1, any external additive was not added to prepare a negatively chargeable, toner No. 4. The toner No. 4 thus obtained had a weight-average particle diameter of 7.4 $\mu$m and SF-1 of 108.

Toner Production Example 5

To the same polymerization particles (cyan toner particles) as those obtained in Toner Production Example 1, the following external additives were added to prepare a negatively chargeable, toner No. 5. The toner No. 5 thus obtained had a weight-average particle diameter of 7.5 $\mu$m and SF-1 of 108.

(1) Hydrophilic fine silica powder, 0.2 part by weight:
BET specific surface area: 200 $m^2/g$
Number-average particle diameter: 12 nm
(2) Hydrophilic fine silica powder, 0.8 part by weight:
BET specific surface area: 50 $m^2/g$
Number-average particle diameter: 30 nm
(3) Hydrophobic fine titanium oxide powder, 0.4 part by weight:
BET specific surface area: 100 $m^2/g$
Number-average particle diameter: 45 nm
Hydrophobic-treated with 10 parts by weight of isobutyltrimethoxysilane based on 100 parts by weight of the fine titanium oxide powder.

Toner Production Example 6

| | (by weight) |
|---|---|
| Polyester resin comprised of terephthalic acid/fumaric acid/trimellitic acid anhydride/derivative of bisphenol A | 100 parts |
| Copper phthalocyanine pigment | 4 parts |
| Di-tert-butylsalicylic acid aluminum compound | 4 parts |

The above materials were thoroughly premixed using a Henschel mixer, and the mixture obtained was melt-kneaded using a twin-screw extrusion kneader. The kneaded product obtained was cooled and thereafter crushed into particles of about 1 to 2 mm diameter by means of a hammer mill, followed by pulverization with a fine-grinding mill of an air-jet system. The pulverized product thus obtained was further classified to obtain negatively triboelectrically chargeable cyan toner particles with a weight-average particle diameter of 6.8 $\mu$m.

To the cyan toner particles thus obtained, the same three types of external additives as those used in Toner Production Example 1 were added to prepare a negatively chargeable, toner No. 6. The toner No. 6 had a weight-average particle diameter of 6.8 $\mu$m and SF-1 of 142.

Toner Production Example 7

Magenta color polymerization particles (magenta toner particles) were obtained in the same manner as in Toner Production Example 1 except that the copper phthalocyanine pigment was replaced with a quinacridone pigment. To the polymerization particles thus obtained, the three types of external additives were added in the same manner as in Toner Production Example 1 to prepare a negatively chargeable, toner No. 7. The toner No. 7 had a weight-average particle diameter of 7.3 $\mu$m and SF-1 of 108.

Toner Production Example 8

Yellow color polymerization particles (yellow toner particles) were obtained in the same manner as in Toner Production Example 1 except that the copper phthalocyanine pigment was replaced with C.I. Pigment Yellow 93 and C.I. Solvent Yellow 162. To the polymerization particles thus obtained, the three types of external additives were added in the same manner as in Toner Production Example 1 to prepare a negatively chargeable, toner No. 8. The toner No. 8 had a weight-average particle diameter of 7.2 $\mu$m and SF-1 of 109.

Toner Production Example 9

Black color polymerization particles (black toner particles) were obtained in the same manner as in Toner Production Example 1 except that the copper phthalocyanine pigment was replaced with carbon black. To the polymerization particles thus obtained, the three types of external additives were added in the same manner as in Toner Production Example 1 to prepare a negatively chargeable, toner No. 9. The toner No. 9 had a weight-average particle diameter of 7.4 $\mu$m and SF-1 of 108.

Toner Production Example 10

Toner No. 10 was prepared in the same manner as in Toner Production Example 6 except that the aluminum compound of di-tert-butylsalicylic acid was not used. The toner No. 10 had a weight-average particle diameter of 7.0 $\mu$m and SF-1 of 141.

Toner Production Example 11

Toner No. 11 was prepared in the same manner as in Toner Production Example 1 except that the hydrophobic silica powders (1) and (2) were not used. The toner No. 10 had a weight-average particle diameter of 7.3 μm and SF-1 of 108.

Example 1

Using a V-type mixing machine, 92 parts by weight of the magnetic resin carrier 1 and 8 parts by weight of the toner No. 1 were so blended as to be in a toner concentration of 8%. Thus, a two-component type developer was produced.

Figure 2:
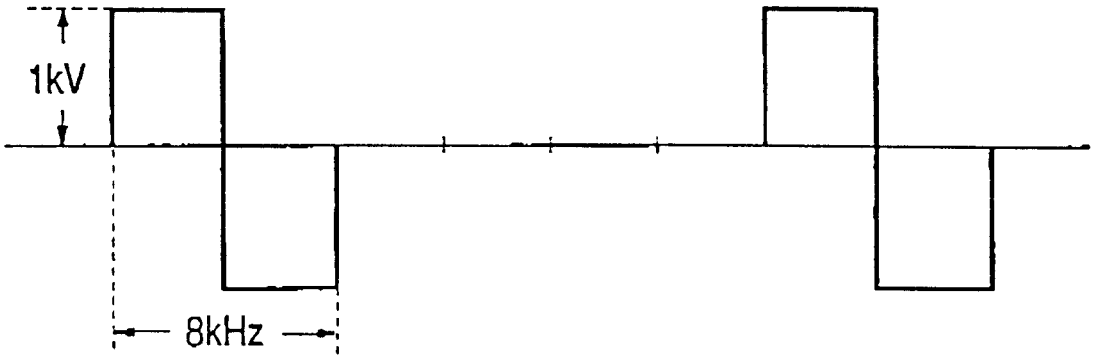
FIG. 2 illustrates an alternating electric field used in Example 1.

Using this two-component type developer, a running test was made. As an image forming apparatus, a commercially available digital copying machine GP55 (manufactured by CANON INC.) was used which was so remodeled that the developing apparatus shown in FIG. 1 was mountable, where a development bias as shown in FIG. 2 was applied and the fixing assembly was so remodeled that both the heat roller and the pressure roller were replaced with rollers whose surface layers were coated with PFA in a thickness of 1.2 μm and the oil applying mechanism was removed. A 10,000-sheet running test was made in each environment of 23° C./60%RH (N/N: normal temperature/normal humidity), 23° C./5%RH (N/L: normal temperature/low humidity) and 32.5° C./90%RH (H/H: high temperature/high humidity), using an original having an image area percentage of 25%. Evaluation was made according to the following evaluation methods.

Results obtained are shown in Table 3.

(1) Image density:

Image density was measured with Macbeth Densitometer RD918 type (manufactured by Macbeth Co.) fitted with an SPI filter, as a relative density of images formed on plain paper.

(2) Carrier adhesion:

Solid white images were reproduced, and the part between the developing zone and the cleaning zone on the photosensitive drum was sampled by making a transparent pressure-sensitive adhesive tape adhere closely thereto. The number of magnetic resin carrier particles having adhered to the photosensitive drum surface at its area of 5 cm×5 cm was counted and the number of carrier particles having adhered per 1 $cm^2$ was calculated.

A: Less than 5 particles.
B: More than 5 particles to less than 10 particles.
C: More than 10 particles to less than 20 particles.
D: More than 20 particles.

(3) Fog:

Average reflectance Dr (%) of plain paper before image reproduction was measured with a reflectometer REFLECTOMETER MODEL TC-6DS, manufactured by Tokyo Denshoku K.K. Meanwhile, a solid white image was reproduced on plain paper, and then reflectance Ds (%) of the solid white image was measured. Fog (%) was calculated from the following expression:

$$\text{Fog}(\%)=Dr(\%)-Ds(\%)$$

A: Less than 0.4%.
B: More than 0.4% to less than 0.8%.
C; More than 0.8% to less than 1.2%.
D; More than 1.2%.

(4) Spots around line images:

How the line width of a 200 μm thick line image became large due to spots around line images was examined to make evaluation.

A: Within the range of 210 μm or less.
B: Within the range of from more than 210 μm to 220 μm
C: Within the range of from more than 220 μm to 230 μm.
D: Beyond the range of C.

Example 2

The procedure of Example 1 was repeated except that the carrier was replaced with the magnetic resin carrier 2. As a result, good results were obtained as shown in Table 3, though slightly inferior to those of Example 1 with regard to fog control. This is presumed to be due to a slight increase in toner-spent on carrier particles after running, because of the carrier not coated with resin.

Comparative Example 1

The procedure of Example 1 was repeated except that the carrier was replaced with the magnetic resin carrier 3. As a result, as shown in Table 3, inferior results were obtained in N/L with regard to image density decrease and fog. This is presumed to be due to non-uniform dispersion due to the fine ferrite particles not treated with the silane coupling agent and also due to a non-uniformity of coat layers which caused faulty charging of the toner.

Comparative Example 2

The procedure of Example 1 was repeated except that the carrier was replaced with the magnetic resin carrier 4. As a result, as shown in Table 3, inferior results were obtained with regard to fog during the running. This is presumed to be due to the fact that the surface treating agent of the core material of the magnetic resin carrier had no reactive functional groups and hence did not achieve a sufficient adhesion to the core material to have come off the core material.

Comparative Example 3

The procedure of Example 2 was repeated except that the toner was replaced with the toner No. 2. As a result, as shown in Table 3, the image density was low from the beginning and also inferior performance was seen with regard to fog control. Accordingly, the evaluation was stopped.

Comparative Example 4

The procedure of Example 2 was repeated except that the toner was replaced with the toner No. 3. As a result, as shown in Table 3, inferior results were obtained with regard to the spots around line images and the fog.

Comparative Example 5

The procedure of Example 2 was repeated except that the toner was replaced with the toner No. 4. As a result, as shown in Table 3, the image density was low and also inferior results were obtained with regard to the fog. Accordingly, the evaluation was stopped.

Example 3

The procedure of Example 2 was repeated except that the toner was replaced with the toner No. 5. As a result, as shown in Table 3, in H/H the image density was so high as to be slightly inferior to those of Example 2 with regard to the fog and the spots around line images, which, however, were on the level of no problem in practical use. This is presumed to be due to the external additive silica fine powder not hydrophobic-treated, which caused a decrease in environmental stability.

Example 4

The procedure of Example 2 was repeated except that the toner was replaced with the toner No. 6. As a result, as shown in Table 3, results slightly inferior to those of Example 2 were obtained with regard to the image density and the fog, which, however, were on the level of no problem in practical use. This is presumed to be due to a low sphericity of toner shape, which made the charging of toner slightly non-uniform Example 5

Images were reproduced in the same manner as in Example 1 except that, as the image forming apparatus, GP55 was replaced with a modified machine of a commercially available full-color copying machine CLC2400 (manufactured by CANON INC.) and four color toners Nos. 1, 7, 8 and 9 were used. As a result, good results were obtained.

Example 6

The procedure of Example 2 was repeated except that the toner was replaced with the toner No. 10. As a result, as shown in Table 3, in H/H, results inferior to those of Example 2 were obtained with regard to the fog and the spots around line images, which, however, were on the level anyhow tolerable in practical use. This is presumed to be due to the use of no charge control agent, which caused a decrease in the electric charge of toner in H/H.

Example 7

The procedure of Example 2 was repeated except that the toner was replaced with the toner No. 11. As a result, as shown in Table 3, results inferior to those of Example 2 were obtained with regard to the spots around line images and the fog, which, however, were on the level tolerable in practical use. This is presumed to be due to the external additive used in a smaller quantity, which resulted in a low blending performance for the toner and the carrier.

Example 8

The procedure of Example 1 was repeated except that the carrier was replaced with the magnetic resin carrier 5. As a result, as shown in Table 3, results inferior to those of Example 1 were obtained with regard to the carrier adhesion and the fog, which, however, were on the level of no problem in practical use. This is presumed to be due to the carrier which was not spherical since it was not produced by polymerization.

Example 9

The procedure of Example 1 was repeated except that the carrier was replaced with the magnetic resin carrier 6. As a result, as shown in Table 3, results inferior to those of Example 1 were obtained with regard to the carrier adhesion during running and the fog, which, however, were on the level of no problem in practical use. This is presumed to be due to the magnetic resin carrier the binder resin of which did not contain the phenolic resin, so that its coating with the coupling agent was in an insufficient strength to have made the electric charge non-uniform as a result of coat break.

Example 10

The procedure of Example 1 was repeated except that the carrier was replaced with the magnetic resin carrier 7. As a result, though the fog increased slightly in H/H, good results were obtained as shown in Table 3.

Magnetic Carrier
Production Example 8

| | (by weight) |
|---|---|
| Phenol (hydroxybenzene) | 50 parts |
| Aqueous 37% by weight formalin solution | 80 parts |
| Water | 50 parts |

Fine magnetite particles containing alumina surface-treated with γ-glycidoxypropyltrimethoxysilane coupling agent (KBM403, available from Shin-Etsu Chemical Co., Ltd.) (number-average particle diameter: 0.24 μm; resistivity; $5\times10^5$ Ω·cm) 280 parts Fine $\alpha$-$Fe_2O_3$ particles surface-treated with γ-glycidoxypropyltrimethoxysilane coupling agent (KBM403, available from Shin-Etsu Chemical Co., Ltd.) (number-average particle diameter: 0.60 μm;

| | |
|---|---|
| resistivity: $8 \times 10^9$ Ω•cm) | 120 parts |
| Aqueous 25% by weight ammonia | 15 parts |

The above materials were put into a four-necked flask. Temperature was raised to 85° C. in 60 minutes while mixing with stirring, and kept at that temperature. Reaction was carried out for 120 minutes to effect curing. Thereafter, the reaction mixture was cooled to 30° C., and 500 parts by weight of water was added thereto. Then, the supernatant formed was removed, and the precipitate was washed with water, followed by air drying. Subsequently, the air-dried product was further dried at 150 to 180° C. for 24 hours under reduced pressure [(667 Pa (5 mmHg)] to obtain magnetic carrier cores (B) having phenolic resin as a binder resin. On the surfaces of the magnetic carrier cores (B), hydroxyl groups were present.

With stirring at 50° C. under reduced pressure, the magnetic carrier cores (B) thus obtained were surface-treated with a solution of γ-(2-aminoethyl) aminopropyltrimethoxysilane:

$$NH_2—CH_2—CH_2—NH—CH_2CH_2CH_2—Si—(—OCH_3)_3$$

and a silicone resin KR255 (available from Shin-Etsu Chemical Co., Ltd.) which were diluted with toluene so as to be 4% by weight for the former and 20% by weight for the latter.

The surfaces of the magnetic carrier cores (B) thus obtained were found to have been coated with 0.1% by weight of the γ-(2-aminoethyl)aminopropyltrimethoxysilane and 0.5% by weight of the silicone resin. During the treating of the surfaces of the magnetic carrier cores (B) with the coating solution, the toluene was evaporated while applying a shear stress continuously.

Thereafter, heat treatment was made at 140° C. for 2 hours in an atmosphere of nitrogen gas. After agglomeration was broken up, particles were classified using a sieve with an opening of 54 μm (200 meshes) to obtain a magnetic resin carrier (8).

The magnetic resin carrier (8) thus obtained had SF-1 of 107, a weight-average particle diameter of 34 μm, a resistivity of $7.4\times10^{13}$ Ω·cm, a magnetization intensity ($\sigma_{1,000}$) of 43 $Am^2/kg$ (emu/g) and residual magnetization (σr) of 3.3

$Am^2/kg$ (emu/g) at 79.6 kA/m (1 kOe), a true specific gravity of 3.75, and a bulk density of 1.85 $g/cm^3$.

Physical properties of the magnetic resin carrier (8) are shown in Table 4.

Magnetic Carrier

Production Example 9

Carrier cores were surface-treated in the same manner as in the production of the magnetic resin carrier (8) except that the γ-(2-aminoethyl)aminopropyltrimethoxysilane was not used. Thus, a comparative magnetic resin carrier (9) was prepared, whose carrier core surfaces had been coated with 0.7% by weight of silicone resin.

Physical properties of the comparative magnetic resin carrier (9) are shown in Table 4.

Magnetic Carrier

Production Example 10

Carrier cores were surface-treated in the same manner as in the production of the magnetic resin carrier (8) except that the silicone resin was replaced with polytetrafluoroethylene (weight-average molecular weight: 32,000) to prepare a toluene coating solution containing it in an amount of 10% by weight as solid content. Thus, a magnetic resin carrier (10) was prepared, the surfaces of the magnetic carrier cores (B) of which had been coated with 0.1% by weight of the γ-(2-aminoethyl)aminopropyltrimethoxysilane and 0.8% by weight of polytetrafluoroethylene.

Physical properties of the magnetic resin carrier (10) are shown in Table 4.

Magnetic Carrier

Production Example 11

In the production of the magnetic resin carrier (8), carrier cores were coated in the same manner as in Magnetic Carrier Production Example 10 except that the carrier cores were coated with the toluene coating solution of polytetrafluoroethylene, without being treated with γ-(2-aminoethyl)aminopropyltrimethoxysilane. Thus, a comparative magnetic resin carrier (11) was prepared, the carrier core surfaces of which had been coated with 0.7% by weight of polytetrafluoroethylene.

Physical properties of the comparative magnetic resin carrier (11) are shown in Table 4.

Magnetic Carrier

Production Example 12

Comparative magnetic resin carrier (12) was prepared in the same manner as in Magnetic Carrier Production Example 8 except that untreated fine particles of magnetite and $\alpha$-$Fe_2O_3$ were used as the inorganic fine particles constituting the magnetic resin carrier (B).

Physical properties of the comparative magnetic resin carrier (12) are shown in Table 4.

Magnetic Carrier

Production Example 13

Comparative magnetic resin carrier (13) was repared in the same manner as in Magnetic Carrier Production Example 8 except that fine magnetite particles and fine $\alpha$-$Fe_2O_3$ particles both treated with vinyltrimethoxysilane were used as the inorganic fine particles constituting the magnetic resin carrier (B).

Physical properties of the comparative magnetic resin carrier (13) are shown in Table 4.

Magnetic Carrier

Production Example 14

Comparative magnetic resin carrier (14) was prepared in the same manner as in Magnetic Carrier Production Example 8 except that ferrite core particles having a number-average particle diameter of 35 μm were surface-coated with 0.1% by weight of the γ-(2-aminoethyl) aminopropyltrimethoxysilane and 0.7% by weight of the silicone resin. This comparative magnetic resin carrier (14) had a true specific gravity of 4.92.

Physical properties of the comparative magnetic resin carrier (13) are shown in Table 4.

Magnetic Carrier

Production Example 15

Comparative magnetic resin carrier (15) was prepared in the same manner as in Magnetic Carrier Production Example 8 except that iron core particles having a number-average particle diameter of 35 μm were surface-coated with 0.1% by weight of the γ-(2-aminoethyl ) aminopropyltrimethoxysilane and 0.7% by weight of the silicone resin. This comparative magnetic resin carrier (15) had a true specific gravity of 5.02.

Physical properties of the comparative magnetic resin carrier (15) are shown in Table 4.

Magnetic Carrier

Production Example 16

Magnetic carrier cores (a) were prepared in the same manner as in Magnetic Carrier Production Example 8 except for using fine magnetite particles having been surface-treated with γ-glycidoxypropyltrimethoxysilane, having a number-average particle diameter of 0.19 μm and a resistivity of $3.02\times10^4$ Ω·cm. Magnetic resin carrier (16) was prepared in the same manner as in Magnetic Carrier Production Example 8 except that the magnetic carrier cores (a) were further surface-coated with 0.1% by weight of the γ-(2-aminoethyl)aminopropyltrimethoxysilane and 0.7% by weight of the silicone resin. This magnetic resin carrier (16) had a resistivity of $1.0\times10^9$ Ω·cm.

Physical properties of the magnetic resin carrier (16) are shown in Table 4.

Magnetic Carrier

Production Example 17

Magnetic carrier cores (b) were prepared in the same manner as in Magnetic Carrier Production Example 8 except for using 200 parts by weight of fine magnetite particles having been surface-treated with γ-glycidoxypropyltrimethoxysilane, having a number-average particle diameter of 0.35 μm and a resistivity of $3\times10^5$ Ω·cm, and using 200 parts by weight the fine $\alpha$-$Fe_2O_3$ particles having been surface-treated with γ-glycidoxypropyltrimethoxysilane. Magnetic resin carrier (17) was prepared in the same manner as in Magnetic Carrier Production Example 8 except that the magnetic carrier cores (b) were further surface-coated with 0.1% by weight of the γ-(2-aminoethyl)aminopropyltrimethoxysilane and 0.7% by weight of the silicone resin. This magnetic resin carrier (17) had a resistivity of $7.0\times10^{15}$ Ω·cm.

Physical properties of the magnetic resin carrier (17) are shown in Table 4.

Magnetic Carrier

Production Example 18

Comparative magnetic resin carrier (18) was prepared in the same manner as in Magnetic Carrier Production Example 8 except that magnetic carrier cores (c) having been coated with 0.1% by weight of methyltrimethoxysilane were prepared by surface-treating the magnetic carrier cores (B) with a toluene solution of 5% by weight of methyltrimethoxysilane and subsequently treated with a toluene solution of the silicone resin so as to be coated with 0.7% by weight of the silicone resin.

Physical properties of the comparative magnetic resin carrier (18) are shown in Table 4.

Magnetic Carrier

Production Example 19

Magnetic carrier cores (C) were prepared in the same manner as in Magnetic Carrier Production Example 8 except for using 350 parts by weight of the fine magnetite particles having been surface-treated with γ-glycidoxypropyltrimethoxysilane and using 50 parts by weight of the fine α-$Fe_2O_3$ particles having been treated with γ-glycidoxypropyltrimethoxysilane. The subsequent procedure of Magnetic Carrier Production Example 8 was repeated to prepare a magnetic resin carrier (19) having been surface-coated with the γ-(2-aminoethyl) aminopropyltrimethoxysilane and silicone resin.

Physical properties of the magnetic resin carrier (19) are shown in Table 4 .

Magnetic Carrier

Production Example 20

Magnetic carrier cores (D) were prepared in the same manner as in Magnetic Carrier Production Example 8 except for using 385 parts by weight of the fine magnetite particles having been surface-treated with γ-glycidoxypropyltrimethoxysilane and using 15 parts by weight of the fine α-$Fe_2O_3$ particles having been treated with γ-glycidoxypropyltrimethoxysilane. The subsequent procedure of Magnetic Carrier Production Example 8 was repeated to prepare a magnetic resin carrier (20) having been surface-coated with the γ-(2-aminoethyl) aminopropyltrimethoxysilane and silicone resin.

Physical properties of the magnetic resin carrier (20) are shown in Table 4.

Magnetic Carrier

Production Example 21

Magnetic carrier cores (E) were prepared in the same manner as in Magnetic Carrier Production Example 8 except for using 200 parts by weight of the fine magnetite particles having been surface-treated with γ-glycidoxypropyltrimethoxysilane and using 200 parts by weight of the fine α-$Fe_2O_3$ particles having been treated with γ-glycidoxypropyltrimethoxysilane. The subsequent procedure of Magnetic Carrier Production Example 8 was repeated to prepare a magnetic resin carrier (21) having been surface-coated with the γ-(2-aminoethyl) aminopropyltrimethoxysilane and silicone resin.

Physical properties of the magnetic resin carrier (21) are shown in Table 4.

Magnetic Carrier

Production Example 22

Magnetic carrier cores (F) were prepared in the same manner as in Magnetic Carrier Production Example 8 except for using 150 parts by weight of the fine magnetite particles having been surface-treated with γ-glycidoxypropyltrimethoxysilane and using 250 parts by weight of the fine α$Fe_2O_3$ particles having been treated with γ-glycidoxypropyltrimethoxysilane. The subsequent procedure of Magnetic Carrier Production Example 8 was repeated to prepare a magnetic resin carrier (22) having been surface-coated with the γ-(2-aminoethyl) aminopropyltrimethoxysilane and silicone resin.

Physical properties of the magnetic resin carrier (22) are shown in Table 4.

Magnetic Carrier

Production Example 23

Magnetic carrier cores (G) were prepared in the same manner as in Magnetic Carrier Production Example 8 except for using 110 parts by weight of the fine magnetite particles having been surface-treated with γ-glycidoxypropyltrimethoxysilane and using 290 parts by weight of the fine α-$Fe_2O_3$ particles having been treated with γ-glycidoxypropyltrimethoxysilane The subsequent procedure of Magnetic Carrier Production Example 8 was repeated to prepare a magnetic resin carrier (23) having been surface-coated with the γ-(2-aminoethyl) aminopropyltrimethoxysilane and silicone resin.

Physical properties of the magnetic resin carrier (23) are shown in Table 4.

Magnetic Carrier

Production Example 24

Magnetic carrier cores (H) were prepared in the same manner as in Magnetic Carrier Production Example 8 except that the fine magnetite particles were replaced with 280 parts by weight of magnetic fine Cu—Zn ferrite particles having been surface-treated with γ-glycidoxypropyltrimethoxysilane (number-average particle diameter: 0.35 μm; resistivity: $2.0\times10^{7}$ Ω·cm). The subsequent procedure of Magnetic Carrier Production Example 8 was repeated to prepare a magnetic resin carrier (24) having been surface-coated with the γ-(2-aminoethyl) aminopropyltrimethoxysilane and silicone resin.

Physical properties of the magnetic resin carrier (24) are shown in Table 4.

Magnetic Carrier

Production Example 25

Magnetic carrier cores (I) were prepared in the same manner as in Magnetic Carrier Production Example 8 except that the fine magnetite particles were replaced with magnetic 280 parts by weight of fine Mn—Mg ferrite particles having been surface-treated with γ-glycidoxypropyltrimethoxysilane (number-average particle diameter: 0.42 μm; resistivity: $6.0\times10^7$ Ω·cm). The subsequent procedure of Magnetic Carrier Production Example 8 was repeated to prepare a magnetic resin carrier (25) having been surface-coated with the γ-(2-aminoethyl) aminopropyltrimethoxysilane and silicone resin.

Physical properties of the magnetic resin carrier (25) are shown in Table 4.

Magnetic Carrier

Production Example 26

Magnetic carrier cores (J) were prepared in the same manner as in Magnetic Carrier Production Example 8 except that the fine magnetite particles were replaced with 280 parts by weight of fine nickel particles having been surface-treated with γ-glycidoxypropyltrimethoxysilane (number-average particle diameter: 0.47 μm; resistivity: $2.5\times10^6$ Ω·cm). The subsequent procedure of Magnetic Carrier Production Example 8 was repeated to prepare a magnetic resin carrier (26) having been surface-coated with the γ-(2-aminoethyl)aminopropyltrimethoxysilane and silicone resin.

Physical properties of the magnetic resin carrier (26 ) are shown in Table 4.

Magnetic Carrier

Production Example 27

Magnetic carrier cores (K) were prepared in the same manner as in Magnetic Carrier Production Example 8 except that the fine α-$Fe_2O_3$ particles were replaced with 120 parts by weight of fine alumina particles having been surface-treated with γ-glycidoxypropyltrimethoxysilane (number-average particle diameter: 0.37 μm; resistivity: $2\times10^{10}$ Ω·cm). The subsequent procedure of Magnetic Carrier Production Example 8 was repeated to prepare a magnetic resin carrier (27) having been surface-coated with the γ-(2-aminoethyl)aminopropyltrimethoxysilane and silicone resin.

Physical properties of the magnetic resin carrier (27) are shown in Table 4.

Magnetic Carrier
Production Example 28

| | (by weight) |
|---|---|
| Styrene | 50 parts |
| 2-Ethylhexyl acrylate | 12 parts |

Fine magnetite particles surface-treated with γ-glycidoxypropyltrimethoxysilane coupling agent (number-average particle diameter: 0.24 μm; resistivity: $5\times10^5$ Ω·cm) 280 parts Fine α-$Fe_2O_3$ particles surface-treated with γ-glycidoxypropyltrimethoxysilane (number-average particle diameter: 0.60 μm; resistivity: $8\times10^9$ Ω·cm) 120 parts The above materials were mixed and thereafter heated to 70° C., followed by addition of 0.7 part by weight of azobisisobutyronitrile to prepare a monomer composition. The monomer composition was dispersed in an aqueous 1% by weight polyvinyl alcohol solution to carry out granulation by means of a homogenizer at 4,500 rpm for 10 minutes. Thereafter, polymerization was carried out at 70° C. for 10 hours with stirring by using paddles, and then the product was filtered out of the aqueous polyvinyl alcohol solution, followed by washing and then drying to obtain magnetic carrier cores (L).

Using the magnetic carrier cores (L), the subsequent procedure of Magnetic Carrier Production Example 8 was repeated to prepare a magnetic resin carrier (28) having been surface-coated with the γ-(2-aminoethyl) aminopropyltrimethoxysilane and silicone resin.

Physical properties of the magnetic resin carrier (28) are shown in Table 4.

Magnetic Carrier

Production Example 29

50 parts of a styrene-butyl acrylate copolymer cross-linked with divinyl benzene (copolymerization weight ratio=83:17:0.5; weigh-average molecular weight; 350,000), 280 parts by weight of the same fine magnetite particles having been surface-treated with γ-glycidoxypropyltrimethoxysilane and 120 parts by weight of the same fine α-$Fe_2O_3$ particles having been surface-treated with γ-glycidoxypropyltrimethoxysilane as those used in Magnetic Carrier Production Example 8 were melt-kneaded at a temperature of 135° C. The kneaded product obtained was cooled and thereafter pulverized. The pulverized product obtained was classified to form magnetic carrier cores (M).

Using the magnetic carrier cores (M), the subsequent procedure of Magnetic Carrier Production Example 8 was repeated to prepare a magnetic resin carrier (29) having been surface-coated with the γ-(2-aminoethyl) aminopropyltrimethoxysilane and silicone resin.

Physical properties of the magnetic resin carrier (29) are shown in Table 4.

Magnetic Carrier

Production Example 30

In Magnetic Carrier Production Example 8, the magnetic carrier cores (B) was first surface-treated with a toluene solution of 5% by weight of γ-(2-aminoethyl) aminopropyltrimethoxysilane. The surface of the carrier cores (B) were found to have been coated with 0.1% by weight of the γ-(2-aminoethyl) aminopropyltrimethoxysilane. Thereafter, the carrier cores were treated with a toluene solution containing silicone resin KR255 in an amount of 18% by weight as solid content. The surface of the carrier cores (B) were found to have been coated with 0.6% by weight of the silicone resin. Using this carrier cores, a magnetic resin carrier (30) was prepared.

Physical properties of the magnetic resin carrier (30) are shown in Table 4.

Materials of the carriers according to the respective Magnetic Carrier Production Examples are summarized in Table 5.

Toner Production Example 12

Into 710 parts of ion-exchanged water, 450 parts of an aqueous 0.1 mol/liter $Na_3PO_4$ solution was introduced, and the mixture obtained was heated to 62° C., followed by stirring at 1,300 rpm using TK-type homomixer (manufactured by Tokushu Kika Kogyo). Then, 68 parts of an aqueous 1.0 mol/liter $CaCl_2$ solution was slowly added thereto to obtain an aqueous medium containing $Ca_3(PO_4)_2$.

| | (by weight) |
|---|---|
| Styrene | 160 parts |
| n-Butyl acrylate | 34 parts |
| Copper phthalocyanine pigment | 12 parts |
| Di-tert-butylsalicylic acid aluminum compound | 2 parts |
| Saturated polyester (acid value: 12 mg KOH/g; peak molecular weight: 8,500) | 10 parts |
| Monoester wax (Mw: 510; Mn: 410; Mw/Mn: 1.24; melting point: 69° C.; viscosity: 6.5 mPa•s; Vickers hardness: 1.1; SP value: 8.6) | 20 parts |

The above materials were heated to 62° C., and then dispersed using a TK-type homomixer (manufactured by Tokushu Kika Rogyo) at 12,000 rpm. To the dispersion obtained, 10 parts by weight of a polymerization initiator 2,2'-azobis(2,4-dimethylvaleronitrile) was dissolved to prepare a polymerizable monomer composition. This polymerizable monomer composition was introduced into the above aqueous medium, and then stirred at 10,000 rpm for 10 minutes by means of a Kurea mixer (manufactured by Emu Technique K.K.) at 60° C. in an atmosphere of $N_2$ to granulate the polymerizable monomer composition. Thereafter, polymerization was carried out for 10 hours while stirring the aqueous medium by using paddle stirring blades, at a temperature raised to 80° C. and while maintaining pH at 6.

After the polymerization was completed, the reaction mixture was cooled, and hydrochloric acid was added so as to adjust its pH to 1 to dissolve the calcium phosphate, followed by filtration, water washing, and then drying to obtain polymerization particles (cyan toner particles).

The polymerization particles thus obtained contained 8.3 parts by weight of the monoester wax per 100 parts by weight of the binder resin. Also, the cross-section observation of the polymerization particles by the use of a transmission electron microscope (TEM) confirmed that the particles had a core/shell structure wherein the wax was encapsulated with the shell resin layer.

The binder resin of the polymerization particles obtained also had an SP value of 20 and Tg of 62° C.

To 100 parts by weight of the polymerization particles (cyan toner particles) obtained, the following three types of external additives were added externally. After the external addition, coarse particles were removed with a sieve with an opening of 43 μm (330 meshes) to obtain a negatively chargeable, toner No. 12.

Physical properties of the toner No. 12 thus obtained are shown in Table 6.

(1) First hydrophobic fine silica powder, 0.2 part by weight:
BET specific surface area: 300 $m^2/g$
Number-average particle diameter: 7 nm
Hydrophobic-treated in gaseous phase, with 20 parts by weight of hexamethyldisilazane based on 100 parts by weight of the fine silica powder.

(2) Second hydrophobic fine silica powder, 0.7 part by weight:
BET specific surface area: 50 $m^2/g$
Number-average particle diameter: 30 nm
Hydrophobic-treated in gaseous phase, with 10 parts by weight of hexamethyldisilazane based on 100 parts by weight of the fine silica powder.

(3) Hydrophobic fine titanium oxide powder, 0.5 part by weight:
BET specific surface area: 100 $m^2/g$
Number-average particle diameter: 45 nm
Hydrophobic-treated in aqueous medium, with 10 parts by weight of isobutyltrimethoxysilane based on 100 parts by weight of the fine titanium oxide powder.

Toner Production Example 13

Polymerization particles (cyan toner particles) were prepared in the same manner as in Toner Production Example 12 except that an aqueous medium containing the $Ca_3(PO_4)_2$ in a larger quantity than that in Toner Production Example 12 and the number of revolution of the Kurea mixer was changed to 15,000 rpm. External additives were externally added in the same manner as in Toner Production Example 12 to prepare a negatively chargeable, toner No. 13. The toner No. 13 had a weight-average particle diameter of 2.8 μm Physical properties of the toner No. 13 thus obtained are shown in Table 6.

Toner Production Example 14

Polymerization particles (cyan toner particles) were prepared in the same manner as in Toner Production Example 12 except that an aqueous medium containing the $Ca_3(PO_4)_2$ in a smaller quantity than that in Toner Production Example 12 and the number of revolution of the Kurea mixer was changed to 6,000 rpm. External additives were externally added in the same manner as in Toner Production Example 12 to prepare a negatively chargeable, toner No 14. The toner No. 14 had a weight-average particle diameter of 10.1 μm Physical properties of the toner No. 14 thus obtained are shown in Table 6.

Toner Production Example 15

To the same polymerization particles (cyan toner particles) as those obtained in Toner Production Example 12, the following external additive was added to prepare a negatively chargeable, toner No. 15.

Physical properties of the toner No. 15 thus obtained are shown in Table 6.

Hydrophobic fine titanium oxide powder, 1.4 parts by weight:
BET specific surface area: 100 $m^2/g$
Number-average particle diameter: 45 nm
Hydrophobic-treated with 6 parts by weight of isobutyltrimetboxysilene based on 100 parts by weight of the fine titanium oxide powder.

Toner Production Example 16

To the same polymerization particles (cyan toner particles) as those obtained in Toner Production Example 12, the following external additives were added to prepare a negatively chargeable, toner No. 16.

Physical properties of the toner No. 16 thus obtained are shown in Table 6.

(1) Hydrophilic fine silica powder, 0.2 part by weight:
BET specific surface area: 200 $m^2/g$
Number-average particle diameter: 12 nm (2) Hydrophilic fine silica powder, 0.7 part by weight:
BET specific surface area: 50 $m^2/g$
Number-average particle diameter: 30 nm (3) Hydrophobic fine titanium oxide powder, 0.5 parts by weight:

BET specific surface area: 100 $m^2/g$
Number-average particle diameter: 45 nm
Hydrophobic-treated with 10 parts by weight of isobutyltrimethoxysilane based on 100 parts by weight of the fine titanium oxide powder.

| Toner Production Example 17 | |
|---|---|
| Terephthalic acid | 15 mole % |
| Fumaric acid | 18 mole % |
| Trimellitic acid anhydride | 17 mole % |

Bisphenol-A derivative A of the formula;

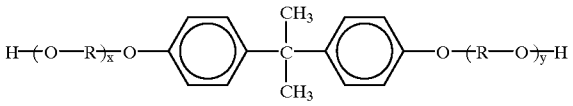

(R: propylene group; x+y=2.2) 30 mole %
Bisphenol-A derivative B of the formula:

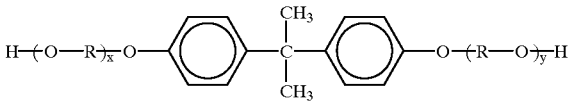

(R: ethylene group; x+y=2.2) 18 mole %
These were condensation-polymerized to obtain a polyester resin having Mn of 5,400, Mw of 42,000, Tg of 63° C., an acid value of 20 mg KOH/g and a hydroxyl value of 16 mg KOH/g.

| | (by weight) |
|---|---|
| Polyester resin obtained as above | 100 parts |
| Copper phthalocyanine pigment | 4 parts |
| Di-tert-butylsalicylic acid aluminum compound | 4.5 parts |

The above materials were thoroughly premixed using a Henschel mixer, and the mixture obtained was melt-kneaded using a twin-screw extrusion kneader. The kneaded product obtained was cooled and thereafter crushed into particles of about 1 to 2 mm diameter by means of a hammer mill, followed by pulverization with a fine-grinding mill of an air-jet system. The pulverized product thus obtained was further classified to obtain negatively triboelectrically chargeable cyan toner particles with a weight-average particle diameter of 6.8 $\mu$m.

To the cyan toner particles thus obtained, the same three types of external additives as those used in Toner Production Example 12 were added to prepare a negatively chargeable, toner No. 17.

Physical properties of the toner No. 17 thus obtained are shown in Table 6.

Toner Production Example 18

Magenta color polymerization particles (magenta toner particles) were obtained in the sate manner as in Toner Production Example 12 except that the copper phthalocyanine pigment was replaced with a quinacridone pigment. To the polymerization particles thus obtained, the three types of external additives were added in the same manner as in toner Production Example 12 to prepare a negatively chargeable, toner No. 18.

Physical properties of the toner No. 18 thus obtained are shown in Table 6.

Toner Production Example 19

Yellow color polymerization particles (yellow toner particles) were obtained in the same manner as in Toner Production Example 12 except that the copper phthalocyanine pigment was replaced with C.I. Pigment Yellow 93. To the polymerization particles thus obtained, the three types of external additives were added in the same manner as in Toner Production Example 12 to prepare a negatively chargeable, toner No. 19.

Physical properties of the toner No. 19 thus obtained are shown in Table 6.

Toner Production Example 20

Black color polymerization particles (black toner particles) were obtained in the same manner as in Toner Production Example 12 except that the copper phthalocyanine pigment was replaced with carbon black. To the polymerization particles thus obtained, the three types of external additives were added in the same manner as in Toner Production Example 12 to prepare a negatively chargeable, toner No. 20.

Physical properties of the toner No. 20 thus obtained are shown in Table 6.

Example 11

92 parts by weight of the magnetic resin carrier (8) and 8 parts by weight of the toner No. 12 were blended to prepare a two-component type developer No. 1. The quantity of triboelectricity of the two-component type developer No. 1 thus obtained were measured to obtain the results shown in Table 7.

This two-component type developer was put into the developing apparatus 104 shown in FIG. 1. A commercially available digital copying machine (GP30F, manufactured by CANON INC.; printing speed: 30 sheets/minute) was remodeled to mount the developing apparatus 104 shown in FIG. 1. As a development bias, a blank pulse as shown in FIG. 2 was used. As the magnetic particles 123 used in the magnetic brush charging assembly to charge the OPC (organic photoconductor) photosensitive drum electrostatically, the following was used.

(Preparation of Magnetic Particles)

5 parts by weight of MgO, 8 parts by weight of MnO, 4 parts by weight of $SrO_4$ and 83 parts by weight of $Fe_2O_3$ were each made into fine particles, followed by addition of water to carry out granulation. Thereafter, the particles obtained were fired at 1,350° C., and their particle size was adjusted. Thus, ferrite magnetic particles having an average particle diameter of 26 $\mu$m ($\sigma_{1,000}$: 60 $Am^2/kg$; coercive force: 4.46 kA/m (56 Oe)).

Then, 100 parts by weight of the magnetic particles were subjected to surface treatment with a mixture prepared by mixing 10 parts by weight of isopropoxytriisostearoyl titanate in a mixed solvent of 99 parts by weight of hexane and 1 part by weight of water, so as to be in a treatment quantity of 0.1 part by weight. Thus, magnetic particles were obtained.

The magnetic particles thus obtained had a volume resistivity of $3\times10^7$ Ω·cm and a weight loss on heating of 0.1 part by weight.

In the charging assembly, the sleeve 122 was rotated at a peripheral speed of 120% in the reverse direction with respect to the peripheral speed of the photosensitive drum 101, and DC/AC electric fields (−700 V, 1 kHz/1.2 kVpp) were superimposingly applied to charge the photosensitive drum 101 electrostatically. Development contrast was set at 200 V, and reverse contrast to fog at −150 V.

In the heat-and-pressure fixing assembly, a roller coated with PFA resin in a layer thickness of 1.2 μm was used as the heat roller, and a roller coated with PFA resin in a layer thickness of 1.2 μm was also used as the pressure roller. The oil applying mechanism was detached from the heat-and-pressure fixing assembly to perform oil-free (oil-less) fixing.

To evaluate image reproduction, an original image having an image area percentage of 30% was digital-processed to form on the OPC photosensitive drum a digital latent image as an electrostatic image. The electrostatic image was developed by reverse development to form a cyan toner image.

An image reproduction was tested on 30,000 sheets in each environment of normal temperature/normal humidity (N/N; temperature: 23° C./humidity: 65%RH), normal temperature/low humidity (N/L; temperature: 23° C./humidity: 10%RH), low temperature/low humidity (L/L; temperature: 15° C./humidity; 10%RH) and high temperature/high humidity (H/H; temperature: 32.5° C./humidity: 85%RH).

Results of evaluated are shown in Tables 8 to 11.

Evaluation was made in the manner as described below.

Image Density

Image density was measured with Macbeth Densitometer RD918 type (manufactured by Macbeth Co.) fitted with an SPI filter, as a relative density of images formed on plain paper.

Carrier Adhesion

Solid white images were reproduced, and the part between the developing zone and the cleaning zone on the photosensitive drum was sampled by making a transparent pressure-sensitive adhesive tape adhere closely thereto. The number of magnetic resin carrier particles having adhered to the photosensitive drum surface at its area of 5 cm×5 cm was counted and the number of carrier particles having adhered per 1 $cm^2$ was calculated.

A: Less than 5 particles.
B: More than 5 particles to less than 10 particles.
C: More than 10 particles to less than 20 particles.
D: More than 20 particles.

Fog:

Average reflectance Dr (%) of plain paper before image reproduction was measured with a reflectometer REFLECTOMETER MODEL TC-6DS, manufactured by Tokyo Denshoku K.K. Meanwhile, a solid white image was reproduced on plain paper, and then reflectance Ds (%) of the solid white image was measured. Fog (%) was calculated from the following expression:

$$\text{Fog}\ (\%)=Dr\ (\%)=-Ds\ (\%).$$

A: Less than 0.4%.
B: More than 0.4% to less than 0.8%.
C: More than 0.8% to less than 1.2%.
D: More than 1.2% to less than 1.8%.
E: More than 1.8%.

Evaluation on toner scatter:

Whether or not in-machine toner scattering occurred was examined after 20,000-sheet copying was tested, to make evaluation according to the following criteria.

A: No scattering at all.
B: Scattering slightly occurs, but on the level of no problem in practical use.
C: Toner having in-machine scattered is present in a large quantity, but on the level of little affecting images.
D: Scattering fairly occurs to contaminate images, and is on the level problematic In practical use.
E: Scattering occurs seriously.

Carrier contamination (degree of spent):

The surfaces of magnetic carriers in the developing assembly were observed with a scanning electron microscope (SEM) after 20,000-sheet copying was tested, to make evaluation according to the following criteria.

A: No contamination at all.
B: Contamination slightly occurs, but on the level of no problem in practical use.
C: Toner contaminating the carrier is present thereon in a large quantity, but on the level of little affecting images.
D: Contamination fairly occurs to affect images, and is on the level problematic in practical use.
E: Contamination occurs seriously.

Evaluation on spots around line images:

A line image of 1 mm wide was copied in each environment to make evaluation according to the following criteria.

A: No spots around line images at all.
B: Spots around line images slightly occurs, but on the level of no problem in practical use.
C: Spots around line images fairly occurs to affect images, and are on the level problematic in practical use.
E: Spots around line images occurs seriously, and images deteriorate greatly.

Examples 12 to 26

Two-component type developers Nos. 2 to 16 were prepared in the same manner as in Example 11 except for using the magnetic resin carriers 10, 16, 17 and 19 to 30, respectively, as the magnetic resin carrier. Quantity of triboelectricity was measured and image reproduction was tested in the same manner as in Example 11. Results obtained are shown in Tables 7 to

Comparative Examples 6 to 12

Comparative two-component type developers Nos. 1 to 7 were prepared in the same manner as in Example 11 except for using the comparative magnetic resin carriers 9, 11 to 15 and 18, respectively, as the magnetic resin carrier. Quantity of triboelectricity was measured and image reproduction was tested in the same manner as in Example 11. Results obtained are shown in Tables 7 to 11.

Examples 27 to 31

Two-component type developers Nos. 17 to 21 were prepared using the magnetic resin carrier (8) in the same manner as in Example 11 except for using the toners Nos. 13 to 17, respectively, as the toner. Quantity of triboelectricity was measured and image reproduction was tested in the same manner as in Example 11. Results obtained are shown in Tables 7 to 11.

Example 32

Two-component type developers Nos. 22 to 24 were prepared using the magnetic resin carrier (8) in the same manner as in Example 11 except for using the toners Nos. 18 to 20, respectively, as the toner. Quantity of triboelectricity was measured in the same manner as in Example 11. Results obtained are shown in Table 7.

The two-component type developers Nos. 22 to 24 were put into the respective developing assemblies of the full-color image forming apparatus shown in FIG. 3, and image reproduction was tested in the full-color mode. As a result, good full-color images were obtained, also showing good many-sheet running performance and good environmental stability.

| Magnetic Carrier Production Example 31 | (by weight) |
|---|---|
| Phenol (hydroxybenzene) | 50 parts |
| Aqueous 37% by weight formalin solution | 80 parts |
| Water | 50 parts |

Fine magnetite particles containing alumina surface-treated with silane type coupling agent having amino group, KBM602(available from Shin-Etsu Chemical Co., Ltd-) (number-average particle diameter: 0.24 $\mu$m; resistivity: $5\times10^5$ $\Omega\cdot$cm) 280 parts Fine $\alpha$-$Fe_2O_3$ particles surface-treated with silane coupling agent having amino group, KBM602 (available from Shin-Etsu Chemical Co., Ltd.) (number-average particle diameter: 0.40 $\mu$m; resistivity: $8\times10^9$ $\Omega\cdot$cm)

| | |
|---|---|
| | 120 parts |
| Aqueous 25% by weight ammonia | 15 parts |

The above materials were put into a four-necked flask. Temperature was raised to 85° C. in 60 minutes while mixing with stirring, and kept at that temperature. Reaction was carried out for 120 minutes to effect curing. Thereafter, the reaction mixture was cooled to 30° C., and 500 parts by weight of water was added thereto. Then, the supernatant formed was removed, and the precipitate was washed with water, followed by air drying. Subsequently, the air-dried product was further dried at 150 to 180° C. for 24 hours under reduced pressure [(667 Pa (5 mmHg)] to obtain magnetic carrier cores (N) having phenolic resin as a binder resin. On the magnetic carrier cores (N), 0.4% by weight of adsorbed water was present after leaving at 30° C./80%RH for 24 hours.

The surfaces of the magnetic carrier cores (N) thus obtained were treated with a solution prepared by diluting silicone resin having an epoxy group, ES1001N (available from Shin-Etsu Chemical Co., Ltd.), in a concentration of 20% as solid content; being treated while adding it under reduced pressure. During the treatment, the toluene was evaporated while treating the cores and while applying a shear stress continuously to the magnetic carrier cores (N).

Subsequently, after stirring for 2 hours, heat treatment was made at 140° C. for 2 hours in an atmosphere of nitrogen gas. After agglomeration was broken up, coarse particles were removed with a sieve of an opening of 54 $\mu$m (200 meshes) to obtain a magnetic resin carrier 31.

The magnetic resin carrier 31 thus obtained had SF-1 of 107, a weight-average particle diameter of 35 $\mu$m, an electrical resistivity of $5\times10^{14}$ $\Omega\cdot$cm, a magnetization intensity ($\sigma_{1,000}$) of 42 $Am^2/kg$ and a residual magnetization ($\sigma r$) of 3.1 $Am^2/kg$ at 79.6 kA/m (1 kOe), a true specific gravity of 3.65, and a bulk density of 1.90 $g/cm^3$.

Magnetic Carrier

Production Example 32

Magnetic resin carrier 32 was obtained in the same manner as in Magnetic Carrier Production Example 31 except that ES1001N was replaced with a silicone resin having no epoxy group, KR221 (available from Shin-Etsu Chemical Co., Ltd.).

Physical properties of the comparative magnetic resin carrier 32 are shown in Table 12.

Magnetic Carrier

Production Example 33

Magnetic resin carrier 33 was obtained in the same manner as in Magnetic Carrier Production Example 31 except that KBM602 was not used as the surface treating agent of the inorganic compound particles.

Physical properties of the comparative magnetic resin carrier 33 are shown in Table 12.

Magnetic Carrier

Production Example 34

Magnetic resin carrier 34 was obtained in the same manner as in Magnetic Carrier Production Example 31 except that, in place of ES1001N, the carrier cores were treated with, as a coating resin, an acryl-modified silicone resin containing carboxyl groups.

Physical properties of the comparative magnetic resin carrier 34 are shown in Table 12.

| Magnetic Carrier Production Example 35 | (by weight) |
|---|---|
| Styrene-methyl methacrylate resin | 100 parts |
| Fine magnetite particles used in Magnetic Carrier Production Example 31 | 100 parts |

The above materials were thoroughly premixed using a Henschel mixer, and the mixture obtained was melt-kneaded using a twin-screw extrusion kneader. The kneaded product obtained was cooled and thereafter crushed into particles of about 1 to 2 mm diameter by means of a hammer mill, followed by pulverization with a fine-grinding mill of an air-jet system. The pulverized product thus obtained was further classified, followed by treatment with ES1001N to obtain a magnetic resin carrier 35 having a weight-average particle diameter of 35 $\mu$m, SF-1 of 148, an electrical resistivity of $3\times10^{13}$ $\Omega\cdot$cm, $\sigma_{1,000}$ of 36 $Am^2/kg$, a residual magnetization of 2.8 $Am^2/kg$, a true specific gravity of 3.63 and a bulk density of 1.65 $g/cm^3$.

| Magnetic Carrier Production Example 36 | (by weight) |
|---|---|
| Styrene | 50 parts |
| Methyl methacrylate | 12 parts |
| Finer magnetite particles used in Magnetic Carrier Production Example 31 | 280 parts |
| Fine $\alpha$-$Fe_2O_3$ particles as used in Magnetic Carrier Production Example 31 | 120 parts |

The above materials were mixed and thereafter heated to 70° C., followed by addition of 1 part by weight of divinylbenzene and 0.7 part by weight of azobisisobutyronitrile to prepare a monomer composition. The monomer composition was dispersed in an aqueous 1% by weight polyvinyl alcohol solution to carry out granulation by means of a homogenizer at 4,500 rpm for 10 minutes. Thereafter, polymerization was carried out at 70° C. for 10 hours with stirring by using paddles, and then the product was filtered out of the aqueous polyvinyl alcohol solution, followed by washing, drying, and then treatment with ES1001N to obtain a magnetic resin carrier 36 having physical properties as shown in Table 12.

Magnetic Carrier

Production Example 37

Magnetic resin carrier 37 having physical properties as shown in Table 12 was obtained in the same manner as in Magnetic Carrier Production Example 31 except that the alumina-containing fine magnetite particles used therein were replaced with magnetite particles containing no alumina.

Toner Production Example 21

Into 710 parts of ion-exchanged water, 450 parts of an aqueous 0.1 mol/liter $Na_3PO_4$ solution was introduced, and the mixture obtained was heated to 60° C., followed by stirring at 1,300 rpm. using TK-type homomixer (manufactured by Tokushu Kika Kogyo). Then, 68 parts of an aqueous 1.0 mol/liter $CaCl_2$ solution was slowly added thereto to obtain an aqueous medium with pH at 6 containing $Ca_3(PO_4)_2$.

| | (by weight) |
|---|---|
| Styrene | 160 parts |
| n-Butyl acrylate | 34 parts |
| Carbon black | 16 parts |
| Di-tert-butylsalicylic acid aluminum compound | 2 parts |
| Saturated polyester (acid value: 10 mg KOH/g; peak molecular weight: 8,500) | 10 parts |
| Monoester wax (Mw: 500; Mn: 400; Mw/Mn: 1.25; melting point: 69° C.; viscosity: 6.5 mPa · s; Vickers hardness: 1.1; SP value: 8.6) | 20 parts |

The above materials were heated to 60° C., and then dispersed using a TK-type homomixer (manufactured by Tokushu Kika Kogyo) at 12,000 rpm. To the dispersion obtained, 10 parts by weight of a polymerization initiator 2,2'-azobis(2,4-dimethylvaleronitrile) was dissolved to prepare a polymerizable monomer composition. This polymerizable monomer composition was introduced into the above aqueous medium, and then stirred at 10,000 rpm. for 10 minutes by means of a Kurea mixer (manufactured by Emu Technique K.K.) at 60° C. in an atmosphere of $N_2$ to granulate the polymerizable monomer composition. Thereafter, polymerization was carried out for 10 hours while stirring the aqueous medium by using paddle stirring blades, at a temperature raised to 80° C. and while maintaining pH at 6.

After the polymerization was completed, the reaction mixture was cooled, and hydrochloric acid was added so as to adjust its pH to 2 to dissolve the calcium phosphate, followed by filtration water washing, and then drying to obtain polymerization particles (toner particles).

The polymerization particles thus obtained contained 8.4 parts by weight of the monoester wax per 100 parts by weight of the binder resin. Also, the cross-section observation of the polymerization particles by the use of a transmission electron microscope (TEM) confirmed that the particles had a core/shell structure wherein the wax was encapsulated with the shell resin layer.

The binder resin of the polymerization particles obtained also had an SP value of 19 and Tg of 60° C.

To 100 parts by weight of the polymerization particles (toner particles) obtained, the following three types of external additives were added externally. After the external addition, coarse particles were removed with a sieve with an opening of 43 μm (330 meshes) to obtain a negatively chargeable, toner No. 21. The toner No. 21 had a weight-average particle diameter of 7.4 μm and SF-1 of 108. Also, in this toner, the cumulative value of distribution of diameter ½-time or less the number-average particle diameter was 10.6% by number. The cumulative value of distribution of diameter twice or more the weight-average particle diameter was 1.9% by volume.

Physical properties of the toner thus obtained are shown in Table 13.

(1) First hydrophobic fine silica powder, 0.3 part by weight:
BET specific surface area: 170 $m^2/g$
Number-average particle diameter: 12 nm
Hydrophobic-treated in gaseous phase, with 20 parts by weight of hexamethyldisilazane based on 100 parts by weight of the fine silica powder.

(2) Second hydrophobic fine silica powder, 0.7 part by weight:
BET specific surface area: 70 $m^2/g$
Number-average particle diameter: 30 nm
Hydrophobic-treated in gaseous phase, with 10 parts by weight of hexamethyldisilazane based on 100 parts by weight of the fine silica powder.

(3) Hydrophobic fine titanium oxide powder, 0.4 part by weight:
BET specific surface area: 100 $m^2/g$
Number-average particle diameter: 45 nm
Hydrophobic-treated in aqueous medium, with 10 parts by weight of isobutyltrimethoxysilane based on 100 parts by weight of the fine titanium oxide powder.

Toner Production Example 22

Polymerization particles (toner particles) were prepared in the same manner as in Toner Production Example 21 except that an aqueous medium containing the $Ca_3(PO_4)_2$ in a larger quantity than that in Toner Production Example 21 and the number of revolution of the Kurea mixer was changed to 15,000 rpm. External additives were externally added in the same manner as in Toner Production Example 21 to prepare a negatively chargeable, toner No. 22. The toner No. 22 had a weight-average particle diameter of 2.9 μm and SF-1 of 115.

Toner Production Example 23

Polymerization particles (toner particles) were prepared in the same manner as in Toner Production Example 21 except that an aqueous medium containing the $Ca_3(PO_4)_2$ in a smaller quantity than that in Toner Production Example 21 and the number of revolution of the Kurea mixer was changed to 6,000 rpm. External additives were externally added in the same manner as in Toner Production Example 21 to prepare a negatively chargeable, toner No. 23. The toner No. 23 had a weight-average particle diameter of 10.3 μm and SF-1 of 108.

Toner Production Example 24

To the same polymerization particles (toner particles) as those obtained in Toner Production Example 21, any external additive was not added to prepare a negatively chargeable, toner No. 24. The toner No. 24 thus obtained had a weight-average particle diameter of 7.4 μm and SF-1 of 108.

Toner Production Example 25

To the same polymerization particles (toner particles) as those obtained in Toner Production Example 21, the following external additives were added to prepare a negatively chargeable, toner No. 25. The toner No. 25 thus obtained had a weight-average particle diameter of 7.5 μm and SF-1 of 108.

(1) Hydrophilic fine silica powder, 0.2 part by weight:
BET specific surface area: 200 $m^2/g$
Number-average particle diameter: 12 nm (2) Hydrophilic fine silica powder, 0.8 part by weight:
BET specific surface area: 50 $m^2/g$
Number-average particle diameter: 30 nm (3) Hydrophobic fine titanium oxide powder, 0.4 parts by weight:
BET specific surface area: 100 $m^2/g$
Number-average particle diameter: 45 nm
Hydrophobic-treated with 10 parts by weight of isobutyltrimethoxysilane based on 100 parts by weight of the fine titanium oxide powder.

Toner Production Example 26

| | (by weight) |
|---|---|
| Polyester resin comprised of terephthalic acid/fumaric acid/trimellitic acid anhydride/derivative of bisphenol A | 100 parts |
| Carbon black | 4 parts |
| Di-tert-butylsalicylic acid aluminum compound | 4 parts |

The above materials were thoroughly premixed using a Henschel mixer, and the mixture obtained was melt-kneaded using a twin-screw extrusion kneader. The kneaded product obtained was cooled and thereafter crushed into particles of about 1 to 2 mm diameter by means of a hammer mill, followed by pulverization with a fine-grinding mill of an air-jet system. The pulverized product thus obtained was further classified to obtain negatively triboelectrically chargeable black toner particles with a weight-average particle diameter of 6.8 μm.

To the black toner particles thus obtained, the same three types of external additives as those used in Toner Production Example 21 were added to prepare a negatively chargeable, toner No. 26. The toner No. 26 had a weight-average particle diameter of 7.1 μm and SF-1 of 143.

Toner Production Example 27

Magenta color polymerization particles (magenta toner particles) were obtained in the same manner as in Toner Production Example 21 except that the carbon black was replaced with a quinacridone pigment. To the polymerization particles thus obtained, the three types of external additives were added in the same manner as in Toner Production Example 21 to prepare a negatively chargeable, toner No 27. The toner No. 27 had a weight-average particle diameter of 7.3 μm and SF-1 of 108.

Toner Production Example 28

Yellow color polymerization particles (yellow toner particles) were obtained in the same manner as in Toner Production Example 21 except that the carbon black was replaced with C.I. Pigment Yellow 93. To the polymerization particles thus obtained, the three types of external additives were added in the same manner as in Toner Production Example 21 to prepare a negatively chargeable, toner No. 28. The toner No. 28 had a weight-average particle diameter of 7.2 μm and SF-1 of 109.

Toner Production Example 29

Cyan color polymerization particles (cyan toner particles) were obtained in the same manner as in Toner Production Example 21 except that the carbon black was replaced with copper phthalocyanine. To the polymerization particles thus obtained, the three types of external additives were added in the same manner as in Toner Production Example 21 to prepare a negatively chargeable, toner No. 29. The toner No. 29 had a weight-average particle diameter of 7.4 μm and SF-1 of 107.

Toner Production Example 30

Toner No. 30 was prepared in the same manner as in Toner Production Example 26 except that the aluminum compound of di-tert-butylsalicylic acid was not used. The toner No. 30 had a weight-average particle diameter of 7.1 μm and SF-1 of 143.

Toner Production Example 31

Toner No. 31 was prepared in the same manner as in Toner Production Example 21 except that the hydrophobic silica powders (1) and (2) were not used. The toner No. 31 had a weight-average particle diameter of 7.3 μm and SF-1 of 108.

Example 32

Using a V-type mixing machine, 92 parts by weight of the magnetic resin carrier 31 and 8 parts by weight of the toner No. 21 were so blended as to be in a toner concentration of 8%. Thus, a two-component type developer was produced.

Using this two-component type developer, a running test was made. As an image forming apparatus, a commercially available digital copying machine GP55 (manufactured by CANON INC.) was used which was so remodeled that the developing apparatus shown in FIG. 1 was mountable, where a development bias as shown in FIG. 2 was applied and the fixing assembly was so remodeled that both the heat roller and the pressure roller were replaced with rollers whose surface layers were coated with PFA in a thickness of 1.2 μm and the oil applying mechanism was removed. A 10,000-sheet running test was made in each environment of 23° C./60%RH (N/N: normal temperature/normal humidity), 23° C./5%RH (N/L: normal temperature/low humidity) and 32.5° C./90%RH (H/H: high temperature/high humidity), using an original having an image area percentage of 25%. Evaluation was made according to the same evaluation methods as those described previously in Example 1.

Results obtained are shown in Table 14. As can be seen from Table 14, good results were obtained.

Comparative Example 13

The procedure of Example 32 was repeated except that the carrier was replaced with the magnetic resin carrier 32. As a result, as shown in Table 14, inferior results were obtained with regard to image density decrease and fog. This is presumed to be due to a non-uniform state of coating due to the absence of functional groups in the carrier core coating resin and also due to a insufficient adhesion strength of the coating resin, which caused faulty charging of the toner.

Comparative Example 14

The procedure of Example 32 was repeated except that the carrier was replaced with the magnetic resin carrier 33. As a result, as shown in Table 14, inferior results were obtained with regard to fog during the running. This is presumed to be due to the fact that the surface treating agent of the core material of the magnetic resin carrier had no reactive functional groups and hence did not achieve a sufficient adhesion to the core material to have come off the core material.

Comparative Example 15

The procedure of Example 32 was repeated except that the toner was replaced with the toner No. 22. As a result, as shown in Table 14, the image density was low from the beginning and also inferior results were obtained with regard to the fog. Accordingly, the evaluation was stopped.

Comparative Example 16

The procedure of Example 32 was repeated except that the toner was replaced with the toner No 23. As a result, as shown in Table 14, inferior results were obtained with regard to the fog and the spots around line images.

Comparative Example 17

The procedure of Example 32 was repeated except that the toner was replaced with the toner No. 24. As a result, as shown in Table 14, the image density was low and also inferior results were obtained with regard to the fog. Accordingly, the evaluation was stopped.

Example 33

The procedure of Example 32 was repeated except that the toner was replaced with the toner No. 25. As a result, as shown in Table 14, in H/H the image density was so high as to be slightly inferior to those of Example 32 with regard to the fog and the spots around line images, which, however, were on the level of no problem in practical use. This is presumed to be due to the external additive silica fine powder not hydrophobic-treated, which caused a decrease in environmental stability.

Example 34

The procedure of Example 32 was repeated except that the toner was replaced with the toner No. 26. As a result, as shown in Table 14, results slightly inferior to those of Example 32 were obtained with regard to both the image density and the fog, which, however, were on the level of no problem in practical use. This is presumed to be due to a low sphericity of toner shape, which made the charging of toner slightly non-uniform.

Example 35

Images were reproduced in the same manner as in Example 32 except that, as the image forming apparatus, GP55 was replaced with a modified machine of a commercially available full-color copying machine CLC2400 (manufactured by CANON INC.) and four color toners Nos. 21, 27, 28 and 29 were used. As a result, good results were obtained.

Example 36

The procedure of Example 32 was repeated except that the toner was replaced with the toner No. 30. As a result, as shown in Table 14, in H/H, results inferior to those of Example 32 were obtained with regard to the spots around line images and the fog, which, however, were on the level anyhow tolerable in practical use. This is presumed to be due to the use of no charge control agent, which caused a decrease in the electric charge of toner in H/H.

Example 37

The procedure of Example 32 was repeated except that the toner was replaced with the toner No. 31. As a result, as shown in Table 14, results inferior to those of Example 32 were obtained with regard to the fog and the spots around line images, which, however, were on the level tolerable in practical use. This is presumed to be due to the external additive used in a smaller quantity, which resulted in a low blending performance for the toner and the carrier.

Example 38

The procedure of Example 32 was repeated except that the carrier was replaced with the magnetic resin carrier 34. As a result, as shown in Table 14, good results were obtained like those in Example 32.

Example 39

The procedure of Example 32 was repeated except that the carrier was replaced with the magnetic resin carrier 35. As a result, as shown in Table 14, results inferior to those of Example 32 were obtained with regard to the carrier adhesion and the fog, which, however, were on the level of no problem in practical use. This is presumed to be due to the carrier which was not spherical since it was not produced by polymerization.

Example 40

The procedure of Example 32 was repeated except that the carrier was replaced with the magnetic resin carrier 36. As a result, as shown in Table 14, results inferior to those of Example 32 were obtained with regard to the carrier adhesion during running and the fog, which, however, were on the level of no problem. This is presumed to be due to the magnetic resin carrier the binder resin of which was not the thermosetting phenolic resin, so that its durability to solvent at the time of resin coating was probably not sufficient to have made the resin coating uniformity insufficient, resulting in a non-uniform electric charge.

Example 41

The procedure of Example 32 was repeated except that the carrier was replaced with the magnetic resin carrier 37. As a result, good results were obtained as shown in Table 14, though the fog increased slightly in H/H. This is presumed to be due to the magnetite particles containing no alumina, which brought about slightly a low surface activity to make the treatment with coupling agent less effective.

TABLE 1

| | Inorganic compound agent's functional group | Core treating coupling agent's functional group | Coating resin | Additive coupling agent's functional group | SF-1 | Weight = average particle diameter (μm) | Resistivity (Ω · cm) | $\sigma_{1,000}$ --(Am²/kg)-- | σr | True specific gravity (g/cm³) | Bulk density |
|---|---|---|---|---|---|---|---|---|---|---|---|
| Magnetic resin carrier: | | | | | | | | | | | |
| 1 | Epoxy g. | Amino g. | Silicone | Amino g. | 107 | 35 | $7 \times 10^{13}$ | 42 | 3.1 | 3.71 | 1.87 |
| 2 | Epoxy g. | Amino g. | None | None | 107 | 35 | $4 \times 10^{13}$ | 42 | 3.1 | 3.72 | 1.89 |
| 3 | None | Amino g. | None | None | 116 | 37 | $6 \times 10^{11}$ | 42 | 3.2 | 3.72 | 1.82 |
| 4 | Epoxy g. | None | None | None | 107 | 35 | $9 \times 10^{12}$ | 42 | 3.2 | 3.72 | 1.88 |
| 5 | Epoxy g. | Amino g. | None | None | 148 | 35 | $3 \times 10^{13}$ | 36 | 2.8 | 3.63 | 1.65 |
| 6 | Epoxy g. | Amino g. | None | None | 115 | 34 | $9 \times 10^{13}$ | 42 | 3.1 | 3.69 | 1.84 |
| 7 | Epoxy g. | Amino g. | None | None | 107 | 34 | $2 \times 10^{13}$ | 42 | 3.1 | 3.70 | 1.88 |

TABLE 2

| | Weight = average particle diameter (μm) | SF-1 | Cumulative value of distribution of diameter ½ time or less the number = average particle diameter (% by number) | Cumulative value of distribution of diameter twice or more the weight = average particle diameter (% by volume) |
|---|---|---|---|---|
| Toner No.1 | 7.3 | 108 | 10.3 | 1.8 |
| Toner No.2 | 2.8 | 112 | 58.3 | 13.5 |
| Toner No.3 | 10.1 | 107 | 10.5 | 3.1 |
| Toner No.4 | 7.4 | 108 | 9.8 | 1.9 |
| Toner No.5 | 7.5 | 108 | 10.1 | 1.8 |
| Toner No.6 | 6.8 | 142 | 19.3 | 8.8 |

TABLE 2-continued

| | Weight = average particle diameter (μm) | SF-1 | Cumulative value of distribution of diameter ½ time or less the number = average particle diameter (% by number) | Cumulative value of distribution of diameter twice or more the weight = average particle diameter (% by volume) |
|---|---|---|---|---|
| Toner No.7 | 7.3 | 108 | 11.4 | 2.0 |
| Toner No.8 | 7.2 | 109 | 10.8 | 1.9 |
| Toner No.9 | 7.4 | 108 | 8.9 | 1.6 |
| Toner No.10 | 7 | 141 | 19.0 | 8.5 |
| Toner No.11 | 7.3 | 108 | 10.2 | 1.8 |

TABLE 3

| | | | Image density | | | | | | Spots around line images | | | | | |
|---|---|---|---|---|---|---|---|---|---|---|---|---|---|---|
| | | Toner | Initial | | | 10,000 sh. | | | Initial | | | 10,000 sh | | |
| | Carrier | No. | NN | HL | HH | NN | NL | HH | NN | NL | HH | NN | NL | HH |
| Example: | | | | | | | | | | | | | | |
| 1 | 1 | 1 | 1.5 | 1.5 | 1.53 | 1.48 | 1.5 | 1.52 | A | A | A | A | A | A |
| 2 | 2 | 1 | 1.48 | 1.5 | 1.51 | 1.43 | 1.4 | 1.54 | A | A | A | A | A | A |
| Comparative Example: | | | | | | | | | | | | | | |
| 1 | 3 | 1 | 1.5 | 1.4 | 1.58 | 1.38 | 1.34 | 1.67 | B | B | B | B | C | C |
| 2 | 4 | 1 | 1.5 | 1.5 | 1.50 | 1.41 | 1.4 | 1.65 | B | B | B | C | C | C |
| 3 | 2 | 2 | 0.9 | 0.9 | 1.12 | X* | X* | X* | B | C | B | X* | X* | X* |
| 4 | 2 | 3 | 1.5 | 1.4 | 1.55 | 1.43 | 1.5 | 1.65 | C | B | C | C | C | D |
| 5 | 2 | 4 | 1.2 | 1.1 | 1.23 | X* | X* | X* | C | C | C | X* | X* | X* |
| Example: | | | | | | | | | | | | | | |
| 3 | 2 | 5 | 1.5 | 1.4 | 1.55 | 1.40 | 1.4 | 1.62 | A | A | A | A | A | B |
| 4 | 2 | 6 | 1.5 | 1.4 | 1.47 | 1.40 | 1.4 | 1.53 | B | B | B | B | B | C |
| 6 | 2 | 10 | 1.5 | 1.4 | 1.60 | 1.42 | 1.3 | 1.52 | B | B | C | B | C | C |
| 7 | 2 | 11 | 1.5 | 1.5 | 1.53 | 1.39 | 1.4 | 1.55 | A | A | A | B | C | B |
| 8 | 5 | 1 | 1.5 | 1.4 | 1.52 | 1.53 | 1.3 | 1.55 | B | B | B | B | B | C |
| 9 | 6 | 1 | 1.6 | 1.5 | 1.60 | 1.48 | 1.4 | 1.63 | A | A | A | B | B | B |
| 10 | 7 | 1 | 1.5 | 1.48 | 1.52 | 1.48 | 1.4 | 1.61 | A | A | A | A | A | A |

| | | | Carrier adhesion | | | | | | Fog | | | | | |
|---|---|---|---|---|---|---|---|---|---|---|---|---|---|---|
| | | Toner | Initial | | | 10,000 sh | | | Initial | | | 10,000 sh | | |
| | Carrier | No. | NN | NL | HH | NN | NL | HH | NN | NL | HH | NN | NL | HH |

TABLE 3-continued

| | | | | | | | | | | | | | | |
|---|---|---|---|---|---|---|---|---|---|---|---|---|---|---|
| Example: | | | | | | | | | | | | | | |
| 1 | 1 | 1 | A | A | A | A | A | A | A | A | A | A | A | A |
| 2 | 2 | 1 | A | A | A | A | A | A | A | A | A | A | B | A |
| Comparative Example: | | | | | | | | | | | | | | |
| 1 | 3 | 1 | A | B | B | B | C | C | B | B | C | C | C | D |
| 2 | 4 | 1 | B | B | B | C | D | D | B | C | B | C | D | C |
| 3 | 2 | 2 | A | A | B | X* | X* | X* | C | C | D | X* | X* | X* |
| 4 | 2 | 3 | B | B | B | B | C | C | B | B | B | B | C | D |
| 5 | 2 | 4 | C | C | C | X* | X* | X* | C | D | C | X* | X* | X* |
| Example: | | | | | | | | | | | | | | |
| 3 | 2 | 5 | A | A | A | A | A | A | C | B | B | B | B | C |
| 4 | 2 | 6 | A | A | A | A | B | B | B | B | B | B | C | C |
| 6 | 2 | 10 | A | A | A | A | B | B | B | B | C | C | C | C |
| 7 | 2 | 11 | A | A | A | A | B | A | B | B | B | B | C | C |
| 8 | 5 | 1 | B | B | B | C | C | C | B | B | B | B | C | C |
| 9 | 6 | 1 | A | A | A | A | B | B | A | A | B | B | B | B |
| 10 | 7 | 1 | A | A | A | A | A | B | A | A | A | A | B | B |

X*: Stopped

TABLE 4

| | True specific gravity | $\sigma_{1,000}$ ($Am^2/kg$) | $\sigma r$ ($Am^2/kg$) | Resistivity ($\Omega \cdot cm$) | Bulk density ($g/cm^3$) | Shape factor SF-1 | Weight-average particle diameter ($\mu m$) |
|---|---|---|---|---|---|---|---|
| Magnetic resin carrier: | | | | | | | |
| 8 | 3.75 | 43 | 3.2 | $7.4 \times 10^{13}$ | 1.85 | 107 | 34 |
| 9* | 3.61 | 42 | 3.2 | $4.3 \times 10^{13}$ | 1.76 | 112 | 34 |
| 10 | 3.57 | 42 | 3.2 | $2.9 \times 10^{13}$ | 1.74 | 114 | 34 |
| 11* | 3.67 | 42 | 3.2 | $5.6 \times 10^{13}$ | 1.78 | 111 | 34 |
| 12* | 3.58 | 42 | 3.2 | $9.0 \times 10^{13}$ | 1.81 | 114 | 35 |
| 13* | 3.72 | 41 | 3.1 | $1.4 \times 10^{14}$ | 1.93 | 107 | 35 |
| 14* | 4.91 | 64 | 0 | $8.7 \times 10^{8}$ | 2.74 | 144 | 36 |
| 15* | 5.01 | 69 | 0 | $9.3 \times 10^{9}$ | 2.85 | 155 | 35 |
| 16 | 3.69 | 57 | 2.8 | $1.1 \times 10^{9}$ | 1.83 | 108 | 35 |
| 17 | 3.73 | 35 | 3.4 | $7.1 \times 10^{15}$ | 1.88 | 107 | 34 |
| 18* | 3.75 | 43 | 3.2 | $7.2 \times 10^{13}$ | 1.88 | 107 | 34 |
| 19 | 3.83 | 58 | 2.7 | $4.8 \times 10^{12}$ | 1.84 | 107 | 34 |
| 20 | 3.96 | 62 | 2.2 | $4.1 \times 10^{13}$ | 1.92 | 108 | 33 |
| 21 | 3.72 | 25 | 2.5 | $9.9 \times 10^{11}$ | 1.75 | 109 | 34 |
| 22 | 3.67 | 18 | 3.4 | $1.4 \times 10^{14}$ | 1.73 | 109 | 34 |
| 23 | 3.67 | 15 | 3.6 | $2.5 \times 10^{14}$ | 1.71 | 111 | 35 |
| 24 | 3.72 | 41 | 3.5 | $9.1 \times 10^{12}$ | 1.78 | 107 | 34 |
| 25 | 3.81 | 44 | 3.1 | $9.6 \times 10^{12}$ | 1.82 | 107 | 35 |
| 26 | 3.63 | 37 | 3.6 | $3.5 \times 10^{12}$ | 1.68 | 114 | 31 |
| 27 | 3.68 | 41 | 3.2 | $4.4 \times 10^{14}$ | 1.84 | 108 | 34 |
| 28 | 3.72 | 43 | 3.2 | $2.0 \times 10^{13}$ | 1.84 | 108 | 32 |
| 29 | 3.74 | 43 | 3.2 | $2.0 \times 10^{14}$ | 1.85 | 112 | 29 |
| 30 | 3.68 | 41 | 3.1 | $4.1 \times 10^{13}$ | 1.78 | 108 | 30 |

*Comparative magnetic resin carrier

55

TABLE 5

| | Magnetic particle treating agent | Magnetic particles | Binder resin | Coating resin | Coupling agent |
|---|---|---|---|---|---|
| Magnetic resin carrier: | | | | | |
| 8 | γ-glycidoxyPTMS | Magnetite | Phenolic resin | Silicone resin | γ-(2-AE)APTMS |
| 9* | γ-glycidoxyPTMS | Magnetite | Phenolic resin | Silicone resin | — |
| 10 | γ-glycidoxyPTMS | Magnetite | Phenolic resin | PTFE | γ-(2-AE)APTMS |

TABLE 5-continued

| | Magnetic particle treating agent | Magnetic particles | Binder resin | Coating resin | Coupling agent |
|---|---|---|---|---|---|
| 11* | γ-glycidoxyPTMS | Magnetite | Phenolic resin | PRFE | — |
| 12* | — | Magnetite | Phenolic resin | Silicone resin | γ-(2-AE)APTMS |
| 13* | VinyltriMS | Magnetite | Phenolic resin | Silicone resin | γ-(2-AE)APTMS |
| 14* | — | — | — | Silicone resin | γ-(2-AE)APTMS |
| 15* | — | — | — | Silicone resin | γ-(2-AE)APTMS |
| 16 | γ-glycidoxyPTMS | Magnetite | Phenolic resin | Silicone resin | γ-(2-AE)APTMS |
| 17 | γ-glycidoxyPTMS | Magnetite | Phenolic resin | Silicone resin | γ-(2-AE)APTMS |
| 18* | γ-glycidoxyPTMS | Magnetite | Phenolic resin | Silicone resin | MMS |
| 19 | γ-glycidoxyPTMS | Magnetite | Phenolic resin | Silicone resin | γ-(2-AE)APTMS |
| 20 | γ-glycidoxyPTMS | Magnetite | Phenolic resin | Silicone resin | γ-(2-AE)APTMS |
| 21 | γ-glycidoxyPTMS | Magnetite | Phenolic resin | Silicone resin | γ-(2-AE)APTMS |
| 22 | γ-glycidoxyPTMS | Magnetite | Phenolic resin | Silicone resin | γ-(2-AE)APTMS |
| 23 | γ-glycidoxyPTMS | Magnetite | Phenolic resin | Silicone resin | γ-(2-AE)APTMS |
| 24 | γ-glycidoxyPTMS | Magnetite | Phenolic resin | Silicone resin | γ-(2-AE)APTMS |
| 25 | γ-glycidoxyPTMS | Mn—Mg ferrite | Phenolic resin | Silicone resin | γ-(2-AE)APTMS |
| 26 | γ-glycidoxyPTMS | Nickel | Phenolic resin | Silicone resin | γ-(2-AE)APTMS |
| 27 | γ-glycidoxyPTMS | Alumina | Phenolic resin | Silicone resin | γ-(2-AE)APTMS |
| 28 | γ-glycidoxyPTMS | Magnetite | St-acryl resin | Silicone resin | γ-(2-AE)APTMS |
| 29 | γ-glycidoxyPTMS | Magnetite | St-acryl resin | Silicone resin | γ-(2-AE)APTMS |
| 30 | γ-glycidoxyPTMS | Magnetite | Phenolic resin | Silicone resin | γ-(2-AE)APTMS |

*Comparative magnetic resin carrier
PTMS: propyltrimethoxysilane
PTFE: Polytetrafluroethylene
St-acryl: styrene acrylic
MMS: Methyltrimethoxysilane
(2-AE)APTMS: (2-aminoethyl)aminopropyltrimethoxysilane

TABLE 6

| | Weight = average particle diameter (μm) | Shape factor SF-1 | Shape factor SF-2 | External additive (part(s) by weight) BET 200 $m^2/g$ silica | BET 50 $m^2/g$ silica | BET 100 $m^2/g$ titanium oxide |
|---|---|---|---|---|---|---|
| Toner No.12 | 7.3 | 106 | 103 | Hydrophobic (0.2) | Hydrophobic (0.7) | Hydrophobic (0.5) |
| Toner No.13 | 3.3 | 111 | 109 | Hydrophobic (0.2) | Hydrophobic (0.7) | Hydrophobic (0.5) |
| Toner No.14 | 8.9 | 109 | 105 | Hydrophobic (0.2) | Hydrophobic (0.7) | Hydrophobic (0.5) |
| Toner No.15 | 7.3 | 106 | 103 | — | — | Hydrophobic (1.4) |
| Toner No.16 | 7.3 | 106 | 103 | Hydrophilic (0.2) | Hydrophilic (0.7) | Hydrophobic (0.5) |
| Toner No.17 | 6.7 | 156 | 144 | Hydrophobic (0.2) | Hydrophobic (0.7) | Hydrophobic (0.5) |
| Toner No.18 | 7.2 | 107 | 104 | Hydrophobic (0.2) | Hydrophobic (0.7) | Hydrophobic (0.5) |
| Toner No.19 | 7.3 | 106 | 104 | Hydrophobic (0.2) | Hydrophobic (0.7) | Hydrophobic (0.5) |
| Toner No.20 | 7.2 | 10B | 105 | Hydrophobic (0.2) | Hydrophobic (0.7) | Hydrophobic (0.5) |

TABLE 7

Cp: Comparative

| | Toner No. | Carrier No. | Quantity of triboelectricity N/N environment(μC/g) | L/L environment(μC/g) | H/H environment(μC/g) |
|---|---|---|---|---|---|
| Two-component developer: | | | | | |
| No.1 | 12 | (8) | −28.5 | −34.2. | −23.6 |
| No.2 | 12 | (10) | −23.6 | −30.5 | −17.3 |
| No.3 | 12 | (16) | −24.4 | −27.7 | −14.8 |
| No.4 | 12 | (17) | −29.6 | −33.7 | −25.7 |
| No.5 | 12 | (19) | −26.4 | −32.6 | −22.4 |

TABLE 7-continued

Cp: Comparative

| | Toner No. | Carrier No. | Quantity of triboelectricity N/N environment(μC/g) | L/L environment(μC/g) | H/H environment(μC/g) |
|---|---|---|---|---|---|
| No.6 | 12 | (20) | −25.7 | −31.5 | −21.3 |
| No.7 | 12 | (21) | −30.1 | −34.6 | −24.7 |
| No.8 | 12 | (22) | −31.1 | −35.3 | −25.7 |
| No.9 | 12 | (23) | −31.8 | −37.5 | −25.9 |
| No.10 | 12 | (24) | −27.6 | −32.4 | −21.8 |
| No.11 | 12 | (25) | −26.9 | −33.4 | −21.6 |
| No.12 | 12 | (26) | −25.8 | −33.7 | −21.7 |
| No.13 | 12 | (27) | −24.9 | −30.7 | −19.7 |
| No.14 | 12 | (28) | −29.7 | −35.2 | −23.9 |
| No.15 | 12 | (29) | −30.2 | −37.4 | −20.4 |
| No.16 | 12 | (30) | −30.4 | −36.9 | −19.7 |
| No.17 | 13 | (8) | −30.6 | −46.7 | −18.6 |
| No.18 | 14 | (8) | −24.2 | −30.6 | −14.3 |
| No.19 | 15 | (8) | −20.1 | −25.3 | −10.2 |
| No.20 | 16 | (8) | −27.4 | −31.6 | −8.9 |
| No.21 | 17 | (8) | −31.4 | −37.6 | −17.5 |
| No.22 | 18 | (8) | −26.3 | −34.2 | −21.8 |
| No.23 | 19 | (8) | −30.7 | −36.9 | −21.7 |
| No.24 | 20 | (8) | −25.6 | −32.7 | −21.2 |
| Cp.No.1 | 12 | (9) | −15.6 | −24.2 | −6.9 |
| Cp.No.2 | 12 | (11) | −22.6 | −25.2 | −17.4 |
| Cp.No.3 | 12 | (12) | −28.5 | −34.4 | −19.4 |
| Cp.No.4 | 12 | (13) | −31.6 | −39.2 | −20.1 |
| Cp.No.5 | 12 | (14) | −25.4 | −33.8 | −19.8 |
| Cp.No.6 | 12 | (15) | −26.6 | −31.6 | −22.7 |
| Cp.No.7 | 12 | (18) | −12.8 | −21.7 | −6.2 |

TABLE 8

(Normal Temperature/Normal Humidity)

| | Image density | | Carrier adhesion | | Fog | | Toner scatter | | Carrier contami. | | Line spots | | Charge quantity of toner on developing sleeve | |
|---|---|---|---|---|---|---|---|---|---|---|---|---|---|---|
| | (I) | (II) | (I) | (II) | (I) | (II) | (I) | (II) | (I) | (II) | (I) | (II) | (I)(μC/g) | (II)(μC/g) |
| Example: | | | | | | | | | | | | | | |
| 11 | 1.47 | 1.48 | A | A | A | A | A | A | A | A | A | A | −27.8 | −27.5 |
| 12 | 1.42 | 1.39 | A | A | A | B | A | A | A | A | A | A | −21.6 | −18.7 |
| 13 | 1.50 | 1.51 | B | B | B | B | A | B | A | A | A | B | −23.8 | −23.7 |
| 14 | 1.39 | 1.32 | B | B | A | B | A | B | A | B | B | B | −29.0 | −31.9 |
| 15 | 1.46 | 1.48 | A | A | A | A | B | B | B | B | A | A | −26.4 | −25.3 |
| 16 | 1.47 | 1.50 | B | A | A | A | B | B | B | B | A | A | −25.8 | −24.6 |
| 17 | 1.46 | 1.48 | A | A | B | B | A | A | B | B | B | A | −29.3 | −30.6 |
| 18 | 1.47 | 1.45 | B | B | B | B | A | A | B | B | B | B | −29.7 | −30.9 |
| 19 | 1.45 | 1.46 | B | B | B | B | A | A | B | B | B | B | −30.4 | −31.9 |
| 20 | 1.46 | 1.47 | A | A | A | A | A | A | A | A | A | A | −27.5 | −31.5 |
| 21 | 1.47 | 1.49 | A | A | A | A | A | A | A | A | A | A | −24.9 | −26.8 |
| 22 | 1.45 | 1.47 | A | A | A | A | A | B | A | A | A | A | −24.4 | −25.9 |
| 23 | 1.46 | 1.47 | A | A | B | B | A | A | A | B | A | B | −23.5 | −25.3 |
| 24 | 1.46 | 1.45 | A | A | A | A | A | A | B | B | A | B | −27.9 | −30.4 |
| 25 | 1.47 | 1.51 | A | A | A | B | A | A | A | B | A | B | −27.8 | −23.7 |
| 26 | 1.48 | 1.52 | A | A | A | B | A | A | A | B | A | B | −29.8 | −30.9 |
| 27 | 1.41 | 1.43 | A | A | B | B | B | B | B | B | A | A | −29.8 | −32.7 |
| 28 | 1.50 | 1.50 | A | A | A | A | A | A | B | B | B | B | −21.6 | −24.1 |
| 29 | 1.51 | 1.50 | A | A | B | B | B | B | B | B | B | B | −20.8 | −19.9 |
| 30 | 1.48 | 1.51 | A | A | A | A | A | B | A | A | A | A | −25.8 | −25.7 |
| 31 | 1.47 | 1.51 | A | A | A | B | A | B | A | A | A | A | −29.9 | −28.6 |
| Comparative Example: | | | | | | | | | | | | | | |
| 6 | 1.39 | 1.34 | A | A | B | C | B | D | A | D | B | C | −14.3 | −10.5 |

TABLE 8-continued (Normal Temperature/Normal Humidity)

| | Image density | | Carrier adhesion | | Fog | | Toner scatter | | Carrier contami. | | Line spots | | Charge quantity of toner on developing sleeve | |
|---|---|---|---|---|---|---|---|---|---|---|---|---|---|---|
| | (I) | (II) | (I) | (II) | (I) | (II) | (I) | (II) | (I) | (II) | (I) | (II) | (I)(μC/g) | (II)(μC/g) |
| 7 | 1.24 | 1.27 | A | A | B | C | B | C | A | C | C | D | −20.8 | −16.2 |
| 8 | 1.42 | 1.38 | A | A | B | B | B | C | C | D | B | C | −27.4 | −26.9 |
| 9 | 1.47 | 1.46 | A | A | B | C | A | A | C | D | B | C | −30.5 | −29.2 |
| 10 | 1.47 | 1.30 | B | A | A | C | A | B | A | C | A | B | −24.7 | −20.3 |
| 11 | 1.48 | 1.29 | B | A | B | C | A | B | A | D | A | B | −24.9 | −19.7 |
| 12 | 1.39 | 1.38 | A | A | A | B | B | C | A | A | A | A | −12.8 | −10.5 |

(I): Initial stage;
(II): 20,000 sheets

TABLE 9

(Normal Temperature/Low Humidity)

| | Image density | | Carrier adhesion | | Fog | | Toner scatter | | Carrier contami. | | Line spots | | Charge quantity of toner on developing sleeve | |
|---|---|---|---|---|---|---|---|---|---|---|---|---|---|---|
| | (I) | (II) | (I) | (II) | (I) | (II) | (I) | (II) | (I) | (II) | (I) | (II) | (I) (μC/g) | (II) (μC/g) |
| Example: | | | | | | | | | | | | | | |
| 11 | 1.46 | 1.45 | A | A | A | A | A | A | A | A | A | A | −32.7 | −32.8 |
| 12 | 1.35 | 1.30 | A | B | B | B | A | B | A | B | B | C | −28.8 | −25.5 |
| 13 | 1.50 | 1.52 | B | C | A | A | B | B | A | B | A | A | −27.4 | −27.8 |
| 14 | 1.33 | 1.28 | B | C | B | B | A | B | B | B | B | B | −33.3 | −35.8 |
| 15 | 1.47 | 1.46 | A | A | A | B | A | A | A | B | A | A | −31.0 | −31.8 |
| 16 | 1.46 | 1.45 | B | A | B | B | A | A | A | B | A | A | −30.6 | −31.6 |
| 17 | 1.45 | 1.44 | A | A | B | C | A | A | A | B | A | A | −33.7 | −35.7 |
| 18 | 1.43 | 1.41 | B | B | C | D | A | A | B | C | B | A | −34.8 | −36.9 |
| 19 | 1.37 | 1.39 | B | B | D | D | A | A | B | C | B | A | −35.9 | −38.9 |
| 20 | 1.45 | 1.44 | A | A | A | A | A | A | A | A | A | A | −29.2 | −31.7 |
| 21 | 1.46 | 1.45 | A | A | A | A | A | A | A | A | A | A | −27.1 | −29.9 |
| 22 | 1.46 | 1.45 | A | A | A | A | A | A | A | A | A | A | −26.5 | −28.8 |
| 23 | 1.46 | 1.44 | A | A | B | B | A | A | B | B | A | B | −30.1 | −33.5 |
| 24 | 1.47 | 1.45 | A | A | B | C | A | A | B | C | A | B | −30.5 | −36.7 |
| 25 | 1.46 | 1.45 | A | A | B | C | A | A | A | C | A | B | −32.5 | −35.9 |
| 26 | 1.46 | 1.50 | A | A | B | C | A | A | A | B | A | B | −34.1 | −37.9 |
| 27 | 1.34 | 1.33 | A | A | C | C | A | A | A | A | B | B | −37.7 | −39.4 |
| 28 | 1.50 | 1.48 | A | A | A | A | A | A | A | A | C | C | −23.4 | −20.7 |
| 29 | 1.49 | 1.47 | A | A | B | A | A | B | A | A | B | B | −25.9 | −24.8 |
| 30 | 1.50 | 1.47 | A | A | A | A | A | B | A | A | A | B | −30.6 | −32.7 |
| 31 | 1.49 | 1.48 | A | A | B | C | A | A | A | A | A | A | −36.9 | −38.9 |
| Comparative Example: | | | | | | | | | | | | | | |
| 6 | 1.44 | 1.48 | A | A | B | B | A | C | A | E | B | C | −24.4 | −19.4 |
| 7 | 1.36 | 1.39 | A | A | B | B | A | B | A | C | C | D | −23.4 | −18.6 |
| 8 | 1.48 | 1.47 | A | A | B | B | A | B | C | E | B | C | −34.7 | −38.3 |
| 9 | 1.50 | 1.48 | A | A | B | C | A | A | C | E | B | C | −37.3 | −39.6 |
| 10 | 1.48 | 1.37 | B | A | A | C | A | B | B | D | A | B | −31.7 | −35.4 |
| 11 | 1.48 | 1.36 | B | A | B | C | A | B | B | D | A | B | −30.8 | −35.6 |
| 12 | 1.44 | 1.47 | A | A | A | A | A | B | A | A | A | A | −23.6 | −25.7 |

(I): Initial stage;
(II): 20,000 sheets

TABLE 10

(Low Temperature/Low Humidity)

| | Image density | | Carrier adhesion | | Fog | | Toner scatter | | Carrier contami. | | Line spots | | Charge quantity of toner on developing sleeve | |
|---|---|---|---|---|---|---|---|---|---|---|---|---|---|---|
| | (I) | (II) | (I) | (II) | (I) | (II) | (I) | (II) | (I) | (II) | (I) | (II) | (I) (μC/g) | (II) (μC/g) |
| Example: | | | | | | | | | | | | | | |
| 11 | 1.48 | 1.47 | A | A | A | A | A | A | A | A | A | A | −31.7 | −31.8 |
| 12 | 1.36 | 1.33 | A | B | B | B | A | B | A | B | B | C | −28.6 | −26.7 |
| 13 | 1.51 | 1.49 | B | C | A | A | B | B | A | B | A | A | −27.4 | −25.9 |
| 14 | 1.31 | 1.27 | B | C | B | B | A | B | B | C | B | C | −33.8 | −34.5 |
| 15 | 1.48 | 1.47 | A | A | A | B | A | A | A | A | A | A | −30.9 | −31.9 |
| 16 | 1.47 | 1.47 | B | A | B | B | A | A | A | A | A | A | −30.4 | −32.3 |
| 17 | 1.45 | 1.45 | A | A | B | C | A | A | A | A | A | A | −33.6 | −34.4 |
| 18 | 1.44 | 1.43 | B | B | C | D | A | A | B | C | B | A | −33.8 | −35.1 |
| 19 | 1.38 | 1.37 | B | B | D | D | A | A | B | C | B | A | −34.9 | −36.9 |
| 20 | 1.47 | 1.48 | A | A | A | A | A | A | A | A | A | A | −28.4 | −29.7 |
| 21 | 1.46 | 1.47 | A | A | A | A | A | A | A | A | A | A | −26.7 | −28.9 |
| 22 | 1.44 | 1.45 | A | A | A | A | A | A | A | A | A | A | −25.8 | −28.1 |
| 23 | 1.45 | 1.46 | A | A | B | B | A | A | B | B | A | B | −29.8 | −31.2 |
| 24 | 1.48 | 1.48 | A | A | B | C | A | A | B | C | A | B | −30.9 | −32.4 |
| 25 | 1.47 | 1.46 | A | A | B | C | A | A | A | C | A | B | −31.6 | −33.6 |
| 26 | 1.47 | 1.47 | A | A | B | C | A | A | A | B | A | B | −33.9 | −35.6 |
| 27 | 1.36 | 1.35 | A | A | B | C | A | A | A | A | B | B | −36.8 | −39.6 |
| 28 | 1.49 | 1.47 | A | A | A | A | A | A | A | A | C | C | −21.4 | −21.8 |
| 29 | 1.49 | 1.47 | A | A | B | A | A | B | A | A | B | B | −24.9 | −26.2 |
| 30 | 1.49 | 1.48 | A | A | A | A | A | B | A | A | A | B | −29.8 | −32.1 |
| 31 | 1.50 | 1.48 | A | A | B | C | A | A | A | A | A | A | −34.9 | −37.1 |
| Comparative Example: | | | | | | | | | | | | | | |
| 6 | 1.43 | 1.45 | A | A | B | B | A | C | A | E | B | C | −24.6 | −21.9 |
| 7 | 1.37 | 1.34 | A | A | B | B | A | B | A | C | C | D | −23.8 | −20.6 |
| 8 | 1.47 | 1.48 | A | A | B | B | A | B | C | E | B | C | −34.9 | −35.4 |
| 9 | 1.49 | 1.48 | A | A | B | C | A | A | C | E | B | C | −37.9 | −39.8 |
| 10 | 1.41 | 1.38 | B | A | A | C | A | B | B | D | A | B | −31.7 | −35.7 |
| 11 | 1.47 | 1.37 | B | A | B | C | A | B | B | D | A | B | −30.6 | −35.8 |
| 12 | 1.45 | 1.46 | A | A | A | A | A | B | A | A | A | A | −23.9 | −25.1 |

(I): Initial stage;
(II): 20,000 sheets

40

TABLE 11

(High Temperature/High Humidity)

| | Image density | | Carrier adhesion | | Fog | | Toner scatter | | Carrier contami. | | Line spots | | Charge quantity of toner on developing sleeve | |
|---|---|---|---|---|---|---|---|---|---|---|---|---|---|---|
| | (I) | (II) | (I) | (II) | (I) | (II) | (I) | (II) | (I) | (II) | (I) | (II) | (I) (μC/g) | (II) (μC/g) |
| Example: | | | | | | | | | | | | | | |
| 11 | 1.50 | 1.49 | A | A | A | A | A | A | A | A | A | A | −22.8 | −25.6 |
| 12 | 1.56 | 1.63 | A | A | B | C | B | C | A | B | B | C | −17.5 | −18.1 |
| 13 | 1.61 | 1.65 | B | C | B | C | B | C | A | B | B | C | −14.3 | −16.2 |
| 14 | 1.38 | 1.42 | A | A | B | C | A | A | B | C | B | C | −24.8 | −21.2 |
| 15 | 1.50 | 1.47 | A | A | A | B | A | B | A | A | A | A | −21.6 | −24.7 |
| 16 | 1.51 | 1.46 | B | A | A | A | A | B | A | A | A | A | −20.4 | −24.1 |
| 17 | 1.51 | 1.50 | A | A | A | A | A | A | A | A | A | A | −23.7 | −27.1 |
| 18 | 1.52 | 1.49 | B | B | A | A | A | A | B | C | B | A | −24.4 | −26.9 |
| 19 | 1.51 | 1.49 | B | B | C | C | A | A | B | C | B | A | −20.8 | −24.1 |
| 20 | 1.49 | 1.47 | A | A | A | A | A | A | A | A | A | A | −19.3 | −23.2 |
| 21 | 1.50 | 1.48 | A | A | A | A | A | A | A | A | A | A | −18.6 | −22.2 |
| 22 | 1.49 | 1.47 | A | A | A | A | A | A | A | A | A | A | −19.3 | −23.1 |
| 23 | 1.49 | 1.49 | A | A | B | B | A | A | B | C | A | B | −21.5 | −25.2 |
| 24 | 1.49 | 1.45 | A | A | B | B | A | A | B | C | A | B | −21.2 | −24.9 |
| 25 | 1.48 | 1.49 | A | A | B | B | A | A | A | C | A | B | −22.9 | −26.1 |

TABLE 11-continued (High Temperature/High Humidity)

| | Image density | | Carrier adhesion | | Fog | | Toner scatter | | Carrier contami. | | Line spots | | Charge quantity of toner on developing sleeve | |
|---|---|---|---|---|---|---|---|---|---|---|---|---|---|---|
| | (I) | (II) | (I) | (II) | (I) | (II) | (I) | (II) | (I) | (II) | (I) | (II) | (I) (μC/g) | (II) (μC/g) |
| 26 | 1.47 | 1.49 | A | A | B | B | A | A | A | B | A | B | −23.7 | −27.1 |
| 27 | 1.48 | 1.47 | A | A | B | B | B | C | A | A | B | B | −23.2 | −27.3 |
| 28 | 1.50 | 1.48 | A | A | A | A | A | A | A | A | C | C | −17.6 | −21.6 |
| 29 | 1.44 | 1.38 | A | A | B | A | B | C | A | A | B | B | −20.8 | −22.8 |
| 30 | 1.43 | 1.34 | A | A | A | A | B | C | A | A | A | B | −21.3 | −25.1 |
| 31 | 1.50 | 1.47 | A | A | B | B | A | A | A | A | A | A | −24.7 | −27.8 |
| Comparative Example: | | | | | | | | | | | | | | |
| 6 | 1.28 | 1.08 | A | A | B | C | B | D | A | D | B | C | −7.4 | −13.7 |
| 7 | 1.28 | 1.36 | A | A | B | C | B | C | A | C | C | D | −16.2 | −16.1 |
| 8 | 1.29 | 1.33 | A | A | B | B | B | C | C | D | B | C | −19.1 | −31.3 |
| 9 | 1.49 | 1.46 | A | A | B | C | A | A | C | D | B | C | −20.4 | −28.9 |
| 10 | 1.47 | 1.48 | B | A | A | C | A | B | A | C | A | B | −18.3 | −22.0 |
| 11 | 1.48 | 1.45 | B | A | B | C | A | B | A | D | A | B | −20.6 | −25.6 |
| 12 | 1.44 | 1.40 | A | A | A | B | B | C | A | A | A | A | −9.1 | −10.8 |

(I): Initial stage;
(II): 20,000 sheets

TABLE 12

| | Inorganic compound agent's functional group | Coating resin functional group | SF-1 | Weight = average particle diameter (μm) | Resistivity (Ω · cm) | $\sigma_{1,000}$ ($Am^2/kg$) | σr ($Am^2/kg$) | True specific gravity ($g/cm^3$) | Bulk density |
|---|---|---|---|---|---|---|---|---|---|
| Magnetic resin carrier: | | | | | | | | | |
| 31 | Amino group | Epoxy group | 107 | 35 | $5 \times 10^{14}$ | 42 | 3.1 | 3.65 | 1.90 |
| 32 | Amino group | None | 112 | 38 | $3 \times 10^{13}$ | 42 | 3.1 | 3.55 | 1.82 |
| 33 | None | Epoxy group | 108 | 37 | $1 \times 10^{13}$ | 41 | 3.0 | 3.66 | 1.87 |
| 34 | Amino group | Carboxyl g. | 108 | 36 | $9 \times 10^{13}$ | 42 | 3.1 | 3.74 | 1.89 |
| 35 | Amino group | Epoxy group | 146 | 38 | $3 \times 10^{12}$ | 36 | 2.8 | 3.63 | 1.64 |
| 36 | Amino group | Epoxy group | 114 | 35 | $7 \times 10^{13}$ | 42 | 3.1 | 3.68 | 1.82 |
| 37 | Amino group | Epoxy group | 110 | 36 | $5 \times 10^{13}$ | 42 | 3.1 | 3.63 | 1.88 |

TABLE 13

| | Weight = average particle diameter (μm) | SF-1 | Cumulative value of distribution of diameter ½ time or less the number = average particle diameter (% by number) | Cumulative value of distribution of diameter twice or more the weight = average particle diameter (% by volume) |
|---|---|---|---|---|
| Toner No.21 | 7.4 | 108 | 10.6 | 1.9 |
| Toner No.22 | 2.9 | 115 | 59.3 | 12.7 |
| Toner No.23 | 10.3 | 108 | 10.7 | 3.0 |
| Toner No.24 | 7.4 | 108 | 10.3 | 1.9 |
| Toner No.25 | 7.5 | 108 | 10.1 | 1.8 |
| Toner No.26 | 7.1 | 143 | 18.8 | 9.3 |

TABLE 13-continued

| | Weight = average particle diameter (μm) | SF-1 | Cumulative value of distribution of diameter ½ time or less the number = average particle diameter (% by number) | Cumulative value of distribution of diameter twice or more the weight = average particle diameter (% by volume) |
|---|---|---|---|---|
| Toner No.27 | 7.3 | 108 | 11.3 | 1.9 |
| Toner No.28 | 7.2 | 109 | 10.5 | 1.8 |
| Toner No.29 | 7.4 | 107 | 9.3 | 1.7 |
| Toner No.30 | 7.1 | 143 | 19.5 | 9.8 |
| Toner No.31 | 7.3 | 108 | 10.3 | 1.9 |

TABLE 14

| | | | Image density | | | | | | Spots around line images | | | | | |
|---|---|---|---|---|---|---|---|---|---|---|---|---|---|---|
| | | Toner | Initial | | | 10,000 sh. | | | Initial | | | 10,000 sh | | |
| | Carrier | No. | NN | HL | HH | NN | NL | HH | NN | NL | HH | NN | NL | HH |
| Example: | | | | | | | | | | | | | | |
| 32 | 31 | 21 | 1.5 | 1.5 | 1.5 | 1.48 | 1.5 | 1.5 | A | A | A | A | A | A |
| Comparative Example: | | | | | | | | | | | | | | |
| 13 | 32 | 21 | 1.5 | 1.4 | 1.6 | 1.38 | 1.32 | 1.7 | B | B | B | B | C | C |
| 14 | 33 | 21 | 1.5 | 1.4 | 1.6 | 1.42 | 1.3 | 1.7 | B | B | B | B | C | C |
| 15 | 31 | 22 | 1.0 | 0.9 | 1.0 | X* | X* | X* | B | B | B | X* | X* | X* |
| 16 | 31 | 23 | 1.6 | 1.5 | 1.7 | 1.53 | 1.5 | 1.8 | C | B | C | C | C | D |
| 17 | 31 | 24 | 1.2 | 1.1 | 1.2 | X* | X* | X* | C | D | C | X* | X* | X* |
| Example: | | | | | | | | | | | | | | |
| 33 | 31 | 25 | 1.5 | 1.5 | 1.6 | 1.43 | 1.4 | 1.7 | A | A | A | A | A | B |
| 34 | 31 | 26 | 1.5 | 1.4 | 1.5 | 1.40 | 1.3 | 1.6 | B | B | B | B | B | C |
| 36 | 31 | 30 | 1.5 | 1.4 | 1.6 | 1.41 | 1.3 | 1.6 | B | B | C | C | C | C |
| 37 | 31 | 31 | 1.5 | 1.4 | 1.5 | 1.45 | 1.4 | 1.5 | A | A | A | B | C | C |
| 38 | 34 | 21 | 1.5 | 1.5 | 1.5 | 1.39 | 1.4 | 1.6 | A | A | A | A | A | A |
| 39 | 35 | 21 | 1.5 | 1.4 | 1.53 | 1.51 | 1.4 | 1.5 | B | B | B | B | B | C |
| 40 | 36 | 21 | 1.5 | 1.5 | 1.60 | 1.47 | 1.4 | 1.7 | A | A | A | B | B | B |
| 41 | 37 | 21 | 1.5 | 1.45 | 1.52 | 1.48 | 1.4 | 1.6 | A | A | A | A | A | A |

| | | | Carrier adhesion | | | | | | Fog | | | | | |
|---|---|---|---|---|---|---|---|---|---|---|---|---|---|---|
| | | Tonner | Initial | | | 10,000 sh | | | Initial | | | 10,000 sh | | |
| | Carrier | No. | NN | NL | HH | NN | NL | HH | NN | NL | HH | NN | NL | HH |
| Example: | | | | | | | | | | | | | | |
| 32 | 31 | 21 | A | A | A | A | A | A | A | A | A | A | A | A |
| Comparative Example: | | | | | | | | | | | | | | |
| 13 | 32 | 21 | B | B | B | C | D | D | B | B | C | D | D | D |
| 14 | 33 | 21 | A | B | B | B | C | C | B | B | C | C | C | D |
| 15 | 31 | 22 | A | A | B | X* | X* | X* | C | D | D | X* | X* | X* |
| 16 | 31 | 23 | B | B | B | B | C | C | B | B | C | C | C | D |
| 17 | 31 | 24 | C | C | C | X* | X* | X* | C | D | C | X* | X* | X* |
| Example: | | | | | | | | | | | | | | |
| 33 | 31 | 25 | A | A | A | A | A | B | A | A | B | A | B | C |
| 34 | 31 | 26 | A | A | A | A | B | B | B | B | B | B | B | C |
| 36 | 31 | 30 | A | A | A | B | B | B | B | B | C | C | C | C |
| 37 | 31 | 31 | A | A | A | A | B | B | B | B | B | C | C | C |
| 38 | 34 | 21 | A | A | A | A | A | A | A | A | A | A | A | A |
| 39 | 35 | 21 | B | B | B | C | C | C | B | B | B | B | C | C |
| 40 | 36 | 21 | A | A | A | A | B | B | A | A | B | B | B | B |
| 41 | 37 | 21 | A | A | A | A | A | B | A | A | A | A | B | B |

X*: Stopped

What is claimed is:

1. A two-component type developer comprising a negatively chargeable toner having toner particles and an external additive and a magnetic-fine-particle-dispersed resin carrier;

wherein;

i) said magnetic-fine-particle-dispersed resin carrier comprises composite particles containing at least inorganic compound particles and a binder resin;

said inorganic compound particles having been surface-treated with a lipophilic-treating agent having at least one type of functional group (A) selected from the group consisting of an epoxy group, an amino group, a mercapto group, an organic acid group, an ester group, a ketone group, an alkyl halide group and an aldehyde group, or a mixture of the agent, and said composite particles having been surface-coated with at least one type of coupling agent having at least one type of functional group (B) different from the functional group (A) the lipophilic-treating agent has;

said functional group (B) the coupling agent has being a functional group or groups selected from the group consisting of an epoxy group, an amino group and a mercapto group; and ii) said negatively chargeable toner has a weight-average particle diameter of from 3 $\mu$m to 9 $\mu$m.

2. The developer according to claim 1, wherein said external additive has a number-average particle diameter of from 3 nm to 100 nm.

3. The developer according to claim 1, wherein said external additive has a BET specific surface area of from 30 $m^2/g$ to 400 $m^2/g$.

4. The developer according to claim 1, wherein said external additive has a BET specific surface area of from 50 $m^2/g$ to 400 $m^2/g$.

5. The developer according to claim 1, wherein said external additive is a fine powder of a metal compound or a composite of a metal compound.

6. The developer according to claim 1, wherein said external additive is a hydrophobic fine silica powder, a hydrophobic fine titanium oxide powder or a hydrophobic fine alumina powder.

7. The developer according to claim 1, wherein said external additive is externally added in an amount of from 0.1 to 10.0 parts by weight based on 100 parts by weight of said toner particles.

8. The developer according to claim 1, wherein said external additive is externally added in an amount of from 0.5 to 5.0 parts by weight based on 100 parts by weight of said toner particles.

9. The developer according to claim 1, wherein said negatively chargeable toner has a weight-average particle diameter of from 4.5 μm to 8.5 μm.

10. The developer according to claim 1, wherein in said negatively chargeable toner the cumulative value of distribution of diameter ½-time or less the number-average particle diameter is not more than 20% by number and the cumulative value of distribution of diameter twice or more the weight-average particle diameter is not more than 10% by volume.

11. The developer according to claim 1, wherein said negatively chargeable toner has a weight-average particle diameter of from 4.5 μm to 8.5 μm, and in said toner the cumulative value of distribution of diameter ½-time or less the number-average particle diameter is not more than 20% by number and the cumulative value of distribution of diameter twice or more the weight-average particle diameter is not more than 10% by volume.

12. The developer according to claim 1, wherein said negatively chargeable toner has a shape factor SF-1 of from 100 to 140.

13. The developer according to claim 1, wherein said negatively chargeable toner has a shape factor SF-1 of from 100 to 130.

14. The developer according to claim 1, wherein said negatively chargeable toner contains a wax in an amount of from 1 part by weight to 40 parts by weight based on 100 parts by weight of the binder resin.

15. The developer according to claim 1, wherein said negatively chargeable toner contains a solid wax in an amount of from 1 part by weight to 40 parts by weight based on 100 parts by weight of the binder resin.

16. The developer according to claim 1, wherein said negatively chargeable toner contains a wax having a ratio of weight-average molecular weight (Mw) to number-average molecular weight (Mn), Mw/Mn, of not more than 1.45.

17. The developer according to claim 1, wherein said negatively chargeable toner contains a wax having a ratio of weight-average molecular weight (Mw) to number-average molecular weight (Mn), Mw/Mn, of not more than 1.30.

18. The developer according to claim 1, wherein said negatively chargeable toner contains a metal compound of an aromatic hydroxycarboxylic acid.

19. The developer according to claim 1, wherein said toner particles are polymerization toner particles produced by a polymerization process.

20. The developer according to claim 1, wherein said lipophilic-treating agent with which said inorganic compound particles have been surface-treated is a lipophilic-treating agent having at least one type of functional group (A) selected from the group consisting of an epoxy group, an amino group and a mercapto group.

21. The developer according to claim 1, wherein said lipophilic-treating agent with which said inorganic compound particles have been surface-treated is a lipophilic-treating agent having at least an epoxy group.

22. The developer according to claim 1, wherein said lipophilic-treating agent is a coupling agent.

23. The developer according to claim 1, wherein said lipophilic-treating agent is a silane coupling agent, a titanium coupling agent or an aluminum coupling agent.

24. The developer according to claim 1, wherein said lipophilic-treating agent is a silane coupling agent.

25. The developer according to claim 1, wherein said inorganic compound particles have been treated with said lipophilic-treating agent in an amount of from 0.1% by weight to 5.0% by weight based on the weight of said inorganic compound particles.

26. The developer according to claim 1, wherein said binder resin is a thermosetting resin.

27. The developer according to claim 1, wherein said binder resin is a thermosetting resin containing at least a phenolic resin.

28. The developer according to claim 1, wherein said coupling agent with which said composite particles have been surface-coated is a silane coupling agent.

29. The developer according to claim 1, wherein said coupling agent with which said composite particles have been surface-coated is a silane coupling agent having at least an amino group.

30. The developer according to claim 1, wherein said coupling agent with which said composite particles have been surface-coated is in a coating weight of from 0.001% by weight to 5.0% by weight based on the weight of said composite particles.

31. The developer according to claim 1, wherein said composite particles have been further surface-coated with a resin.

32. The developer according to claim 1, wherein said composite particles have been further surface-coated with a silicone resin.

33. The developer according to claim 1, wherein said composite particles have been further surface-coated with a silicone resin containing a coupling agent.

34. The developer according to claim 1, wherein said composite particles have been further surface-coated with a silicone resin containing a coupling agent having an amino group.

35. The developer according to claim 1, wherein said composite particles have been further surface-coated with a resin in a coating weight of not less than 0.05% by weight based on the weight of said composite particles.

36. The developer according to claim 1, wherein said composite particles have been further surface-coated with a resin in a coating weight of from 0.1% by weight to 10% by weight based on the weight of said composite particles.

37. The developer according to claim 1, wherein said magnetic-fine-particle-dispersed resin carrier has a weight-average particle diameter of from 10 μm to 50 μm.

38. The developer according to claim 1, wherein said magnetic-fine-particle-dispersed resin carrier has a weight-average particle diameter of from 15 μm to 45 μm.

39. The developer according to claim 1, wherein said magnetic-fine-particle-dispersed resin carrier has a true specific gravity of from 2.5 to 4.5, a magnetization intensity $\sigma_{1,000}$ of from 15 $Am^2/kg$ to 60 $Am^2/kg$ (emu/g) and a residual magnetization σr of from 0.1 $Am^2/kg$ to 20 $Am^2/kg$ as measured under application of a magnetic field of 79.6 kA/m (1 kOe), and a resistivity of from $5\times10^{11}$ Ω·cm to $5\times10^{15}$ Ω·cm.

40. The developer according to claim 1, wherein said magnetic-fine-particle-dispersed resin carrier has a shape factor SF-1 of from 100 to 130.

41. The developer according to claim 1, wherein said magnetic-fine-particle-dispersed resin carrier has a shape factor SF-1 of from 100 to 120.

42. The developer according to claim 1, wherein said inorganic compound particles contain at least magnetic fine particles.

43. The developer according to claim 1, wherein said inorganic compound particles contain at least a magnetic iron compound.

44. The developer according to claim 1, wherein said inorganic compound particles contain at least a magnetic iron oxide compound.

45. The developer according to claim 44, wherein said magnetic iron oxide compound contains a different type of oxide or hydroxide, or both of them.

46. The developer according to claim 45, wherein said different type of oxide or hydroxide is an oxide or hydroxide of silicon or aluminum.

47. The developer according to claim 1, wherein said inorganic compound particles contain magnetic fine particles and non-magnetic inorganic compound particles.

48. The developer according to claim 47, wherein said magnetic fine particles have number-average particle diameter a and said non-magnetic inorganic compound particles have number-average particle diameter b which are a<b.

49. The developer according to claim 48, wherein said a is from 0.02 μm to 2 μm, said b is from 0.05 μm to 5 μm, and 1.5 a<b.

50. The developer according to claim 47, wherein said inorganic compound particles contain a magnetic iron compound and a non-magnetic iron oxide.

51. A two-component type developer comprising a negatively chargeable toner having toner particles and an external additive and a magnetic-fine-particle-dispersed resin carrier;

wherein;

i) said magnetic-fine-particle-dispersed resin carrier comprises composite particles containing at least inorganic compound particles and a binder resin;

said inorganic compound particles having been surface-treated with a lipophilic-treating agent having at least one type of functional group (A) selected from the group consisting of an epoxy group, an amino group, a mercapto group, an organic acid group, an ester group, a ketone group, an alkyl halide group and an aldehyde group, or a mixture of the agent; and said composite particles having been surface-coated with at least one type of resin having at least one type of functional group (c) different from the functional group (A) the lipophilic-treating agent has;

said functional group (C) the resin has being a functional group or groups selected from the group consisting of an epoxy group, an amino group, an organic acid group, an ester group, a ketone group, an alkyl halide group, a hydroxyl group and a chloro group; and ii) said negatively chargeable toner has a weight-average particle diameter of from 3 μm to 9 μm.

52. The developer according to claim 51, wherein said external additive has a number-average particle diameter of from 3 nm to 100 nm.

53. The developer according to claim 51, wherein said external additive has a BET specific surface area of from 30 $m^2/g$ to 400 $m^2/g$.

54. The developer according to claim 51, wherein said external additive has a BET specific surface area of from 50 $m^2/g$ to 400 $m^2/g$.

55. The developer according to claim 51, wherein said external additive is a fine powder of a metal compound or a composite of a metal compound.

56. The developer according to claim 51, wherein said external additive is a hydrophobic fine silica powder, a hydrophobic fine titanium oxide powder or a hydrophobic fine alumina powder.

57. The developer according to claim 51, wherein said external additive is externally added in an amount of from 0.1 to 10.0 parts by weight based on 100 parts by weight of said toner particles.

58. The developer according to claim 51, wherein said external additive is externally added in an amount of from 0.5 to 5.0 parts by weight based on 100 parts by weight of said toner particles.

59. The developer according to claim 51, wherein said negatively chargeable toner has a weight-average particle diameter of from 4.5 μm to 8.5 μm.

60. The developer according to claim 51, wherein in said negatively chargeable toner the cumulative value of distribution of diameter ½-time or less the number-average particle diameter is not more than 20% by number and the cumulative value of distribution of diameter twice or more the weight-average particle diameter is not more than 10% by volume.

61. The developer according to claim 51, wherein said negatively chargeable toner has a weight-average particle diameter of from 4.5 μm to 8.5 μm, and in said toner the cumulative value of distribution of diameter ½-time or less the number-average particle diameter is not more than 20% by number and the cumulative value of distribution of diameter twice or more the weight-average particle diameter is not more than 10% by volume.

62. The developer according to claim 51, wherein said negatively chargeable toner has a shape factor SF-1 of from 100 to 140.

63. The developer according to claim 51, wherein said negatively chargeable toner has a shape factor SF-1 of from 100 to 130.

64. The developer according to claim 51, wherein said negatively chargeable toner contains a wax in an amount of from 1 part by weight to 40 parts by weight based on 100 parts by weight of the binder resin.

65. The developer according to claim 51, wherein said negatively chargeable toner contains a solid wax in an amount of from 1 part by weight to 40 parts by weight based on 100 parts by weight of the binder resin.

66. The developer according to claim 51, wherein said negatively chargeable toner contains a wax having a ratio of weight-average molecular weight (Mw) to number-average molecular weight (Mn), Mw/Mn, of not more than 1.45.

67. The developer according to claim 51, wherein said negatively chargeable toner contains a wax having a ratio of weight-average molecular weight (Mw) to number-average molecular weight (Mm), Mw/Mn, of not more than 1.30.

68. The developer according to claim 51, wherein said negatively chargeable toner contains a metal compound of an aromatic hydroxycarboxylic acid.

69. The developer according to claim 51, wherein said toner particles are polymerization toner particles produced by a polymerization process.

70. The developer according to claim 51, wherein said lipophilic-treating agent with which said inorganic compound particles have been surface-treated is a lipophilic-treating agent having at least one type of functional group (A) selected from the group consisting of an epoxy group, an amino group and a mercapto group.

71. The developer according to claim 51, wherein said lipophilic-treating agent with which said inorganic compound particles have been surface-treated is a lipophilic-treating agent having at least an epoxy group.

72. The developer according to claim 51, wherein said lipophilic-treating agent is a coupling agent.

73. The developer according to claim 51, wherein said lipophilic-treating agent is a silane coupling agent, a titanium coupling agent or an aluminum coupling agent.

74. The developer according to claim 51, wherein said lipophilic-treating agent is a silane coupling agent.

75. The developer according to claim 51, wherein said inorganic compound particles have been treated with said lipophilic-treating agent in an amount of from 0.1% by weight to 5.0% by weight based on the weight of said inorganic compound particles.

76. The developer according to claim 51, wherein said binder resin is a thermosetting resin.

77. The developer according to claim 51, wherein said binder resin is a thermosetting resin containing at least a phenolic resin.

78. The developer according to claim 51, wherein said resin with which said composite particles have been surface-coated is a resin having at least one type of functional group (C) selected from the group consisting of an epoxy group, an amino group, an organic acid group, an ester group, a ketone group and an alkyl halide group.

79. The developer according to claim 51, wherein said resin with which said composite particles have been surface-coated is a resin having at least one type of functional group (C) selected from the group consisting of an epoxy group, an amino group and an organic acid group.

80. The developer according to claim 51, wherein said resin with which said composite particles have been surface-coated is a resin having at least an amino group.

81. The developer according to claim 51, wherein said resin with which said composite particles have been surface-coated is in a coating weight of not less than 0.05% by weight based on the weight of said composite particles.

82. The developer according to claim 51, wherein said resin with which said composite particles have been surface-coated is in a coating weight of from 0.1% by weight to 10.0% by weight based on the weight of said composite particles.

83. The developer according to claim 51, wherein said resin with which said composite particles have been surface-coated is in a coating weight of from 0.2% by weight to 5.0% by weight based on the weight of said composite particles.

84. The developer according to claim 51, wherein said composite particles have been further surface-coated with an additional resin.

85. The developer according to claim 51, wherein said composite particles have been further surface-coated with a silicone resin.

86. The developer according to claim 51, wherein said composite particles have been further surface-coated with a silicone resin containing a coupling agent.

87. The developer according to claim 51, wherein said composite particles have been further surface-coated with a silicone resin containing a coupling agent having an amino group.

88. The developer according to claim 51, wherein said composite particles have been further surface-coated with an additional resin in a coating weight of not less than 0.05% by weight based on the weight of said composite particles.

89. The developer according to claim 51, wherein said composite particles have been further surface-coated with a resin in a coating weight of from 0.1% by weight to 10% by weight based on the weight of said composite particles.

90. The developer according to claim 51, wherein said magnetic-fine-particle-dispersed resin carrier has a weight-average particle diameter of from 10 $\mu$m to 50 $\mu$m.

91. The developer according to claim 51, wherein said magnetic-fine-particle-dispersed resin carrier has a weight-average particle diameter of from 15 $\mu$m to 45 $\mu$m.

92. The developer according to claim 51, wherein said magnetic-fine-particle-dispersed resin carrier has a true specific gravity of from 2.5 to 4.5, a magnetization intensity $\sigma_{1,000}$ of from 15 $Am^2/kg$ to 60 $Am^2/kg$ (emu/g) and a residual magnetization or of from 0.1 $Am^2/kg$ to 20 $Am^2/kg$ as measured under application of a magnetic field of 79.6 kA/m (1 kOe), and has a resistivity of from $5\times10^{11}$ $\Omega\cdot$cm to $5\times10^{15}$ $\Omega\cdot$cm.

93. The developer according to claim 51, wherein said magnetic-fine-particle-dispersed resin carrier has a shape factor SF-1 of from 100 to 130.

94. The developer according to claim 51, wherein said magnetic-fine-particle-dispersed resin carrier has a shape factor SF-1 of from 100 to 120.

95. The developer according to claim 51, wherein said inorganic compound particles contain at least magnetic fine particles.

96. The developer according to claim 51, wherein said inorganic compound particles contain at least a magnetic iron compound.

97. The developer according to claim 51, wherein said inorganic compound particles contain at least a magnetic iron oxide compound.

98. The developer according to claim 97, wherein said magnetic iron oxide compound contains a different type of oxide or hydroxide, or both of them.

99. The developer according to claim 98, wherein said different type of oxide or hydroxide is an oxide or hydroxide of silicon or aluminum.

100. The developer according to claim 51, wherein said inorganic compound particles contain magnetic fine particles and non-magnetic inorganic compound particles.

101. The developer according to claim 100, wherein said magnetic fine particles have number-average particle diameter a and said non-magnetic inorganic compound particles have number-average particle diameter b which are a<b.

102. The developer according to claim 101, wherein said a is from 0.02 $\mu$m to 2 $\mu$m, said b is from 0.05 $\mu$m to 5 $\mu$m, and 1.5 a<b.

103. The developer according to claim 100, wherein said inorganic compound particles contain a magnetic iron compound and a non-magnetic iron oxide.

104. An image forming method comprising;

charging an electrostatic image bearing member electrostatically by a charging means;

exposing the electrostatic image bearing member thus charged, to form an electrostatic image on the electrostatic image bearing member;

developing the electrostatic image by a developing means having a two-component type developer, to form a toner image on the electrostatic image bearing member;

transferring the toner image formed on the electrostatic image bearing member, to a transfer medium via, or not via, an intermediate transfer member; and fixing the toner image on the transfer medium by a heat-and-pressure fixing means;

said two-component type developer comprising a negatively chargeable toner having toner particles and an external additive and a magnetic-fine-particle-dispersed resin carrier;

wherein;

i) said magnetic-fine-particle-dispersed resin carrier comprises composite particles containing at least inorganic compound particles and a binder resin;

said inorganic compound particles having been surface-treated with a lipophilic-treating agent having at least one type of functional group (A) selected from the group consisting of an epoxy group, an amino group, a mercapto group, an organic acid group, an ester group, a ketone group, an alkyl halide group and an aldehyde group, or a mixture of the agent; and said composite particles having been surface-coated with at least one type of coupling agent having at least one type of functional group (B) different from the functional group (A) the lipophilic-treating agent has;

said functional group (B) the coupling agent has being a functional group or groups selected from the group consisting of an epoxy group, an amino group and a mercapto group; and ii) said negatively chargeable toner has a weight-average particle diameter of from 3 $\mu$m to 9 $\mu$m.

105. The method according to claim 104, wherein said developing means has a developing sleeve provided internally with a magnetic field generating means, and the electrostatic image is developed with said two-component type developer while applying an alternating bias, a pulse bias or a blank pulse bias to the developing sleeve.

106. The method according to claim 105, wherein said magnetic field generating means is a stationary magnet, and the electrostatic image is developed under conditions that the magnetic field at the surface of the developing sleeve in the developing zone has an intensity of from 39.8 kA/m to 79.6 kA/m (500 Oe to 1,000 Oe).

107. The method according to claim 104, wherein said electrostatic image is a digital latent image, and the digital latent image is developed by reverse development.

108. The method according to claim 104, wherein said electrostatic image bearing member is a photosensitive drum having an organic photoconductor photosensitive layer.

109. An image forming method comprising:

charging an electrostatic image bearing member electrostatically by a charging means;

exposing the electrostatic image bearing member thus charged, to form an electrostatic image on the electrostatic image bearing member;

developing the electrostatic image by a developing means having a two-component type developer, to form a toner image on the electrostatic image bearing member;

transferring the toner image formed on the electrostatic image bearing member, to a transfer medium via, nor not via, an intermediate transfer member; and fixing the toner image on the transfer medium by a heat-and-pressure fixing means;

said two-component type developer comprising a negatively chargeable toner having toner particles and an external additive and a magnetic-fine-particle-dispersed resin carrier;

wherein i) said magnetic-fine-particle-dispersed resin carrier comprises composite particles containing at least inorganic compound particles and a binder resin;

said inorganic compound particles having been surface-treated with a lipophilic-treating agent having at least one type of functional group (A) selected from the group consisting of an epoxy group, an amino group, a mercapto group, an organic acid group, an ester group, a ketone group, an alkyl halide group and an aldehyde group, or a mixture of the agent; and said composite particles having been surface-coated with at least one type of coupling agent having at least one type of functional group (B) different from the functional group (A) of the lipophilic-treating agent;

said functional group (B) of the coupling agent being a functional group or groups selected from the group consisting of an epoxy group, an amino group and a mercapto group; and (ii) said negatively chargeable toner has a weight-average particle diameter from 3 $\mu$m to 9 $\mu$m; and wherein said two-component type developer is a two-component type developer according to a claim selected from claims 2 to 50.

110. An image forming method comprising:

charging an electrostatic image bearing member electrostatically by a charging means;

exposing the electrostatic image bearing member thus charged, to form an electrostatic image on the electrostatic image bearing member;

developing the electrostatic image by a developing means having a two-component type developer, to form a toner image on the electrostatic image bearing member;

transferring the toner image formed on the electrostatic image bearing member, to a transfer medium via, or not via, an intermediate transfer member; and fixing the toner image on the transfer medium by a heat-and-pressure fixing means;

said two-component type developer comprising a negatively chargeable toner having toner particles and an external additive and a magnetic-fine-particle-dispersed resin carrier;

wherein;

i) said magnetic-fine-particle-dispersed resin carrier comprises composite particles containing at least inorganic compound particles and a binder resin;

said inorganic compound particles having been surface-treated with a lipophilic-treating agent having at least one type of functional group (A) selected from the group consisting of an epoxy group, an amino group, a mercapto group, an organic acid group, an ester group, a ketone group, an alkyl halide group and an aldehyde group, or a mixture of the agent; and said composite particles having been surface-coated with at least one type of resin having at least one type of functional group (C) different from the functional group (A) the lipophilic-treating agent has;

said functional group (C) the resin has being a functional group or groups selected from the group consisting of an epoxy group, an amino group, an organic acid group, an ester group, a ketone group, an alkyl halide group, a hydroxyl group and a chloro group; and ii) said negatively chargeable toner has a weight-average particle diameter of from 3 $\mu$m to 9 $\mu$m.

111. The method according to claim 110, wherein said developing means has a developing sleeve provided internally with a magnetic field generating means, and the electrostatic image is developed with said two-component type developer while applying an alternating bias, a pulse bias or a blank pulse bias to the developing sleeve.

112. The method according to claim 111, wherein said magnetic field generating means is a stationary magnet, and the electrostatic image is developed under conditions that the magnetic field at the surface of the developing sleeve in the developing zone has an intensity of from 39.8 kA/m to 79.6 kA/m (500 Oe to 1,000 Oe).

113. The method according to claim 110, wherein said electrostatic image is a digital latent image, and the digital latent image is developed by reverse development.

114. The method according to claim 110, wherein said electrostatic image bearing member is a photosensitive drum having an organic photoconductor photosensitive layer.

115. An image forming method comprising:

charging an electrostatic image bearing member electrostatically by a charging means;

exposing the electrostatic image bearing member thus charged, to form an electrostatic image on the electrostatic image bearing member;

developing the electrostatic image by a developing means having a two-component type developer, to form a toner image on the electrostatic image bearing member;

transferring the toner image formed on the electrostatic image bearing member, to a transfer medium via, nor not via, an intermediate transfer member; and fixing the toner image on the transfer medium by a heat-and-pressure fixing means;

said two-component type developer comprising a negatively chargeable toner having toner particles and an external additive and a magnetic-fine-particle-dispersed resin carrier;

wherein (i) said magnetic-fine-particle-dispersed resin carrier comprises composite particles containing at least inorganic compound particles and a binder resin;

said inorganic compound particles having been surface-treated with a lipophilic-treating agent having at least one type of functional group (A) selected from the group consisting of an epoxy group, an amino group, a mercapto group, an organic acid group, an ester group, a ketone group, an alkyl halide group and an aldehyde group, or a mixture of the agent; and said composite particles having been surface-coated with at least one type of resin having at least one type of functional group (C) different from the functional group (A) of the lipophilic-treating agent;

said functional group (C) of the resin being a functional group or groups selected from the group consisting of an epoxy group, an amino group, an organic acid group, an ester group, a ketone group, an alkyl halide group, a hydroxyl group and a chloro group; and (ii) said negatively chargeable toner has a weight-average particle diameter from 3 $\mu$m to 9 $\mu$m; and wherein said two-component type developer is a two-component type developer according to a claim selected from claims 52 to 103.

* * * * *

UNITED STATES PATENT AND TRADEMARK OFFICE

CERTIFICATE OF CORRECTION

PATENT NO. : 6,312,862 B1
DATED : November 6, 2001
INVENTOR(S) : Kenji Okado et al.

It is certified that error appears in the above-identified patent and that said Letters Patent is hereby corrected as shown below:

Column 3,
Line 16, “No” should read -- No. --.

Column 6,
Line 40, “In” should read -- in --.

Column 7,
Line 22, “counter Specific” should read -- counter. Specific --.

Column 8,
Line 50, “dollnone” should read -- dolinone --.

Column 9,
Line 1, “used Stated” should read -- used. Stated --.

Column 10,
Line 23, “10º C./min” should read -- 10ºC/min --; and
Line 27, “30 mpas.sec.” should read -- 30mPas·sec. --.

Column 12,
Line 23, “Is” should read -- is --.

Column 13,
Line 17, “layers A” should read -- layers. A --; and
Line 43, “combination Thereafter,” should read -- combination. Thereafter, --.

Column 14,
Line 9, “fixed After” should read -- fixed. After --.

Column 15,
Line 5, “Inorganic” should read -- inorganic --;
Line 14, “hydroxystearic” should read -- (hydroxystearic --; and
Line 27, “are- In” should read -- are. In --.

Column 17,
Line 15, “occur The” should read -- occur. ¶ The --; and
Line 58, “used Silicone” should read -- used. Silicone --.

Column 18,
Line 55, “carrier The” should read -- carrier. ¶ The --; and “In” should read -- in --.

UNITED STATES PATENT AND TRADEMARK OFFICE

CERTIFICATE OF CORRECTION

PATENT NO. : 6,312,862 B1
DATED : November 6, 2001
INVENTOR(S) : Kenji Okado et al.

It is certified that error appears in the above-identified patent and that said Letters Patent is hereby corrected as shown below:

Column 20,
Line 15, “benzaldehyde In” should read -- benzaldehyde. ¶ In --;
Line 18, “particles If” should read -- particles. If --;
Line 21, “particles Also” should read -- particles. ¶ Also --; and
Lines 24 and 41, “In” should read -- in --.

Column 23,
Line 66, “t” should read -- % --.

Column 26,
Line 31, “preferred If” should read -- preferred. If --.

Column 27,
Line 45, “Is” should read -- is --.

Column 28,
Line 58, “drying In” should read -- drying. In --.

Column 30,
Line 47, “be.” should read -- be --.

Column 31,
Line 34, “occur If” should read -- occur. If --; and
Line 63, “formed- In” should read -- formed. In --.

Column 32,
Line 58, “In” should read -- in --; and
Line 67, “101 In” should read -- 101. In --.

Column 33,
Line 14, “Is” should read -- is --.

Column 35,
Line 12, “In” should read -- in --.

Column 36,
Line 26, “(not shown) The” should read -- (not shown). The --.

UNITED STATES PATENT AND TRADEMARK OFFICE

CERTIFICATE OF CORRECTION

PATENT NO. : 6,312,862 B1
DATED : November 6, 2001
INVENTOR(S) : Kenji Okado et al.

It is certified that error appears in the above-identified patent and that said Letters Patent is hereby corrected as shown below:

Column 37,
Line 9, "5*b*" should read -- 8*b* --;
Line 20, "Is" should read -- is --;
Line 23, "completed," should read -- completed. --; and
Line 56, "51 a" should read -- 51a --.

Column 38,
Line 29, "p As" should read -- ¶ As --.

Column 40,
Line 26, "size Number" should read -- size. Number --; and
Line 42, "In" should read -- in --.

Column 41,
Line 1, "SF-52" should read -- SF-2 --.

Column 42,
Line 3, "γ-aminopropyltrimethoxysilane During" should read -- γ-aminopropyltrimethoxysilane. During --;
Line 20, "Shln-Etsu" should read -- Shin-Etsu --; and
Line 67, "Table 1." should read -- Table 1 --.

| Magnetic Carrier Production Example 5 | (by weight) |
|---|---|
| Styrene-methyl methacrylate resin | 100 parts |
| Fine magnetic particles used in production Example 1 | 100 parts |

--.

Column 43,
Line 24, "Production Example 1" should read -- Production Example 1 120 parts --.

Column 44,
Line 19, "&" should be deleted.

Column 50,
Line 26, "25%" should read -- 28% --.

Column 52,
Line 64, "$3\times10^{5}$" should read -- $3\times10^{8}$ --.

UNITED STATES PATENT AND TRADEMARK OFFICE

CERTIFICATE OF CORRECTION

PATENT NO. : 6,312,862 B1
DATED : November 6, 2001
INVENTOR(S) : Kenji Okado et al.

It is certified that error appears in the above-identified patent and that said Letters Patent is hereby corrected as shown below:

Column 54,
Line 18, "$\alpha Fe_2O_3$" should read -- $\alpha$-$Fe_2O_3$ --.

Column 58,
Line 49, "metboxysilene" should read -- methoxysilene --.

Column 59,
Line 61, "sate" should read -- same --; and
Line 65, "toner" should read -- Toner --.

Column 61,
Line 56, "Fog (%)=Dr (%)=-Ds (%)." should read -- Fog (%)=Dr (%)-Ds (%). --.

Column 62,
Line 6, "In" should read -- in --; and
Line 39, "to" should read -- to 11. --.

Column 63,
Line 19, "Ltd-)" should read -- Ltd.) --.

Column 66,
Line 1, "filtration" should read -- filtration, --.

Column 75,
Table 6, "10B" should read -- 108 --.

UNITED STATES PATENT AND TRADEMARK OFFICE

CERTIFICATE OF CORRECTION

PATENT NO. : 6,312,862 B1
DATED : November 6, 2001
INVENTOR(S) : Kenji Okado et al.

It is certified that error appears in the above-identified patent and that said Letters Patent is hereby corrected as shown below:

Column 77,

Table 8, "35, 40, 45, 50, 55, 60, 65" should be deleted. Table 8 should read

-- Table 8 (Normal Temperature/Normal Humidity)

| | Image density | | Carrier adhesion | | Fog | | Toner scatter | | Carrier contami. | | Line spots | | Charge quantity of toner on developing sleeve | |
|---|---|---|---|---|---|---|---|---|---|---|---|---|---|---|
| | (I) | (II) | (I) | (II) | (I) | (II) | (I) | (II) | (I) | (II) | (I) | (II) | (I) (μC/g) | (II) (μC/g) |
| Example: | | | | | | | | | | | | | | |
| 11 | 1.47 | 1.48 | A | A | A | A | A | A | A | A | A | A | -27.8 | -27.5 |
| 12 | 1.42 | 1.39 | A | A | A | B | A | A | A | A | A | A | -21.6 | -18.7 |
| 13 | 1.50 | 1.51 | B | B | B | B | A | B | A | A | A | B | -23.8 | -23.7 |
| 14 | 1.39 | 1.32 | B | B | A | B | A | B | A | B | B | B | -29.0 | -31.9 |
| 15 | 1.46 | 1.48 | A | A | A | A | B | B | B | B | A | A | -26.4 | -25.3 |
| 16 | 1.47 | 1.50 | B | A | A | A | B | B | B | B | A | A | -25.8 | -24.6 |
| 17 | 1.46 | 1.48 | A | A | B | B | A | A | B | B | B | A | -29.3 | -30.6 |
| 18 | 1.47 | 1.45 | B | B | B | B | A | A | B | B | B | B | -29.7 | -30.9 |
| 19 | 1.45 | 1.46 | B | B | B | B | A | A | B | B | B | B | -30.4 | -31.9 |
| 20 | 1.46 | 1.47 | A | A | A | A | A | A | A | A | A | A | -27.5 | -31.5 |
| 21 | 1.47 | 1.49 | A | A | A | A | A | A | A | A | A | A | -24.9 | -26.8 |
| 22 | 1.45 | 1.47 | A | A | A | A | A | B | A | A | A | A | -24.4 | -25.9 |
| 23 | 1.46 | 1.47 | A | A | B | B | A | A | A | B | A | B | -23.5 | -25.3 |
| 24 | 1.46 | 1.45 | A | A | A | A | A | A | B | B | A | B | -27.9 | -30.4 |
| 25 | 1.47 | 1.51 | A | A | A | B | A | A | A | B | A | B | -27.8 | -23.7 |
| 26 | 1.48 | 1.52 | A | A | A | B | A | A | A | B | A | B | -29.8 | -30.9 |
| 27 | 1.41 | 1.43 | A | A | B | B | B | B | B | B | A | A | -29.8 | -32.7 |
| 28 | 1.50 | 1.50 | A | A | A | A | A | A | B | B | B | B | -21.6 | -24.1 |
| 29 | 1.51 | 1.50 | A | A | B | B | B | B | B | B | B | B | -20.8 | -19.9 |
| 30 | 1.48 | 1.51 | A | A | A | A | A | B | A | A | A | A | -25.8 | -25.7 |
| 31 | 1.47 | 1.51 | A | A | A | B | A | B | A | A | A | A | -29.9 | -28.6 |
| Comparative Example: | | | | | | | | | | | | | | |
| 6 | 1.39 | 1.34 | A | A | B | C | B | D | A | D | B | C | -14.3 | -10.5 |
| 7 | 1.24 | 1.27 | A | A | B | C | B | C | A | C | C | D | -20.8 | -16.2 |
| 8 | 1.42 | 1.38 | A | A | B | B | B | C | C | D | B | C | -27.4 | -26.9 |
| 9 | 1.47 | 1.46 | A | A | B | C | A | A | C | D | B | C | -30.5 | -29.2 |
| 10 | 1.47 | 1.30 | B | A | A | C | A | B | A | C | A | B | -24.7 | -20.3 |
| 11 | 1.48 | 1.29 | B | A | B | C | A | B | A | D | A | B | -24.9 | -19.7 |
| 12 | 1.39 | 1.38 | A | A | A | B | B | C | A | A | A | A | -12.8 | -10.5 |

(I): Initial stage; (II): 20,000 sheets--.

UNITED STATES PATENT AND TRADEMARK OFFICE

CERTIFICATE OF CORRECTION

PATENT NO. : 6,312,862 B1
DATED : November 6, 2001
INVENTOR(S) : Kenji Okado et al.

It is certified that error appears in the above-identified patent and that said Letters Patent is hereby corrected as shown below:

Column 79,
Table 9, "1.45" (first occurrence) should read -- 1.46 --.

Column 90,
Line 55, "(Mm)," should read -- (Mn), --.

Column 92,
Line 13, "or" should read -- σr --.

Signed and Sealed this

Seventeenth Day of June, 2003

JAMES E. ROGAN
*Director of the United States Patent and Trademark Office*